US010224637B2

(12) United States Patent
Roy

(10) Patent No.: US 10,224,637 B2
(45) Date of Patent: Mar. 5, 2019

(54) RECIPROCAL CIRCULAR POLARIZATION SELECTIVE SURFACES AND ELEMENTS THEREOF

(71) Applicant: Jasmin Roy, Gatineau (CA)

(72) Inventor: Jasmin Roy, Gatineau (CA)

( * ) Notice: Subject to any disclaimer, the term of this patent is extended or adjusted under 35 U.S.C. 154(b) by 197 days.

(21) Appl. No.: 15/204,289

(22) Filed: Jul. 7, 2016

(65) Prior Publication Data

US 2016/0315394 A1 Oct. 27, 2016

Related U.S. Application Data

(63) Continuation-in-part of application No. 13/936,490, filed on Jul. 8, 2013, now Pat. No. 9,391,374.

(60) Provisional application No. 61/669,409, filed on Jul. 9, 2012, provisional application No. 61/669,978, filed on Jul. 10, 2012.

(51) Int. Cl.

| | |
|---|---|
| ***H01Q 15/02*** | (2006.01) |
| ***H01Q 15/24*** | (2006.01) |
| ***H01Q 1/50*** | (2006.01) |

(52) U.S. Cl.

CPC ..... *H01Q 15/24* (2013.01); *H01Q 1/50* (2013.01); *H01Q 15/02* (2013.01)

(58) Field of Classification Search

CPC ..... H01Q 15/24; H01Q 1/50; H01Q 15/02
USPC ..... 343/702, 700 MS, 909, 756
See application file for complete search history.

(56) References Cited

U.S. PATENT DOCUMENTS

| | | | | |
|---|---|---|---|---|
| 3,271,771 | A | 9/1966 | Hannan et al. | 343/756 |
| 3,500,420 | A | 3/1970 | Pierrot | 343/756 |
| 4,652,891 | A | 3/1987 | Bossuet et al. | 343/909 |
| 4,728,961 | A | 3/1988 | Bossuet et al. | 343/756 |
| 5,053,785 | A | 10/1991 | Tilston et al. | 343/756 |
| 5,280,298 | A | 1/1994 | Morin | 343/909 |
| 6,417,813 | B1 | 7/2002 | Durham | 343/753 |

(Continued)

FOREIGN PATENT DOCUMENTS

| | | | |
|---|---|---|---|
| CA | 2062029 | 8/1993 | H01Q 15/22 |

OTHER PUBLICATIONS

Mener, S.; Gillard, R.; Sauleau, R.; Cheymol, C.; Potier, P. "An improved topology for reconfigurable CPSS-based reflectarray cell", *Antennas and Propagation (EUCAP), 2013 7th European Conference on*, On pp. 2721-2725.

(Continued)

*Primary Examiner* — Hai Tran
(74) *Attorney, Agent, or Firm* — Teitelbaum Bouevitch & McLachlen; Neil Teitelbaum

(57) ABSTRACT

A reciprocal circular polarization selective surface (CPSS) is formed of two mutually orthogonal arrays of dipoles disposed at opposite transverse CPSS faces, with opposing orthogonal dipoles individually connected by transmission lines, wherein adjacent dipoles are EM coupled for enhancing CPSS performance. In one implementation, the CPSS comprises a two-dimensional array of double-crankwire elements each having a 2-fold rotational symmetry and composed of two separate crankwires of the same handedness, with the array elements positioned to impart EM coupling between adjacent array elements for enhanced performance at normal and oblique angles of incidence. Square-array and triangular-array CPSSs are disclosed.

20 Claims, 34 Drawing Sheets

(56) References Cited

U.S. PATENT DOCUMENTS

2004/0090385 A1* 5/2004 Green ..... H01Q 1/245 343/702
2007/0188399 A1* 8/2007 Rickenbrock ..... H01Q 1/36 343/803
2011/0291907 A1* 12/2011 Puzella ..... H01P 5/10 343/816

OTHER PUBLICATIONS

Mener, S.; Gillard, R.; Sauleau, R.; Cheymol, C.; Potier, P. "Design and Characterization of a CPSS-Based Unit-Cell for Circularly Polarized Reflectarray Applications", *Antennas and Propagation, IEEE Transactions on*, On pp. 2313-2318 vol. 61, Issue: 4, Apr. 2013.

Sanz-Fernandez, J.; Saenz, E.; de Maagt, P. "Experimental demonstration of low Axial-Ratio Circular Polarization Selective Surface", *Antennas and Propagation Society International Symposium (APSURSI), 2013 IEEE*, On pp. 474-475.

Joyal, M.-A.; Laurin, J.-J. "Design and Analysis of a Cascade Circular Polarization Selective Surface at K Band", *Antennas and Propagation, IEEE Transactions on*, On pp. 3043-3053 vol. 62, Issue: 6, Jun. 2014.

Lopez, I.; Laurin, J.-J. "A Circular Polarization Selective Surface Implemented on a Flexible Substrate", *Antennas and Propagation, IEEE Transactions on*, On pp. 3847-3852 vol. 62, Issue: 7, Jul. 2014.

Mener, S.; Gillard, R.; Sauleau, R.; Cheymol, C.; Potier, P. "Unit Cell for Reflectarrays Operating With Independent Dual Circular Polarizations", *IEEE Antennas and Wireless Propagation Letters*, On pp. 1176-1179 vol. 13, Apr. 2014.

Sjoberg, Daniel; Ericsson, Andreas "A multi layer meander line circular polarization selective structure (MLML-CPSS)", *Antennas and Propagation (EuCAP), 2014 8th European Conference on*, On pp. 464-468.

Sanz-Fernandez, Juanjo; Saenz, Elena; de Maagt, Peter "Oblique incidence measurements of circular polarization selective surfaces", *Antennas and Propagation (EuCAP), 2014 8th European Conference on*, On pp. 479-481.

Selvanayagam, M.; Eleftheriades, G. V. "Polarization Control Using Tensor Huygens Surfaces", *Antennas and Propagation, IEEE Transactions on*, On pp. 6155-6168 vol. 62, Issue: 12, Dec. 2014.

Ericsson, Andreas; Sjoberg, Daniel "A resonant circular polarization selective structure of closely spaced wire helices", *General Assembly and Scientific Symposium (URSI GASS)*, Beijing, On pp. 1-9, vol. Issue: , Aug. 16-23, 2014.

Martinez-Lopez, L.; Rodriguez-Cuevas, J.; Martinez-Lopez, J.J.; Martynyuk, A.E. "Cascaded circular-polarisation-selective-surface based on bisected split rings", Electronics Letters, On pp. 1335-1336 vol. 50, Issue 19, Sep. 11, 2014.

Lopez, I.; Laurin, J.-J. "Alternative Topologies of Circular Polarization Selective Surfaces Based on Modifications of the Pierrot Cell", *Antennas and Propagation, IEEE Transactions on*, On pp. 1465-1472 vol. 63, Issue: 4, Apr. 2015.

Sanz-Fernandez, J.; Saenz, E.; de Maagt, P. "A Circular Polarization Selective Surface for Space Applications", *Antennas and Propagation, IEEE Transactions on*, On pp. 2460-2470 vol. 63, Issue: 6, Jun. 2015.

Ericsson, Andreas; Sjoberg, Daniel "A performance study of circular polarization selective structures", *Antennas and Propagation (EuCAP), 2015 9th European Conference on*, On pp. 1-5, vol. Issue: , May 13-17, 2015.

Sjoberg, D. "Time domain characterization of circular polarization selective structures", *Electromagnetics in Advanced Applications (ICEAA), 2015 International Conference on*, On pp. 1373-1376.

Wenxing Tang; Goussetis, G.; Fonseca, N.J.G.; Legay, H.; Saenz, E.; De Maagt, P. "Study of coupled split-ring resonator arrays for circular polarization selective surface", *Antennas and Propagation & USMC/URSI National Radio Science Meeting, 2015 IEEE International Symposium on*, On pp. 362-363.

Selvanayagam, M.; Eleftheriades, G. V. "Design and Measurement of Tensor Impedance Transmitarrays for Chiral Polarization Control", *Microwave Theory and Techniques, IEEE Transactions on*, On pp. 414-428 vol. 64, Issue: 2, Feb. 2016.

Cappellin, C; Sjoberg, Daniel; Ericsson, Andreas; Bailin, P.; Gerini, G.; Fonseca, N.J.G.; De Maagt, P. "Design and Analysis of a Reflector Antenna System Based on Doubly Curved Circular Polarization Selective Surfaces", *Antennas and Propagation (EuCAP), 2016 10th European Conference on*, On pp. 1-5, vol. Issue: , Apr. 10-15, 2016.

W.V. Tilston, C. Cannon, Y. Sabourin and A. Hurd, A Polarization Selective Surface for Circular Polarization, DREO Contract #2SV84-00198, Tiltek, Final Report, Mar. 30, 1986.

W.V. Tilston, T. Tralman and S.M. Khanna, "A Polarization Selective Surface for Circular Polarization", Proc. IEEE AP-Symposium, 1988, vol. II, pp. 762-765.

D.A. Tilston and J. Towne, Development of a 15 GHz Circular Polarization Selective Surface, DREO Contract #W7714-8-5651/01-SV, Final Report, 1989.

Y.L. Chow, Analytical Study of the Circular Polarization Selective Surfaces—7.75 and 15 GHz, DREO Contract #W7714-8-5652/01-SS , Final Report, Mar. 1990.

G.A. Morin, "A Simple Circular Polarization Selective Surface (CPSS)", Digest of IEEE AP-S International Symposium, Merging technologies for the 90's, May 1990, vol. 1, pp. 100-103.

Jasmin E. Roy, Jafar Shaker and Lot Shafai, Theoretical Study of a Circularly Polarized Symmetric Cassegrain Antenna using a CPSS Subreflector, DREO Contract #W7714-0-9439/01-SS, Final report, Mar. 31, 1992.

S. Mener, R. Gillard, R. Sauleau, C. Cheymol and P. Potier, "Design and Characterisation of a CPSS-Based Unit-Cell for Circularly Polarized Reflectarray Applications", IEEE Trans. on AP-S, vol. 61, No. 4, Apr. 2013, pp. 2313-2318.

G.A. Morin, A circular polarization selective surface made of resonant helices, Defence Research Establishment Ottawa, Report No. 1269, Nov. 1995, pp. 1-37.

Jasmin E. Roy, Reciprocal Circular Polarization Selective Surface, Ph.D. dissertation, Department of Electrical and Computer Engineering, University of Manitoba, Manitoba, Canada, 1995.

Jasmin E. Roy, and L. Shafai, "Reciprocal Circular-Polarization-Selective Surface", IEEE Antennas and Propagation Magazine, vol. 38, No. 6, Dec. 1996, pp. 18-33.

Etienne Girard and Raphaël Gillard, Simulation de sources déphaseuses en double polarisation circulaire, Rapport d'études bibliographiques, IRER, Project RNRT ARRESAT, Feb. 18, 2000.

V. Fusco and B. Nair, "Circular polarization selective surface characterization and advanced applications", IEEE Proceedings H: Microwaves, Antennas and Propagation. vol. 153, No. 3, 2006, pp. 247-252.

I-Young Tarn and Shyh-Jong Chung, "A New Advance in Circular Polarization Selective Surface—A Three Layered CPSS Without Vertical Conductive Segments", IEEE Transactions on Antennas and Propagation, vol. 55, No. 2, Feb. 2007, pp. 460-467.

Jasmin E. Roy, "New Analysis of a Reciprocal Left Hand Circular Polarization Selective Surface (LHCPSS)", IEEE Antennas and Propagation Society International Symposium, Charleston, South Carolina, USA, Jun. 1-5, 2009, paper #204.4.

M.A. Joyal and J.J. Laurin, "A Cascaded Circular-Polarization-Selective Surface at K band", digest of the 2011 IEEE Int. Antennas Propagat. Symp., Spokane, Washington, Jul. 3-8, 2011, pp. 2657-2660.

Juanjo Sanz-Fernandez, Elena Saenz, Peter de Maagt, and Cyril Mangenot, "Circular Polarization Selective Surface for Dual-Optics CP Offset Reflector Antennas in Ku-band", Proceedings of the 6th European Conference on Antennas and Propagation (EUCAP), Prague, Czech Republic, Mar. 2012, pp. 2683-2687.

Simon Mener, Raphael Gillard, Ronan Sauleau, Cecile Cheymol, and Patrick Potier, "A CPSS-based Reflectarray Cell with Reconfigurable Capabilities", Proceedings of the 6th European Conference Antennas and Propagation (EUCAP), Prague, Czech Republic, Mar. 26-30, 2012.

(56) References Cited

OTHER PUBLICATIONS

Simon Mener, Raphael Gillard, Ronan Sauleau, Cecile Cheymol, and Patrick Potier, "Design of a CPSS-based Reflectarray Cell with Controllable Reflected Phase for Dual Circularly Polarized Reflecatarrays", Proceedings of the 15th International Symposium on Antenna Technology and Applied Electromagnetics, Toulouse, France, Jun. 25-28, 2012.

Jasmin E. Roy, "A New CPSS Element", IEEE Antennas and Propagation Society International Symposium, Chicago, Illinois, USA, Jul. 8-14, 2012, Session 364.2.

Teemu Niemi, Antti O. Karilainen, and Sergei A. Tretyakov, "Synthesis of Polarization Transformers", IEEE Trans. Antennas Propagat., vol. 61, No. 6, Jun. 2013, pp. 3102-3111.

Jasmin E. Roy, "A Numerical Technique for Computing the Values of Plane Wave Scattering Coefficients of a General Scatterer", IEEE Trans. Antennas Propagat., vol. AP 57, No. 12, Dec. 2009, pp. 3868-3881.

Jasmin E. Roy, "On Using a Closed Box as the Integration Surface with the FDTD Method", IEEE Trans. Antennas Propagat., vol. 60, No. 5, May 2012, pp. 2375-2379.

J.E. Roy and L. Shafai, "Generalized scattering matrix and symmetry principles for infinite planar structures", Can. J. Phys. 75, 1997, pp. 413-431.

D.G. Michelson and E.V. Jull, "Depolarizing Trihedral Corner Reflectors for Radar Navigation and Remote Sensing", IEEE Trans. on Antennas and Propagation., vol. 43, No. 5, May 1995, pp. 513-518.

"An Idea for Electromagnetic "Feedforward-Feedbackward" Media" by Moses et al. IEEE Transactions on Antennas and Propagation, vol. 47, No. 5, May 1999 pp. 918-928.

J.E. Roy, L. Shafai. "Reciprocal Circular Polarization—Selective Surface", Dec. 1996, IEEE Antennas and Propagation Magazine, vol. 38, No. 6, pp. 18-33.

* cited by examiner $$\varphi_L = \varphi_R = \varphi_g \pm 90^\circ$$

RECIPROCAL CIRCULAR POLARIZATION SELECTIVE SURFACES AND ELEMENTS THEREOF

CROSS-REFERENCE TO RELATED APPLICATIONS

The present disclosure is a continuation-in-part of a U.S. patent application Ser. No. 13/936,490 filed Jul. 8, 2013, which claims priority from U.S. Provisional Patent Application No. 61/669,978 filed Jul. 10, 2012, and U.S. Provisional Patent Application No. 61/669,409 filed Jul. 9, 2012, all of which are incorporated herein by reference.

TECHNICAL FIELD

The present disclosure generally relates to reciprocal circular polarization selective surfaces (CPSS), elements thereof and devices incorporating such surfaces, more specifically relates to CPSS arrays of 2-fold rotationally symmetrical double crankwire elements (DCE) with electromagnetic (EM) coupling between the DECs.

BACKGROUND

A Circular Polarization Selective Surface (CPSS) is a finite-thickness surface that predominately reflects one sense, or handedness, of a circular polarization (CP) of an incident electro-magnetic (EM) wave, and predominantly transmits the other sense of CP. An ideal reciprocal CPSS acts either as a mirror or a transparent window, depending on the sense of CP of the incident wave. A reciprocal CPSS is one for which the sense of CP of the predominantly reflected wave is the same as that of the incident wave. This is opposite to an ordinary reflection from an interface between two dielectric media or from a common metallic mirror, wherein the sense of the predominant CP of the reflected wave is opposite to that of the incident wave. Furthermore, the general operation of a reciprocal CPSS typically remains the same regardless of whether the CPSS is illuminated from one side or the other. In its simplest form, a prior art CPSS is a two-Dimensional (2D) periodic array of identical CPSS elements that lacks longitudinal reflection symmetry, is reciprocal, and with a Cartesian tiling configuration. In the context of this specification, the longitudinal direction is the direction that is normal to the CPSS. A CPSS is typically designed to CP-selectively reflect or transmit incident EM radiation of a particular frequency f, which is referred to hereinafter as the operating frequency, or simply the frequency. The wavelength $\lambda$ corresponding to the frequency f depends on the effective permittivity of the propagation medium.

U.S. Pat. No. 3,500,420 issued to Pierrot discloses an example of a CPSS array, wherein the CPSS element is a single crankwire that is illustrated in FIG. 1. Here, a crankwire is a conductive wire that is bent to be comprised of three mutually perpendicular conducting segments. In the Pierrot design, the lengths of two perpendicular end segments, which are also referred to herein as transverse segments (TS), is $3\lambda/8$, while the length of the middle, or longitudinal, segment is $\lambda/4$, with the total length of the crankwire equal to one wavelength $\lambda$. The relative orientation of the two transverse segments, i.e. the handedness of the geometry, dictates the operation of the CPSS element as to which sense of CP will be reflected upon being illuminated with a CP plane wave incident in the normal direction, i.e. a direction parallel with the longitudinal segment. Using Cartesian notation, when the longitudinal segment is aligned with the Z direction as illustrated in FIG. 1, the bottom transverse segment is aligned with the +X direction and the top transverse segment is aligned with the +Y direction, the crankwire reflects Left-Hand Circular Polarization (LHCP) when illuminated from the top or bottom, and a corresponding CPSS is referred to as a LHCPSS. With the top transverse segment aligned with the +X direction and the bottom transverse segment aligned with the +Y direction, the crankwire reflects Right-Hand Circular Polarization (RHCP) when illuminated from the top or bottom, and a corresponding CPSS is referred to as a RHCPSS. The crankwire has the same general operation whether it is illuminated from one end of its longitudinal axis or the other.

The two in-phase currents cooperate to produce a strong scattering response whereas the two out-of-phase currents nearly cancel one another to produce a weak scattering response. With the in-phase condition, the one-wavelength crankwire becomes resonant so that the current distribution over the entire length of the wire is sinusoidal-like, with a peak on each transverse segment and a null at the mid-point of the longitudinal segment. The relative orientation of the transverse segments that determines the handedness of the crankwire, and the $\lambda/4$ spacing between the transverse segments ensure that the sense of CP of the reflected wave is the same as that of the incident wave. Hence, the reflected wave is strong and the sense of its CP is the same as that of the incident wave. In contrast, the total transmitted field is very weak because the transmitted scattered wave is equal and opposite to the incident wave, and because the total transmitted field is the vectorial summation of the incident wave and the scattered wave. With the out-of-phase condition, the two out-of-phase currents produce a bell shape current distribution with a small peak value at the mid-length point of the longitudinal segment. Since this produces only a very weak scattering response, the incident wave goes through the crankwire with little or no disturbance as if the crankwire were absent.

A variation of the Pierrot design using printed circuit boards with metalized via-holes to implement the crankwires is disclosed in an article by I-Young Tarn and Shyh-Jong Chung, "A New Advance in Circular Polarization Selective Surface—A Three Layered CPSS Without Vertical Conductive Segments", IEEE Transactions on Antennas and Propagation, Vol. 55, No. 2, February 2007, pp. 460-467, which is incorporated herein by reference. It involves using the Printed Circuit Board (PCB) technology to implement the crankwires, with the metallized via-holes that realizes the longitudinal segments of the crankwires being replaced by conducting traces on intermediate layers between the top and bottom surfaces of the PCB. Due to the partial vertical alignment of one strip with the strip on the next layer, the EM energy flows vertically from one strip to the other by capacitive coupling. This permits to electrically connect the two transverse segments of the crankwire without using a continuous conductor between them. The insertion loss resulting from this arrangement may be, however, large (e.g. about 2.3 dB).

A drawback of CPSS of the Pierrot type composed of a periodic array of the crankwires of the same handedness is that its performance quickly degrades with oblique incidence.

U.S. Pat. No. 5,053,785 to Tilston et al., which is incorporated herein by reference, discloses a CPSS element 20 in the form of a dipole arrangement that is illustrated in FIG. 2, and which has a 2-fold rotational symmetry. The CPSS element 20 of Tilston includes two perpendicular half-wavelength dipoles 22 and 24 separated physically by a λ/4 spacing but connected electrically by a λ/2 transmission line 30. One advantage of the Tilston's design is that is has a 2-fold rotational symmetry, which symmetry has been shown in Jasmin E. Roy, "Reciprocal Circular Polarization Selective Surfaces", Ph.D. thesis, University of Manitoba, Winnipeg, Manitoba, December 1995 to provide a good performance under oblique incidence.

Notably, U.S. Pat. No. 5,053,785 is silent as to possible solutions to a problem of incorporating the half-wavelength transmission line in the quarter-wavelength spacing that corresponds to the thickness of the cell, and further is silent on possible performance of the suggested design. Furthermore, the half-wavelength dipoles need to be rotated 45 degrees to lie on the diagonals of the cells in order to fit within cells that are no larger than a half-wavelength in order to avoid the formation of grating lobes and the presence of higher-order modes of propagation.

FIG. 3 illustrates another CPSS that may be referred to as a CP-LP-CP cascade design, which is disclosed by U.S. Pat. No. 3,271,771 to P. W. Hannan et al. It includes a cascade of two circular polarizers of opposite handedness sandwiching a linear wire-grid polarizer. Its operation involves converting the input CP into a Linear Polarization (LP), filtering the LP with a wire-grid and reconverting the output LP into CP. The CPSS operation would be changed from reflecting one sense of CP to reflecting the other sense of CP by rotating the wire-grid by 90 degrees. One disadvantage of the cascade design is that its performance under oblique incidence is limited because the linear polarization filter works best only under normal incident EM illumination. Also, the realization of the CP-LP-CP cascade design is much thicker than those of Pierrot's or Tilston's designs, which is a disadvantage in terms of volume, weight and space.

An object of the present disclosure is to provide an improved CPSS which addresses at least some of the disadvantages of the prior art, and which provides improved performance in at least some applications.

SUMMARY OF THE DISCLOSURE

Accordingly, the present disclosure relates to an improved CPSS comprising a plurality of double crankwire elements (DCE) having a 2-fold rotational symmetry, wherein the DCEs are disposed so that there exists electro-magnetic (EM) coupling between transverse segments of crankwires of adjacent DCEs.

One aspect of the present disclosure provides a CPSS comprising a plurality of double crankwire elements (DCEs) disposed so as to form a two-dimensional (2D) array, each double crankwire element (DCE) comprising two crankwires of the same handedness, each crankwire comprising a longitudinal segment electrically connecting two transverse segments, each of the segments being electrically conductive, the two crankwires in each DCE disposed to impart a two-fold rotational symmetry to the DCE with respect to a longitudinal symmetry axis that is generally perpendicular to the CPSS at the location of the DCE, the transverse segments of the plurality of the DCEs defining two opposing faces of the CPSS. The transverse segments of the crankwires in each of the plurality of DCEs are disposed to facilitate an electromagnetic (EM) coupling between nearest transverse segments of crankwires of adjacent DCEs, so as to define pairs of EM coupled transverse segments wherein at least a portion of one transverse segment is spaced from at least a portion of another transverse segment with a gap of width of at most G therebetween, and wherein said gap extends along the transverse segments over a coupling length P that is at least half of the width G of the gap. The longitudinal segments of the two crankwires in each DCE are generally parallel to each other and may be adjacently spaced so as to form a longitudinal transmission line. Alternatively, the plurality of DCEs may comprise pairs of crankwires wherein longitudinal segments are generally parallel to each other and adjacently spaced so as to form longitudinal transmission lines.

In accordance with one aspect, a CPSS may comprise a two-dimensional (2D) array of 2-fold rotationally symmetrical DCEs that are laid out according to either a square or a triangular lattice, making use of EM coupling between adjacent DCEs.

A CPSS may include a dielectric substrate supporting the transverse segments of the crankwires. The longitudinal segments of the DCEs may be integrated into the dielectric substrate. The dielectric substrate may be shaped or corrugated so that the two longitudinal segments of the DCEs form a half-wavelength transmission line within the quarter-wavelength thickness of the CPSS.

One aspect of the disclosure provides a CPSS in the form of a two-dimensional (2D) array of three-dimensional (3D) cells, with each cell comprising two separate crankwires of the same handedness that are positioned about a longitudinal axis connecting the centers of two opposing faces of the cell, so that a double crankwire element (DCE) that is formed by the two separate crankwires has a 2-fold rotational symmetry about the longitudinal axis, each crankwire having a transverse segment in one of two faces of the CPSS, and a longitudinal segment that is parallel to the longitudinal axis, wherein the 2D array forms a quarter-wavelength thick electromagnetic surface for an incident EM wave of a pre-determined operating frequency.

One aspect of the present disclosure relates to a CPSS that comprises a plurality of cells, each cell comprising two crankwires of the same handedness, each crankwire comprising a longitudinal segment electrically connecting two transverse segments, each of the segments being electrically conductive. Each of the crankwires of each cell are positioned in the cell so that the longitudinal segment of a first crankwire in a first cell is positioned adjacent to, and transversely aligned with, the longitudinal segment of a second crankwire for coupling thereto so as to form a transmission line that is longitudinally oriented. One transverse segment of the first crankwire is disposed for EM coupling with a nearest transverse segment of a crankwire in a third cell adjacent the first cell. The other transverse segment of the first crankwire is disposed for EM coupling with a nearest transverse segment of a crankwire in a fourth cell adjacent the first cell.

Another feature of the present disclosure provides a CPSS that includes a substrate made of a dielectric material for supporting the crankwires, wherein the transverse segments of each crankwire are formed of conducting strips disposed on opposite faces of the substrate, and wherein the longitudinal segments are embedded in the dielectric material of the substrate, and wherein the substrate is shaped, such as corrugated, so that for a given frequency of a normally-incident electromagnetic wave, an electrical thickness of the substrate is substantially 90 degrees, an electrical length of the longitudinal transmission lines is substantially 180 degrees, and an electrical length of the transverse segments is substantially 90 degrees.

Another feature of the present disclosure provides a CPSS comprising one or more dielectric layers for wave-impedance matching so as to reduce the magnitude of the cross-polarized CP reflection coefficients.

Another feature of the present disclosure provides a CPSS comprising diodes connected at mid-length across each longitudinal transmission line formed by a pair of adjacent crankwires, the transmission lines being half-wavelength long, for electronically disabling the CPSS operation of the pair of crankwires when the diodes are forward-biased, thereby enabling the geometry of an active zone where the CPSS operation is preserved, to be electronically programmable.

Another feature of the present disclosure provides a CPSS comprising a plurality of three-dimensional N-stage multi-segment crankwires (MSC) disposed to form a two-dimensional array, wherein each MSC is formed by a crankwire-type arrangement of N+1 transverse segments and N longitudinal segments, where N≥1, in the shape of a square helix with N stages, each longitudinal segment being substantially a quarter-wavelength long. One aspect provides a CPSS wherein the MSC comprises a first and a last segment disposed in a transverse relation to the N longitudinal segments and having each a free end, and wherein the plurality of the first and last segments of the MSCs define two opposing faces of the CPSS. Another aspect provides a CPSS wherein the MSCs are grouped in MSC pairs, each MSC pair comprising two MSCs disposed to provide a 2-fold rotational symmetry to the MSC pair about a longitudinal axis of the pair.

BRIEF DESCRIPTION OF THE DRAWINGS

Embodiments disclosed herein will be described in greater detail with reference to the accompanying drawings, which may be not to scale and in which like elements are indicated with like reference numerals, and wherein.

DETAILED DESCRIPTION

Figure 1:
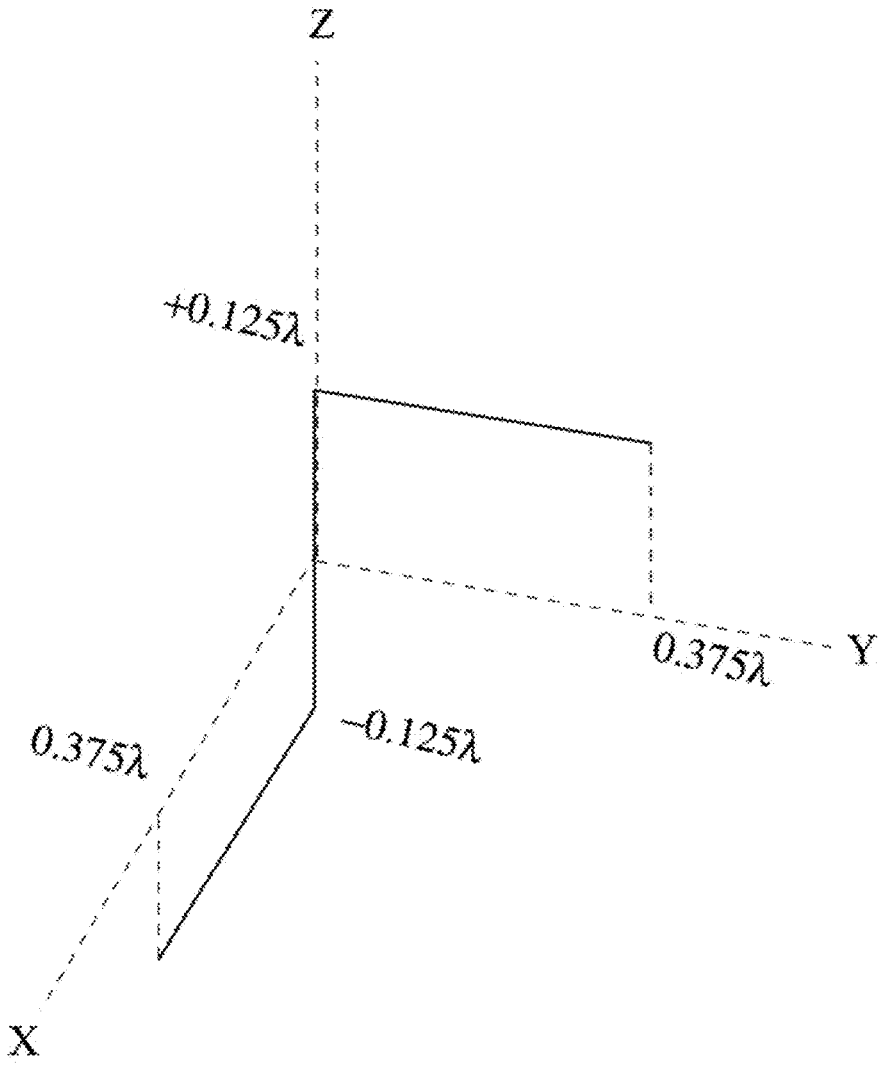
FIG. 1 (PRIOR ART)
FIG. 1 is a schematic diagram illustrating a prior art CPSS element in the form of a single crankwire.

In the following description, for purposes of explanation and not limitation, specific details are set forth, such as particular components, techniques, etc. in order to provide a thorough understanding of the present invention. However, it will be apparent to one skilled in the art that the present disclosure may be practiced in other embodiments that depart from these specific details. In other instances, detailed descriptions of well-known methods, devices, and circuits are omitted so as not to obscure the description of the present invention.

The following definitions may be applicable to embodiments of the present disclosure: the term crankwire refers to a conductor having three mutually perpendicular conductive segments that may have circular or non-circular cross-sections and may include a portion of a transmission line (TL); the term 'connected' means physically and/or electrically connected, while the term 'coupled' or 'couples' refers to the presence of electromagnetic (EM) coupling between two or more physically and electrically separate elements, unless specified otherwise; the term 'overlap' refers to a common length of two generally parallel segments, which extend beside each other over a portion of their length with a gap therebetween, and does not mean a physical connection; the term 'endwise EM coupling' refers to EM coupling of the free end portion of a transverse segment; endwise EM coupling can be either side-to-side or end-to-end EM coupling between two adjacent generally parallel transverse segments (TSs); side-to-side EM coupling can also refer to EM coupling between any portion of two adjacent generally parallel TSs; the term 'capacitive EM coupling refers to an EM coupling between two spaced apart conductors facing each other along a part of a length of one of their edges with a gap therebetween, wherein the EM coupling becomes stronger with either increasing the overlap or decreasing the gap between the two conductors. LHCP refers to the left-hand sense of circular polarization, wherein the electric field vector of the wave rotates counter-clockwise about the propagation vector when looking in the direction of propagation; RHCP refers to the right-hand sense of circular polarization, wherein the electric field vector of the wave rotates clockwise about the propagation vector when looking in the direction of propagation; LHCPSS refers to a CPSS for reflecting the left-hand sense of circular polarization; RHCPSS refers to a CPSS for reflecting the right-hand sense of circular polarization.

The incident EM radiation which is to be selectively reflected and transmitted by the CPSS is also referred to herein as 'wave', and its frequency f is referred to as the frequency of operation or the operating frequency. The term 'wavelength', also denoted as $\lambda$, refers to the wavelength corresponding to the operating frequency f.

Example embodiments of a CPSS may be described herein with reference to a Cartesian system of coordinate (X,Y,Z), wherein the Z axis is directed parallel to a middle segment or segments of the crankwires, while the X and Y axes are directed parallel to the two end segments. A direction parallel to the Z axis is a normal incidence direction of the wave, with the CPSS lying in a plane parallel to the XY plane. A direction parallel to the Z axis is also referred to as the longitudinal direction, whereas the directions parallel to the X or Y axes are referred to as the transverse or lateral directions. Accordingly, a crankwire segment that is parallel to the longitudinal direction and that connects to two transverse segments, one at each end, is also referred to as longitudinal segment (LS), while two crankwire segments that connect perpendicularly to a LS are also referred to as transverse segments (TS). Two or more LSs are said to be aligned or 'transversely aligned' when their respective ends, and the TSs extending therefrom, are transversely aligned, i.e. lie in a same (X,Y) plane.

Note that as used herein, the terms "first", "second" and so forth are not intended to imply sequential ordering, but rather are intended to distinguish one element from another unless explicitly stated.

The term 'lattice' refers to a periodic arrangement of points or nodes in space; herein, a lattice may refer more specifically to a two-dimensional periodic arrangement of points over a surface that may be generally planar; a lattice is invariant to lateral translations along characteristic axes of the lattice by the distance between two nearest nodes along a characteristic axis; the terms 'rectangular lattice' and 'Cartesian lattice' are used interchangeably to refer to a lattice wherein the nodes are positioned at the four vertices of contiguous and identical rectangles; a 'square lattice' is a rectangular lattice wherein the sides of the rectangles are of equal length; the term 'triangular lattice' refers to a lattice wherein the nodes are positioned at the three vertices of contiguous and identical triangles; the term 'equilateral triangular lattice' refers to a triangular lattice wherein all three sides of the triangles are of equal length; the term 'isosceles triangular lattice' refers to a triangular lattice wherein only two sides of the triangles are of equal length; triangular lattices can be obtained by interlacing two identical Cartesian lattices with the horizontal and the vertical offsets therebetween equal to half the horizontal and the vertical periods of the Cartesian lattices, respectively.

The term 'array' maybe used herein to refer to a periodic arrangement of identical elements, one element being positioned at each node of a lattice, all elements being oriented the same way; the lattice for a square array is a square lattice; the lattice for a triangular array is a triangular lattice; the lattice for an equilateral triangular array is an equilateral triangular lattice; the lattice for an isosceles triangular array is an isosceles triangular lattice; the term 'CPSS array' refers to an array wherein the elements are CPSS elements; all physical arrays are necessarily of finite dimensions; the term 'quasi-periodic array' refers to an array that is not perfectly periodic because the arrangement of the CPSS elements is not identical at every node with respect to position, dimensions or orientation of the CPSS elements; the term 'defective array' refers to an array with some elements missing in order to confer EM wave-guiding properties to the array; the term 'partial array' refers to an array that is truncated in a particular shape, e.g. an annular circle.

The term 'cell' may be used herein to refer to the smallest parallelogram having four nodes of a lattice at its vertices, which can be periodically translated to contiguously cover all nodes of the lattice without overlap; the cell for a square array is the square of the corresponding square lattice; the cell for a triangular array is a parallelogram formed by two triangles of the corresponding triangular lattice that are joined at one side; the cell for an equilateral triangular array is a rhombus formed by two equilateral triangles of the corresponding equilateral triangular lattice, that are joined at one side; the cell for an isosceles triangular array is a rhombus formed by two isosceles triangles of the corresponding isosceles triangular lattice, that are joined at their base; the term 'Yee cell' refers to the 3D cell of the Yee lattice that is used in EM simulations with the Finite Difference Time Domain (FDTD) method.

The terms 'bulk permittivity' and 'intrinsic permittivity' of a dielectric material are used interchangeably. The bulk permittivity determine the propagation velocity for an EM wave propagating within a uniform homogeneous and boundless sample of the dielectric material; the effective permittivity of a composite material or structure is understood to be the intrinsic permittivity of an equivalent bulk material in which the EM wave would propagate with the same propagation velocity as in the composite material or structure; the effective wavelength is the wavelength of the wave propagating in the equivalent bulk material; the term 'electrical length' refers to a representation of a length in terms of a propagation phase shift of an electrical signal of the operating frequency, expressed in angular units or in terms of a fraction of an effective wavelength, wherein one full wavelength corresponds to 360 degree phase shift. The term 'electrical thickness of a CPSS' refers to the electrical length in the direction perpendicular to the faces of the CPSS; the electrical thickness of a CPSS depends on a large-scale effective permittivity of its substrate, i.e. the effective permittivity of the substrate averaged over an area with dimensions of many wavelengths. The electrical length of a longitudinal TL depends on a local or small-scale effective permittivity, i.e. the effective permittivity averaged over the small region where is mostly confined the transverse electromagnetic (TEM) field that is bound to the TL; the electrical length of a TS depends on the local effective permittivity in the vicinity of the TS, i.e. the effective permittivity averaged over the small region where is mostly confined the EM near-field that is bound to the TS.

The operation of Pierrot's crankwire under normal incidence is as follows. Because the two transverse segments are orthogonal to one another, the EM coupling between them is negligible. Hence, one transverse segment does not create EM blockage for the other transverse segment as the incident wave propagates at normal incidence through the cell. Due to the $\lambda/4$ separation between the two perpendicular transverse segments, a normally incident plane wave of one sense of CP would induce two in-phase currents on the two transverse end-segments whereas a normally incident plane wave of the other sense of CP would induce two out-of-phase currents.

The operation of Tilston's element under normal incidence is as follows. Due to the $\lambda/4$ separation between the two orthogonal transverse dipoles 22, 24, a normally incident plane wave would induce currents on the two orthogonal dipoles 22, 24 such that the two voltage travelling waves present at the two opposite ends of the TL would be equal in magnitude but in-phase for one sense of CP, and out-of-phase for the other sense of CP of the incident wave. The induced currents are equal in magnitude because the EM coupling between the two orthogonal dipoles is very weak, owing to the dipoles being mutually perpendicular. Hence, one dipole does not create EM blockage for the other dipole as the incident wave propagates through the Tilston cell. From the longitudinal symmetry of the TL 30, the two equal-magnitude in-phase voltage travelling waves at the two opposite ends of the TL produce a virtual open-circuit at mid-length of the TL whereas the two equal-magnitude out-of-phase voltage travelling waves produce a virtual short-circuit at mid-length. Since the TL is electrically a half-wavelength long, a virtual short-circuit at mid-length of the TL is transformed through a λ/4 TL into an open-circuit at the port of each perpendicular dipole connected at each end of the TL, and conversely, a virtual open-circuit at mid-length is transformed into a short-circuit. The two orthogonal half-wavelength dipoles produce a strong scattering response when their terminals are short-circuited because each dipole acquires a resonance length of a half-wavelength. In contrast, the two orthogonal half-wavelength dipoles produce a weak scattering response when their terminals are open-circuited because each dipole is segmented into two non-resonant λ/4 wires. The sense of the CP that is reflected for Tilston's design depends on the connection of the longitudinal TL to the two dipoles at its two ends. In fact, neglecting momentarily the difference in the electrical length of the TSs and the difference in the electrical length of the LSs, this connection is the same as if Tilston's design were two "back-to-back" crankwires. Hence, the explanation for the sense of the CP being scattered for Tilston's design is the same as that which was given for Pierrot's crankwire since the fact that the lengths of the TSs are different between Pierrot's crankwire and Tilston's dipoles does not affect the sense of CP being scattered.

Figure 4:
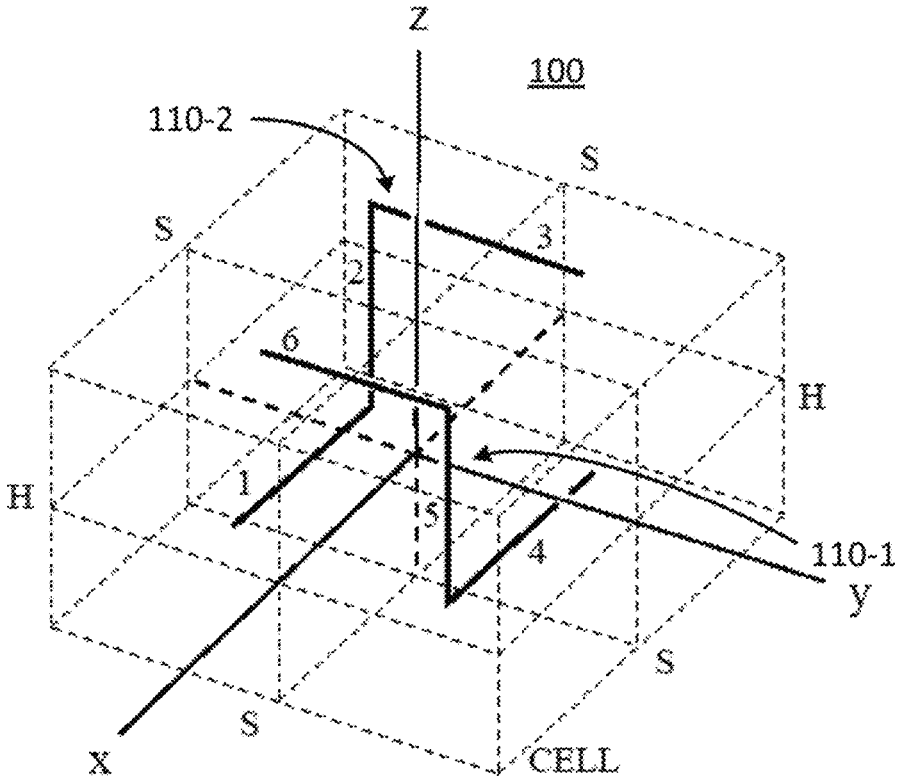
FIG. 4 is an isometric view of an example CPSS cell including two opposing crankwires forming a double crankwire element (DCE) with 2-fold rotational symmetry.

Embodiments of the present disclosure will now be described first with reference to FIG. 4, which shows an exemplary LHCPSS cell 100. As described hereinbelow in further details, a CPSS of the present disclosure may include a plurality of such cells disposed side-by-side to form a 2D Cartesian array. The cell 100, which is shown by way of example as a square cell of a square array with transverse dimensions S and longitudinal dimension H, contains a double crankwire arrangement, which may also be termed herein as double crankwire or double crankwire element (DCE), and which is composed of crankwires 110-1 and 110-2 of the same handedness, and may be generally centered within the cell 100. The single crankwires 110-1 and 110-2, which are generally referred to as crankwires 110 and are shown with reference to the Cartesian coordinate system (X,Y,Z), are substantially identical in shape and size and disposed so as to confer a 2-fold rotational symmetry about the Z axis to the double crankwire element (DCE). In FIG. 4, the middle or longitudinal segments (LS) of the crankwires are labeled '2' and '5', while their end segments are labeled '1' and '3', and '4' and '6', respectively.

In one embodiment, the individual crankwires 110-1 and 110-2 may be disposed diagonally at opposing corners of the cell 100 near the cell periphery. Preferably they may have an opposite orientation of their respective TSs so as to confer a 2-fold rotational symmetry to the double crankwire element, wherein each of the crankwires is substantially a copy of the other crankwire rotated 180 degrees about the Z axis passing through the center of the cell. Top TSs 3, 6 are co-planar defining a first face of cell 100, while bottom TSs 1 and 4 are also co-planar and define a second face of cell 100. We will also be referring to the first and second faces as the top (upper) and bottom (lower) faces, although it will be appreciated that all these designations are for convenience of the description only.

Figure 5:
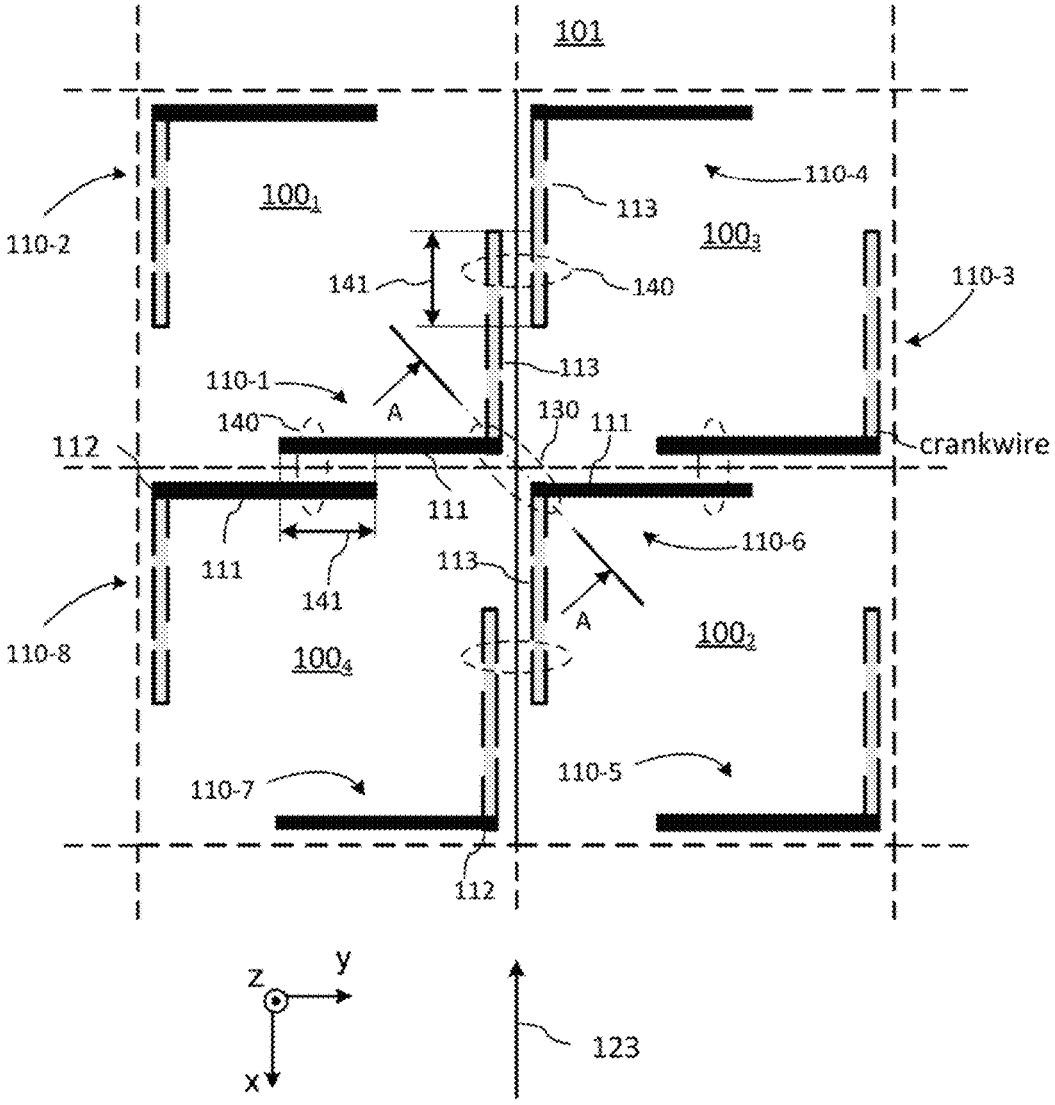
FIG. 5 is a schematic top view of an example 2×2 CPSS array composed of the CPSS cells of the type shown in FIG. 4 with EM coupling between crankwires of adjacent cells.
Figure 6:
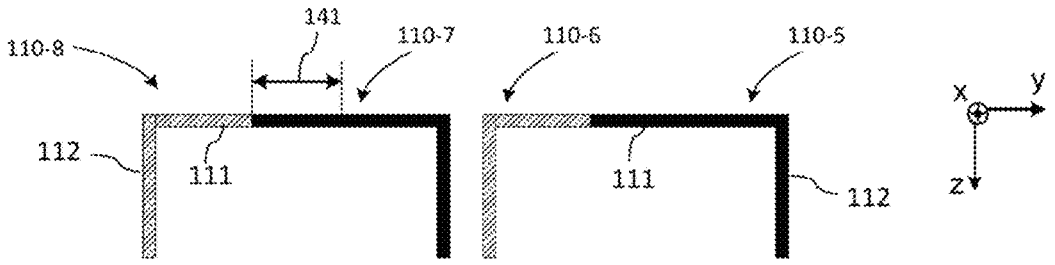
FIG. 6 is a side view of the 2×2 CPSS array of FIG. 5.

Turning now to FIGS. 5 and 6, there is illustrated, in a top view and a side view indicated by arrow 123 respectively, a four-cell LHCPSS arrangement 101 for selectively reflecting LHCP waves of a pre-determined operating frequency f according to an embodiment of the present disclosure. Here four instances of cell 100, labeled '$\mathbf{100}_i$' with cell indices i spanning from 1 to 4, are arranged side-by-side in a 2×2 Cartesian array, with their first and second faces aligned to form a first and second face of the CPSS array 101.

FIG. 5 shows the top view of the array 101, which corresponds to looking at the array 100 of FIG. 4 from the top down in the −Z direction. Each of the cells $\mathbf{100}_i$ includes two crankwires 110 that are positioned adjacent the periphery of the cell, so that a first cell $\mathbf{100}_1$ includes two crankwires 110-1 and 110-2, a second cell $\mathbf{100}_2$ includes two crankwires 110-5 and 110-6, a third cell $\mathbf{100}_3$ includes two crankwires 110-3 and 110-4, and a fourth cell $\mathbf{100}_4$ includes two crankwires 110-7 and 110-8. Upper TSs 111 that lie at the top, or first, face of the CPSS 101 are shown with solid black stripes. Lower TSs 113 that lie at the bottom, or second, face of the CPSS 101 are shown with dashed stripes.

Figure 7:
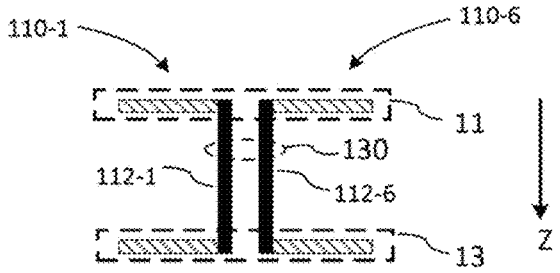
FIG. 7 is a partial cross-sectional view of the 2×2 CPSS array of FIG. 5 along the AA line showing a longitudinal transmission line formed by two longitudinal segments.

The LSs 112 extend in the direction normal to the plane of the FIG. 5 at the virtual intersections of the TSs of each crankwire. Referring also to FIG. 7, which illustrates a partial side view of the CPSS 101 in an "A-A" cross-section indicated in FIG. 5, the LS 112-1 of the first crankwire 110-1 of the first cell $\mathbf{100}_1$ is transversely aligned with the LS 112-6 of the second crankwire 110-6 of the second cell $\mathbf{100}_2$ and is positioned in close proximity (generally less than a tenth of a wavelength, and preferably just a few hundredths of a wavelength) thereto so as to ensure that these two adjacent LSs 112-1 and 112-6 are electromagnetically (EM) coupled to each other so as to form together a longitudinally-oriented (TL) 130, which is also referred to herein as the longitudinal TL.

In accordance with an aspect of the present disclosure, one TS 113 of the first crankwire 110-1 in the first cell $\mathbf{100}_1$ is disposed so as to provide a capacitive EM coupling with a nearest TS 113 of the crankwire 110-4 in the third cell $\mathbf{100}_3$ adjacent the first cell $\mathbf{100}_1$, in a configuration that may also be referred to as a side-to-side EM coupling between the two nearest crankwires. Similarly, the other TS 111 of the first crankwire 110-1 in the first cell $\mathbf{100}_1$ is disposed so as to provide an EM coupling with a nearest TS 111 of the crankwire 110-8 in the fourth cell $\mathbf{100}_4$ adjacent the first cell $\mathbf{100}_1$. Similarly, each of the TSs 111 and 113 of the second crankwire 110-6 of the second cell $\mathbf{100}_2$ is EM coupled with a nearest co-planar TS 111 and 113, respectively, of one of the crankwires 110-3 and 110-7 in the adjacent third cell $\mathbf{100}_3$ and adjacent fourth cell $\mathbf{100}_4$, respectively. The EM coupling between the nearest TSs of two electrically isolated crankwires may also be referred to as the capacitive EM coupling.

Accordingly, the CPSS 101 of the present disclosure provides EM coupling not only between LSs of adjacent crankwires to provide longitudinal TLs, but additionally provides capacitive EM coupling between TSs of adjacent cells, which may also be referred to herein as the endwise coupling, TS coupling, side-to-side coupling, or in-plane coupling. We found that EM coupling between CPSS cells may substantially improve the CPSS performance, as described hereinbelow.

Figure 8:
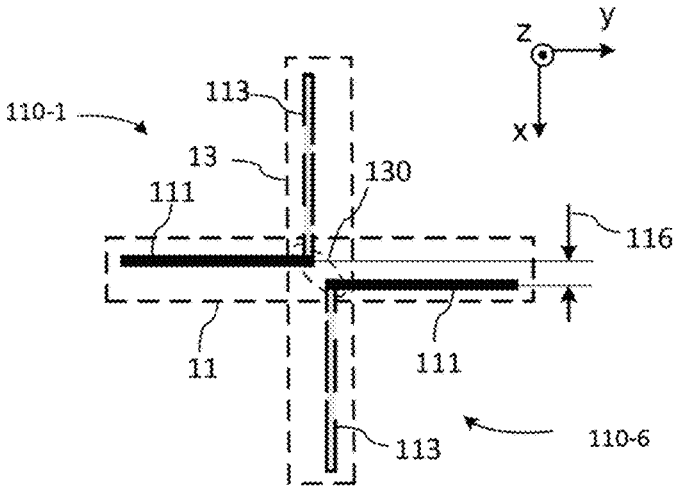
FIG. 8 is a schematic top view of a portion of a CPSS array showing two opposing offset dipoles which are connected by a longitudinal transmission line, each dipole being formed of two transverse segments of same two adjacent crankwires.

Turning now to FIG. 8 showing the two adjacent crankwires 110-1, 110-6 that are coupled at their LSs, the TL 130 can be viewed as connecting a dipole 11 formed of a pair of co-planar TSs 111 of the respective crankwires 110-1 and 110-6 to an orthogonally oriented dipole 13 formed of the other two co-planar TSs 113 of the same two crankwires that lie at an opposite face of the CPSS array 101. The TSs forming a dipole will also be referred to herein as dipole arms. Taken individually and neglecting momentarily the lateral offset of the dipoles, the orthogonal-dipole arrangement of FIG. 8 is similar in some respect to that disclosed by Tilston, and operates generally as described in U.S. Pat.

No. 5,053,785, which is incorporated herein by reference. In particular, dimensions of the crankwire segments and parameters of the TL 130 are preferably selected so that the dipoles 11 and 13 are resonant at the operating frequency, i.e. have an electrical length of substantially 180° degrees or one half-wavelength, the electrical length of the TL 130 is also substantially 180 degrees or one half-wavelength, and the electrical distance between the dipoles 11 and 13 in the longitudinal direction is substantially 90 degrees or one quarter-wavelength. Here substantially means allowing for manufacturing tolerances and measurement accuracy. The condition for the dipoles 11, 13 to have the electrical length of 180 degrees or one half-wavelength requires that each of the TSs have an electrical length of substantially 90 degrees, or one quarter-wavelength.

However, the dipoles 11, 13 that are shown in FIGS. 5, 7, 8 and 9 differ from the dipoles disclosed by Tilston in that the individual TSs forming the dipoles 11 and 13, i.e. the dipole arms, although preferably substantially parallel to each other, are not collinear, but disposed with a lateral offset 116 with respect to each other. Accordingly, the dipoles 11 and 13 will also be referred to as 'offset dipoles'. In the embodiment of FIGS. 4-8 this lateral offset, which results from the positioning of the crankwires in close proximity but slightly away from the edges of the CPSS cell, together with the suitable choice of the cell size S and the TS length L, enables an endwise 'overlap' between end portions of the TSs near the boundary between adjacent cells, and enables the close proximity of the TSs of the adjacent cells, resulting in the EM coupling therebetween. The lateral offset of the TSs also facilitates the connection of the TS to the LS by permitting a straight electrical connection without twisting the TL.

Figure 9:
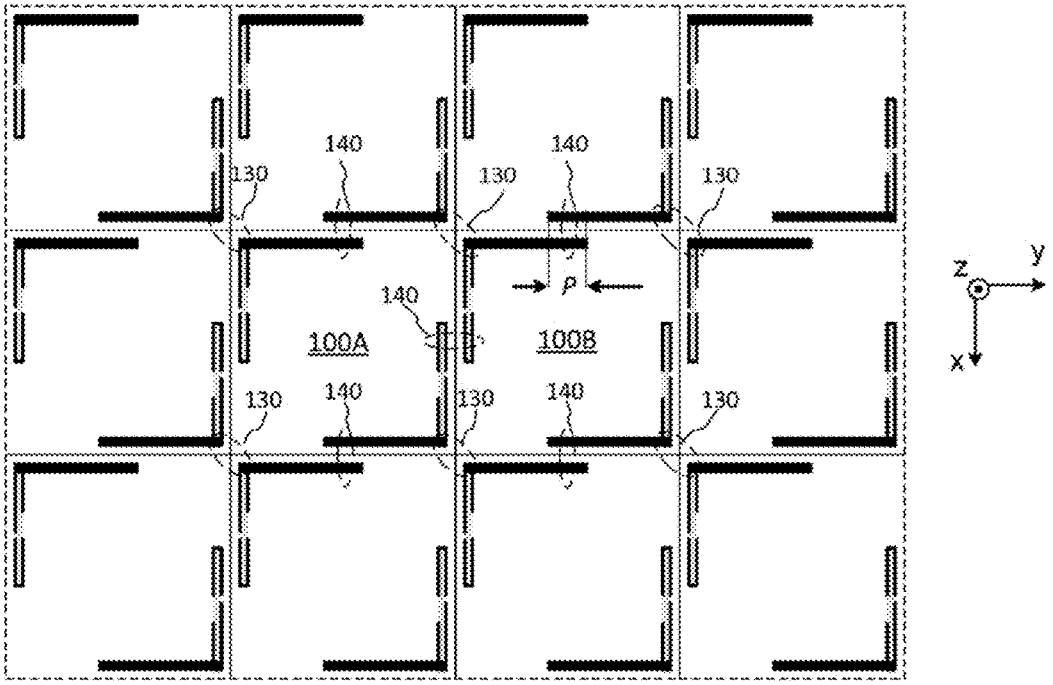
FIG. 9 is a schematic top view of a 3×4 CPSS array with EM coupling and two inner cells.

Although FIG. 5 shows only four CPSS cells 100 wherein only two of the eight crankwires are coupled at their respective LS to form the TL 130, preferred embodiments of the disclosure may include other cells extending the array 101 of FIG. 5 in all or some of the four directions along the X and Y axis, so that one or more of the cells are inner cells that are surrounded on all four sides by other cells 100. By way of example, FIG. 9 illustrates a 3×4 CPSS array having two inner cells 100A and 100B that are surrounded by ten outer CPSS cells, with all cells being of the same type as cell 100. For the inner cells, each LS of each crankwire forms a longitudinal TL 130 with a LS of a closest crankwire in an adjacent cell, so as to form a plurality of longitudinal TLs 130 having an electrical length of a half-wavelength each, with each of the TLs 130 connecting two orthogonal offset dipoles 11 and 13.

Furthermore, each of the TSs 111, 113 of the inner cells is EM coupled to a nearest TS of a crankwire in an adjacent cell, forming a plurality of EM coupled pairs 140 of TSs, and hence a plurality of EM coupled dipoles 11 at one face of the array, and a plurality of EM coupled dipoles 13 at the other face of the array. Effectively, this capacitive EM coupling between the TSs provides a capacitive loading of the dipoles 11 and 13, which positively contributes into the electrical length thereof. Advantageously, this makes the TSs of the optimal electrical length of 90 degrees, or one quarter-wavelength, physically smaller, thereby making the period of the array physically smaller and thereby making the CPSS array physically denser and smaller.

It will be appreciated that the square-array CPSS of FIGS. 5 and 9 may be viewed as an array of DCEs shown in FIG. 8, in which the DCEs are disposed at the nodes of a square lattice.

Figure 10:
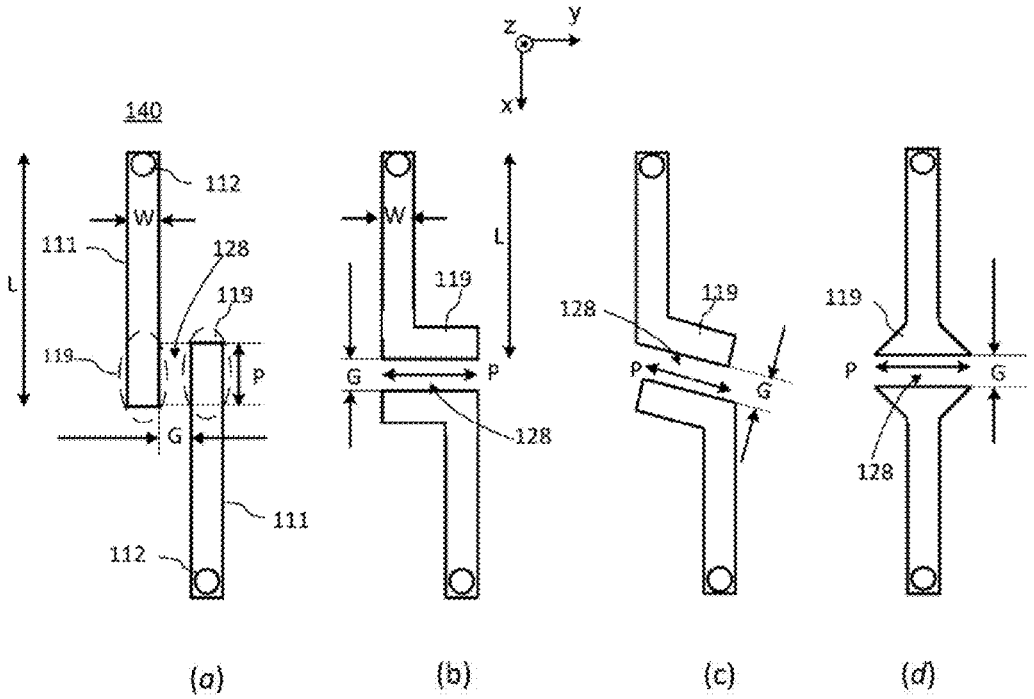
FIG. 10 is a schematic diagram illustrating exemplary variants of EM coupling between transverse segments of adjacent crankwires.

Referring now to FIGS. 10(*a*) to 10(*d*), the embodiments described hereinabove include TSs that are substantially straight, with the end portions 119 of the TSs of a same EM coupled pair 140 extending alongside each other over a coupling length P with a gap G therebetween, as illustrated in FIG. 10(*a*).

The present disclosure is not however limited to straight TSs that at least partially overlap lengthwise at the ends, but encompasses TSs having end portions of any suitable shape, relative position and/or orientation therebetween that provide the desired EM coupling between the TSs of adjacent crankwires, and hence between the crankwires themselves.

FIGS. 10(*b*)-(*d*) illustrate other examples of such end-coupling configurations wherein end portions 119 of the respective TSs, which are referred to herein also as the end-coupling portions 119, are shaped and/or positioned so as to be directly facing each other along a coupling length P with a suitably small gap G therebetween. In particular, FIGS. 10(*b*) and (*c*) illustrate an embodiment wherein the end-coupling portions 119 of the TSs are bent relative to the rest of their respective TSs, with FIG. 10(*b*) illustrating a 90 degrees bend, while FIG. 10 (*c*) illustrates an oblique angle bend of the TSs. This arrangement may be viewed as providing side-to-side coupling between the TSs along the bent ends thereof, and may also be viewed as providing effectively a version of end-to-end coupling between the TSs, wherein end-faces of the TSs are asymmetrically widen and positioned in a close proximity facing each other to provide the desired EM coupling. FIG. 10 (*d*) illustrates an embodiment wherein the end-to-end coupling is provided by flared ends of the TSs. It will be appreciated that other designs of the end-coupling portions are also possible, such as for example, but not exclusively, end-to-end coupling designs which combine features of FIGS. 10(*b*) and 10(*d*) or 10(*c*) and 10(*d*), wherein the TS ends are asymmetrically flared. Note that in the context of the present specification the term 'EM coupling' and its derivatives, when applied to TSs, encompass both the side-to-side coupling and end-to-end coupling of the TSs and their variants and combinations, including but not limited to the embodiments illustrated in FIGS. 10(*a*)-(*d*). It will also be appreciated that the end faces of the TSs in the embodiments of FIGS. 10(*a*)-(*d*) do not have to be square but can be tapered, e.g. rounded, or generally of any suitable shape. It will be also appreciated that the EM coupling between adjacent TSs can be varied while maintaining the overlap P and the separation gap G by making the edges of the TSs serrated or meandered as described below.

It will be also appreciated that, although FIGS. 4-9 illustrate arrangements wherein the CPSS is formed by side-by-side tiling in two dimensions of a CPSS cell that is substantially square and fully encompasses the two crankwires so as to provide a periodic 2D array, in other embodiments the cells may be non-square, and/or may not fully encompass the two crankwires in their entirety, and/or the array may be only quasi-periodic instead of periodic, for example, for the purpose of beam shaping (e.g. reflect-array or transmit-array). Furthermore, the CPSS cells may be arranged not to be flat but to follow a smoothly curved surface, for example, a concave or convex face of an antenna or another device or component.

Figure 11:
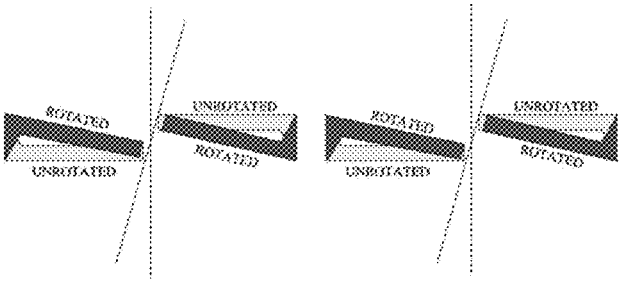
FIG. 11 is a schematic top view of a portion of a CPSS with rotated crankwires and end-to-end EM coupling.

One possible advantage of using a type of end-to-end EM coupling over using side-to-side EM coupling of TSs is that the end-to-end coupled TSs of FIGS. 10(*b*)-(*c*) can be slightly rotated about the z axis while still maintaining the end-to-end coupling by changing the shape or bending angle of the enlarged ends of the two coupled elements, as illustrated in FIG. 11 by way of example. This would be useful for designing a CPSS reflect-array or transmit-array whereby the elements of the reflect-array or transmit-array must scatter the incident wave with a slightly different phase shift from one element to the next. This phase shift can be obtained by a mechanical rotation of the crankwires about the center of their cell. Since the phase shift induced by the mechanical rotation is twice the angular value of the mechanical rotation, slight phase shifts can be accommodated with small mechanical rotations without losing the end-to-end EM coupling by changing the shape of the enlarged ends 119 as depicted in FIG. 11.

In one aspect, embodiments described hereinabove may be generally described as based on, or including, a plurality of EM coupled double crankwire elements. They can also be described as including parallel chains of EM coupled dipoles 11 and 13 disposed at two parallel faces of the CPSS in row-wise and column-wise orientations, respectively, wherein each of the diploes at one face is connected at mid-length with an orthogonally oriented dipole at the other face by a TL 130 that is generally orthogonal to the dipoles it connects. For optimum operation as CPSS elements, the electrical length of the TL should be equal or at least suitably close to λ\2, and the electrical length of the dipoles should be equal or at least suitably close to λ\2, which is achieved when the electrical length of the TSs is equal or at least suitably close to λ\4. When adopting this view, the embodiments of FIGS. 5-10(*a*) with the side-to-side TS coupling can be obtained by sliding the dipoles towards each other until a desired overlap of the dipole arms is achieved.

Figure 18:
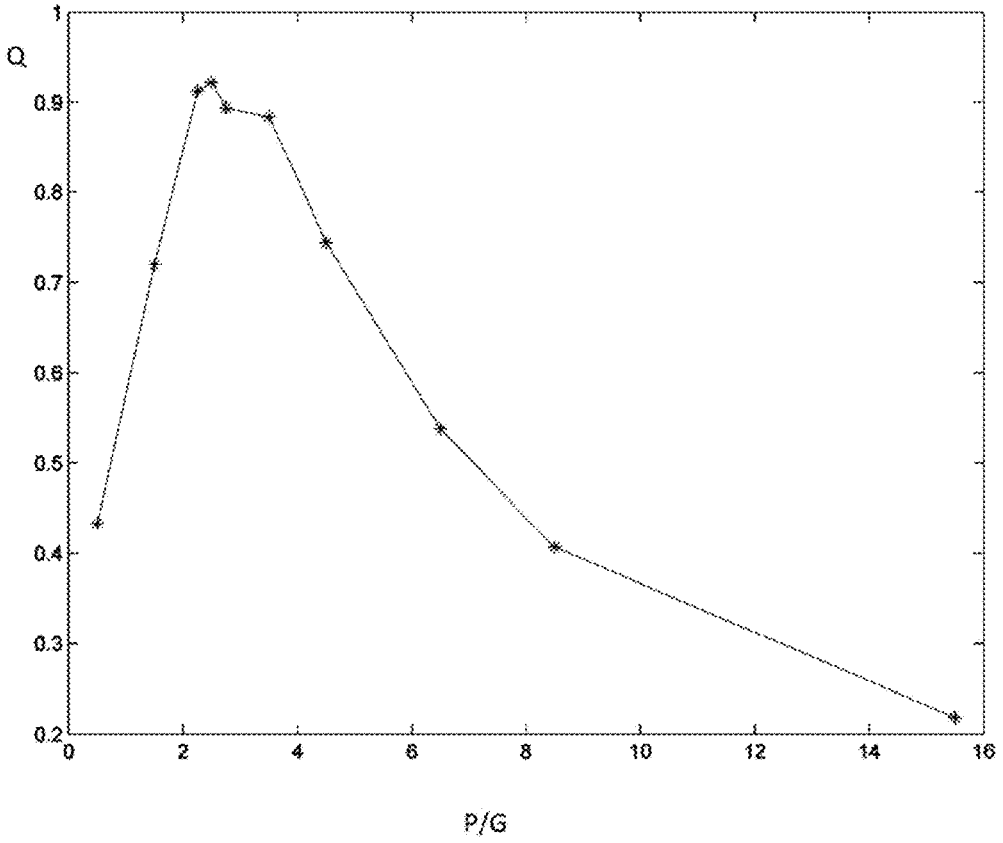
FIG. 18 is graph showing a dependence of the figure of merit Q, representing the CP selectivity of the CPSS, upon the ratio of the coupling length P to the coupling gap G for an exemplary 30×30 CPSS array without dielectric substrate.

One advantage of this 'offset/overlap sliding' is the increased density of the array, which now includes a greater number of CPSS elements than the prior art arrays without the EM coupling of crankwires or dipoles, which may increase its efficiency in selective CP scattering. Furthermore, the resulting capacitive EM coupling between the dipoles has the effect of adding a capacitive loading of their arms, which adds to its electrical length, thereby reducing the physical length of the dipole arms that is required for optimum operation of the CPSS. Thus, the added capacitive loading due to the EM coupling between adjacent dipoles further decreases the size of the CPSS cell, thereby further increasing the CPSS density and efficiency. The enhanced CPSS efficiency due to the CPSS cell reduction resulting from the capacitive loading is also present in the embodiment of FIG. 10(*d*), wherein the dipoles may be straight rather than offset, but wherein the capacitive loading due to the end-to-end EM coupling at the flared dipole ends results in the smaller dipoles and their greater density in the CPSS. Furthermore, the EM coupling effectively leads to a formation of an EM aperture between the opposing faces or sides of the TSs in the end-coupling portions thereof, as indicated at 128 in FIGS. 10(*a*)-(*d*). The EM radiation from the CPSS with EM coupling between the crankwires is thus a combination of EM radiation from the currents on the TSs and EM radiation from the apertures, each contribution being linearly polarized according to the orientation of its respective originator. With side-to-side coupling as illustrated in FIG. 10(*a*), the two orientations are orthogonal whereas with end-to-end coupling as illustrated in FIG. 10(*b*) or 10(*d*), the two orientations are parallel. The performance of the CPSS may thus be different, depending on the type of endwise EM coupling between the TSs. With proper phasing of the two contributions, the presence of the apertures enhances the performance of the CPSS over what it would be without the presence of the apertures. The strength of the EM coupling between the crankwires, or equivalently between the respective dipoles, depends on the ratio C of the coupling length P to the gap G between the coupling faces of the respective TSs, C=P/G, which defines the aspect ratio of the aperture 128, and is also a geometrical factor conventionally known to define the capacitance in a parallel-plate approximation. We found that this ratio should be at least 0.5, and preferably at least 1. An optimal value for this ratio for a particular exemplary embodiment that used free space in place of the dielectric substrate was found to be ranging from about 2 to about 4, as illustrated in FIG. 18 obtained with the results presented in Tables 1 and 2 below, with the CP selectivity of the CPSS falling off with C increasing beyond about 6 or 8. Notably, the electrical length value of the gap G should be less than λ/4, and preferably less than λ/8, and more preferably less than about L/4. With a dielectric substrate, the optimum value for C tends to be larger than that in a free-space implementation.

Various embodiments of the CPSS of the present disclosure, such as those described hereinabove with reference to FIGS. 4-11, may be implemented in practice in a variety of ways, which include for example free-standing orthogonal dipoles 11, 13 that are connected by a suitable TL, which may be for example in the form of a coaxial TL, which may be filled with a suitable dielectric to increase its electrical length. The TL may also be formed by the two LSs of two proximate crankwires as described hereinabove. In a preferred embodiment, the electrical length of the TL is λ/2, or 180°, while the TSs that lie at the opposing faces of the CPSS are separated by the electrical distance of λ/4, so as to ensure that the E field of the incident radiation experiences the 90° phase shift when propagating therebetween as desired for the CPSS operation. Substantially, this requires that the phase velocity of the EM mode propagation in the TL be half of that of the incident EM wave throughout the rest of the CPSS.

In one exemplary embodiment, the conductors forming the crankwires may be considered to lie in free space, or surrounded by a material which permittivity is close to that of air, or etched on very thin low-loss Printed Circuit Board (PCB) substrates, such as by way of example DuPont AP8515R with $\varepsilon_r$=3.4 and loss tangent factor tan(δ)=0.003, supported by a material which permittivity is close to that of air such as by way of example, Rohacell 31 HF with $\varepsilon_r$=1.04 and loss tangent factor tan(δ)=0.0017, except for the conductors 112 of the longitudinal TLs which conductors are embedded in the dielectric cores of the TLs. Note that the term 'embedded' as used herein encompasses arrangements wherein the conductor is surrounded by the dielectric, either fully or partially, and arrangements wherein the dielectric is inside the conductor, such as for example when the conductors form a coaxial TL. When the conductors are inside the dielectric core, the volume of the dielectric core should preferably be large enough to contain most of the TEM (Transverse Electromagnetic Mode) field of the TL without affecting significantly the propagation velocity of the incident EM wave throughout the rest of the CPSS.

In one preferred embodiment, the CPSS includes a substrate that is made of a dielectric material for supporting the crankwires, wherein the two TSs of each crankwire are formed of conducting strips disposed on opposite faces of the substrate, and wherein the LSs are embedded in the dielectric material of the substrate. In one embodiment, the substrate is shaped so that, for an incident electromagnetic wave of a given frequency, an electrical thickness of the substrate is substantially 90 degrees, an electrical length of the longitudinal TLs is substantially 180 degrees, and an electrical length of the TSs is substantially 90 degrees. In one preferred embodiment, the value of the longitudinal effective relative permittivity $\varepsilon_r^{eff}$ for the corrugated substrate, the value of the relative permittivity $\varepsilon_r$ for the bulk dielectric material of the substrate, the substrate thickness H and the frequency of operation f=c/λ should preferably be chosen such that the following relationship holds:

$$H = \frac{\lambda/\sqrt{\varepsilon_r^{eff}}}{4} = \frac{\lambda/\sqrt{\varepsilon_r}}{2},$$

which leads to $\varepsilon_r^{eff}=\varepsilon_r/4$. For example, the choice $\varepsilon_r=10.7$ and H=1.499 mm yields $\varepsilon_r^{eff}=2.675$ for f=30.57 GHz.

In one embodiment, the CPSS may be realized from a PCB substrate by corrugating, i.e. thinning or removing, the dielectric substrate mostly everywhere except in the immediate vicinity of the TL 130 where the substrate is left solid.

The corrugation of the substrate can be realized, for example, by drilling holes or making grooves or channels in the dielectric material of the PCB substrate, or thinning it in areas preferably a suitable distance away from the TLs 130. The corrugations may be implemented, for example, by machining channels in a PCB substrate.

Figure 12:
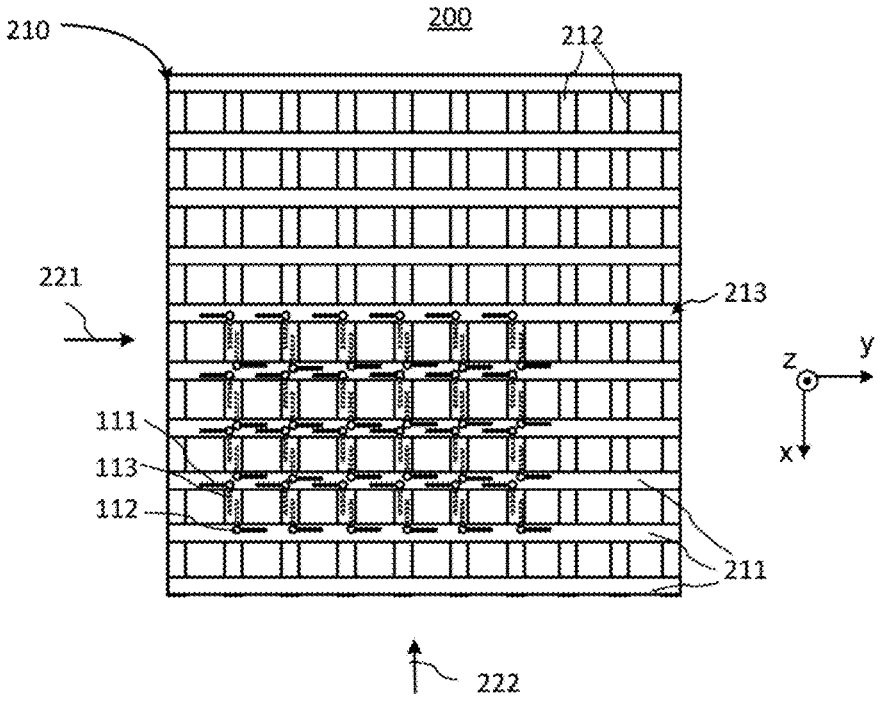
FIG. 12 is a schematic top view of a corrugated substrate composed of two sets of orthogonal dielectric beams supporting the transverse segments of the crankwires of a CPSS array with a view of a portion of the array.
Figure 13:
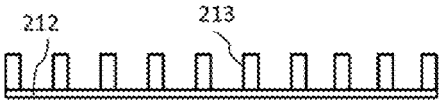
FIG. 13 is one side view of the corrugated substrate of FIG. 12.
Figure 14:
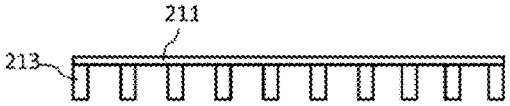
FIG. 14 is another side view of the corrugated substrate of FIG. 12.

With reference to FIGS. 12 to 14, there is illustrated, in top view, an embodiment of a RHCPSS 200 that is formed of two sets of parallel beams 211 and 212, with the beams 211 of one set disposed orthogonally to the beams 212 of the other set so as to form a rectangular grid, as illustrated in FIG. 12 in a plan view. The LSs 112 of the crankwires are embedded in dielectric columns 213 at beam intersections, which are also referred to herein as dielectric cores and which are best seen in FIGS. 13 and 14 showing elevation views of the CPSS 200 from directions indicated by arrows 221 and 222, respectively; these dielectric columns may be of circular, square, or other suitable cross-section but the shape and dimensions of their cross-section affect the electrical length of the TLs. The TSs 111 and 113 of each crankwire are disposed upon the outer faces of the beams 211 and 212 of the first (211) and second (212) sets, respectively, extending from the beam intersection along the respective beams. The LSs 112 may be implemented, for example, as metallized via-holes extending through the cores 213 and electrically connecting the respective TSs 111 and 113. In some embodiments, the beams 211, 212 may be sufficiently thick so that beams 211 lie directly on top of beams 212 without the dielectric columns 213.

The CPSS 200 may be fabricated, for example, by etching a PCB to produce the desired metallic pattern of TSs on both PCB faces and metallized via-holes, and in machining the dielectric substrate of the PCB from both sides at orthogonal directions to form the two sets of beams or ridges supporting the metallic strips of the TSs. The depth and width of the grooves between the ridges are selected so as to achieve the desired effective permittivity values in the transverse and longitudinal directions and in the vicinity of the dielectric cores that make the longitudinal TLs appear to be a half-wavelength long within a physical spacing a quarter-wavelength long.

Another advantage in corrugating the PCB substrate is to reduce the effective permittivity of the substrate so as to minimize the wave-impedance mismatch between free-space and the CPSS substrate so as to reduce the magnitude of the CP cross-polarized reflection off the CPSS.

A further advantage in corrugating the PCB substrate is that the corrugation helps to prevent the formation of surface waves whose presence would cause the amount of EM coupling to be different from that which was desired.

In one embodiment, to achieve a suitable substrate thickness, the overall substrate with copper foil on both faces could be fabricated from two equal thickness substrates that have copper foil on only one side and which are subsequently glued together from the other side with the use of a thin bonding film, such as by way of example Arlon CuClad6250 with $\varepsilon_r=2.32$ and loss tangent factor tan(δ)=0.0013. Each half-thickness substrate would be devoid of copper foil on one face in order to allow machining precisely their thickness and machining grooves or corrugations and to allow bonding the two half-thickness substrates together. The presence of the thin bonding film at mid-thickness would not perturb significantly the performance of the CPSS if the film was not too lossy electrically.

In one embodiment, the geometry of FIGS. 12-14 could be obtained by machining two series of parallel channels in the PCB substrate such that the channels machined from one face of the PCB were orthogonal to those machined from the other face of the PCB. The depth of each channel may be such that the intersection of the orthogonal channels results in a hollow structure. As the structure would become mechanically weak after machining one series of channels, an auxiliary mold resembling a bed of rectangular posts could be mated with the half-machined PCB substrate in order to provide mechanical strength during the machining of the second series of channels from the other surface of the PCB. The mold is removed after machining. Alternatively, the substrate could be 3D printed and conductive traces could be generated for example by exposure of the printed substrate that is impregnated with metallic particles, to a tracing laser beam that forms a conducting strip along the trace by melting the metallic particles that are contained in the impregnated substrate and that coalesce upon liquefaction. If the resulting PCB structure needs to be rigid, the channels could be filled up with a low-loss low-permittivity dielectric material like Rohacell. Otherwise, depending on the type of substrate, the structure could be bent to some extent to be made to conform to smoothly curved surfaces.

One exemplary embodiment uses a commercially available non-reinforced PCB substrate that is reported to have a relative permittivity $\varepsilon_r=3$ and a loss tangent factor tan(δ)=0.003 at an operating frequency f=10 GHz. Using a permittivity of 3 instead of 4 may have the advantage of avoiding the increasing material anisotropy of Teflon-like material as the permittivity value of the bulk material departs from the value of about 3. One advantage of not using a fiber-reinforced substrate is also to have a lower substrate anisotropy. However, embodiments may be envisioned that utilize the substrate anisotropy to improve the CPSS performance.

The following notations are used herein in the description of this and related embodiments and simulation results:

The length and width of the conducting strip that forms each TS of a crankwire are denoted as L and W, respectively. Conducting strips embody the TSs in a CPSS that is fabricated with conventional PCB techniques, such as photolithography and chemical etching of a copper foil that is bound to one or both sides of a dielectric substrate.

The diameter of each cylindrical LS of a crankwire is denoted as d. These segments can be fabricated, for example, as metallized, e.g. copper-plated, via-holes, also called vias, through the PCB substrate.

The center-to-center separation distance along X or Y between the two cylindrical conductors of the longitudinal TL formed by the two LSs of two adjacent crankwires is denoted as D.

The period of the array is denoted as S and is defined herein as the distance between two nearest nodes of the lattice of the array. With a square lattice, S is also the width and height of each square cell of the lattice. With an equilateral triangular lattice, S is also the side length of the equilateral triangles formed by adjacent nodes of the lattice.

The coupling length and the length of the separation gap, either side-to-side or end-to-end depending on the type of EM coupling between the parallel TSs of two adjacent crankwires, are denoted as P and G, respectively.

The end-to-end separation distance along X or Y between proximate ends of the two TSs of a same dipole, is denoted as U.

For the side-to-side EM coupling configuration of FIGS. 4-10(*a*) the following relationship holds: S=(2L−P+U). The coupling gap G does not appear in this expression because the two parallel TSs of the two adjacent crankwires are side-by-side rather than end-to-end. In this embodiment, the gap G refers to the separation distance between the two side-by-side parallel TSs. If each TS is long enough, it overlaps with the other side-by-side TS by an amount corresponding to the coupling length P.

For the end-to-end EM coupling as illustrated in FIGS. 10(*b*) and (*d*), the following relationship holds: S=(2L+G+U). The coupling length P does not appear in this expression because the two parallel TSs are end-to-end rather than side-by-side. The coupling length P here refers to the length of the end-coupling portion of each TS, such as the 90 degree bent section of FIG. 10(*b*). The bent end-coupling portions could be realized with or without beveling or padding the corner of the bend.

The case of EM coupling that would be achieved by a mixture of side-to-side and end-to-end coupling is also within the scope of this disclosure. Such a mixture might be realized by having the bent segments bent at an angle different than 90 degrees as illustrated in FIG. 10(*c*), or by flaring the ends of the TSs, either symmetrically as shown in FIG. 10(*d*), or asymmetrically.

Figure 25:
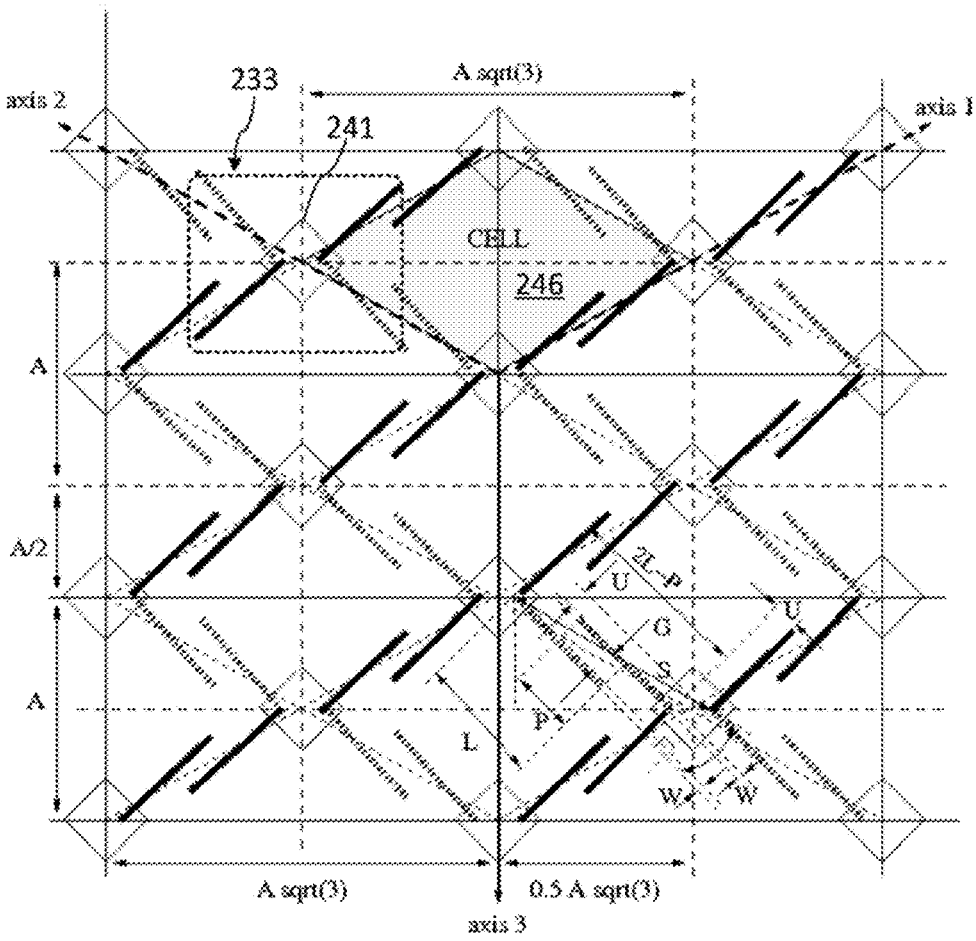
FIG. 25 is a schematic representation of a CPSS formed with a second equilateral triangular DCE array which may be obtained from the DCE array of FIG. 24 by rotating each DCE by 90 degrees relative to the lattice in order to reduce the value of the gap G.

In FIG. 8, each dipole 11 and 13 is formed of two TSs, which form the dipole ms and which may be offset with respect to one another. If the two arms of the dipole are aligned to form in-line dipoles rather than being offset to form offset dipoles, the LSs 112 that together form the TL 130 may need to undergo, either continuously or abruptly, a twist totaling 90 degrees between the two ends of the TL. Advantageously, by offsetting the transverse arms, this twist may be avoided to ease the fabrication process. This offset 116 also permits to 'overlap' the TSs of two adjacent crankwires in two adjacent cells by "sliding" one TS past the other as shown in FIGS. 5-10(*a*). The value of the lateral offset 116 between the centerlines of the two arms of an offset dipole is equal to the value of the gap G plus the value of the segment width W. In embodiments using square lattices and offset dipoles, the chains of EM coupled DCEs remain aligned with the square lattice. In embodiments using square lattices and in-line dipoles, the absence of lateral offset between the dipoles forces adjacent EM coupled DCEs of the chain to be positioned alternatingly up and down so as to maintain the center-line of the chain aligned with the square lattice so as to avoid a progressive lateral displacement along the chain. However, in embodiments of CPSS using a triangular lattice as in FIG. 25, there may inherently exist a progressive lateral displacement from one DCE to the next in a chain of EM coupled DCEs. In FIG. 25, this displacement corresponds to the direction of the characteristic axis denoted in the figure as 'axis 1' for the chains of TSs shown in thick solid lines, and to the direction of the characteristic axis denoted in the figure as 'axis 2' for the chains of TSs shown in thick dashed lines. In embodiment using offset dipoles, the lateral offset of offset dipoles gets incorporated in this lateral displacement. In embodiments using in-line dipoles, the lateral displacement can still be implemented by adjusting the value of the period S for a prescribed value of gap G. Hence, the use of a triangular lattice may facilitate the use of in-line dipoles while still achieving the desired value of gap separation G. Neglecting the consideration of using of twisted longitudinal TLs, the use of in-line dipoles may improve the performance of the CPSS.

The presence of the dielectric bridges or beams on which the TSs reside causes the electrical dimensions for G, P, S and L to scale somewhat differently than the electrical dimensions for D and H because G, P, S and L depend on the local effective permittivity that the EM wave propagating on the TSs experiences in the vicinity of the air-dielectric interface, whereas H depends on the large-scale effective permittivity that the incident wave experiences as it propagates through the CPSS, and D depends on the local effective permittivity that the wave propagating on the longitudinal TL experiences. Optimum values of the geometrical and material parameters may be determined by optimization with an EM simulator as generally known in the art for similar type of devices, without requiring the explicit knowledge of the values of these three effective permittivities.

In one exemplary embodiment that used a corrugated substrate with a bulk permittivity $\varepsilon_r=3$, the dimensions of each square column was 3.8720 mm on each side. This is also the width of the dielectric beams that the dielectric columns support. The thickness of the dielectric beams was chosen to be about 0.9250 mm as a compromise between mechanical rigidity and the need to achieve the desired values of the three effective permittivities mentioned hereinabove. Other choices of bridge thickness and width and other choices of cross-sectional shapes and dimensions are possible but the structure should be optimized for each different choice of shapes, dimensions and dielectric materials so as to provide the desired electrical length of the TL and TSs, and the desired electrical thickness of the substrate.

Specific transverse geometrical parameters of the TL that determine its characteristic impedance may not be critical for the optimum CPSS operation since a short-circuit is transformed into an open-circuit and vice-versa, for any finite value of the characteristic impedance, provided that the electrical length over which the impedance transformation is carried out is substantially $\lambda/4$. This can be easily seen from the following well-known expression for the input impedance $Z_{in}$ along a TL:

$$Z_{in} = Z_o \frac{Z_L \cosh \gamma L + Z_o \sinh \gamma L}{Z_o \cosh \gamma L + Z_L \sinh \gamma L}$$

wherein $Z_0$ is the characteristic impedance of the TL, $Z_L$ is the load impedance, $\gamma$ is the propagation constant of the TL, and L here is the length over which the impedance transformation is carried out. Clearly, if $(\gamma L)=\pi/2$, then for any finite value of $Z_0$ we have $Z_{in}=\infty$ when $Z_L=0$, and $Z_{in}=0$ when $Z_L=\infty$. Therefore, provided that $(\gamma L)$ is substantially equal to $\pi/2$, the performance of the CPSS may generally be insensitive to the type, or the precise cross-sectional dimensions, of the TL and there may be no requirement to match the input impedance of the offset dipoles to the characteristic impedance of the TL. However, the cross-sectional dimensions of the dielectric core of the TL affects the value of the local effective permittivity as experienced by the EM wave propagating on the TL and thus, also affects the value of the electrical length γL of the TL. Tolerances in the actual value of the permittivity and in the thickness of the dielectric substrate, and departure from the resonance frequency are other factors that can cause (γL) not to be exactly π/2, in which case the values of $Z_0$ and $Z_L$ may then affect the performance of the CPSS.

An optimum amount of the EM coupling and an optimal choice of the size of the CPSS cell may depend on a particular CPSS application, and could be identified using a suitable commercially available simulation software, for example such as ANSYS HFSS software that is available from ANSYS, Inc. or CST's Studio Suite that is available from CST of America®, Inc., that may be assisted as needed by simple experimentation as would be evident to those skilled in the art. Results provided hereinbelow are by way of example only and were obtained using an accurate software that uses a Finite Difference Time Domain (FDTD) full-wave EM solver of the scattered field formulation, as described in the paper entitled "*A Numerical Technique for Computing the Values of Plane Wave Scattering Coefficients of a General Scatterer*", *IEEE Trans. Antennas and Propagation*, Vol. AP 57, No. 12, December 2009, pp. 3868-3881, and in the paper entitled "*On Using a Closed Box as the Integration Surface with the FDTD Method*", *IEEE Trans. Antennas and Propagation*, Vo. 60, No. 5, May 2012, pp. 2375-2379. Simulation results presented below are to demonstrate the contribution of at least some of the novel features of the disclosure to the performance of the reciprocal CPSS of the type illustrated in FIGS. 4-14. Simulations were performed for values of the CPSS period S less than λ/2, to avoid the formation of secondary lobes in the scattered field and the presence of higher-order propagation modes over the CPSS.

Figure 15:
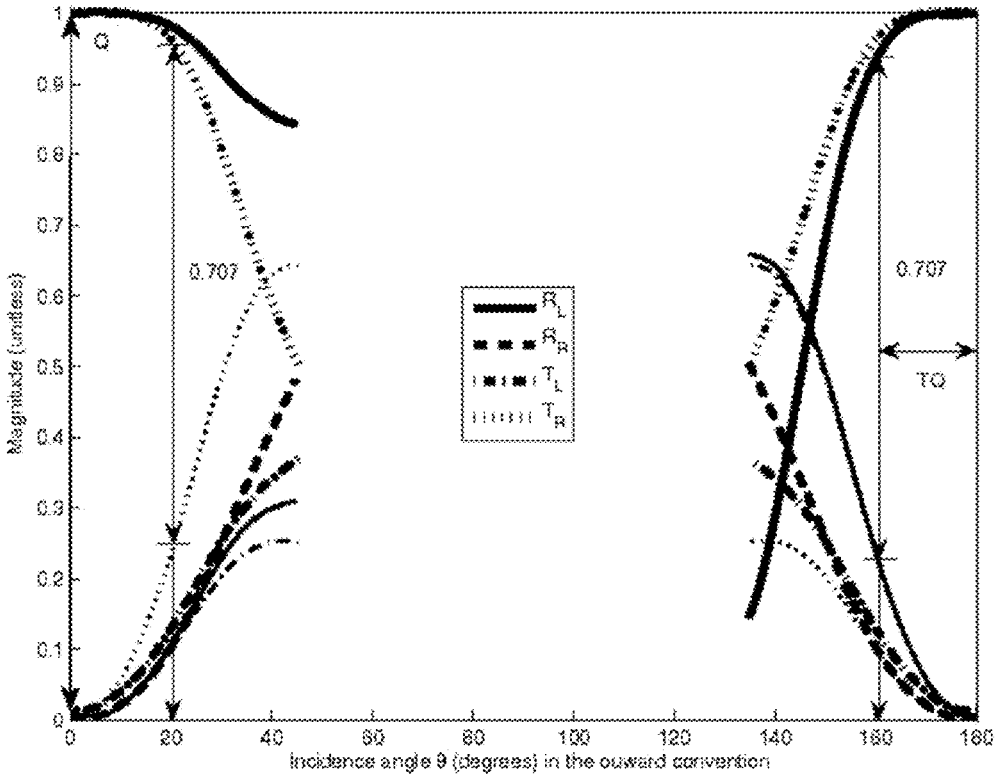
FIG. 15 is a graph showing simulation results, in a linear scale, for magnitudes of co-polarization and cross-polarization CP transmission and CP reflection coefficients in dependence on the angle of incidence θ for an exemplary embodiment of a 36×36 CPSS array.
Figure 16:
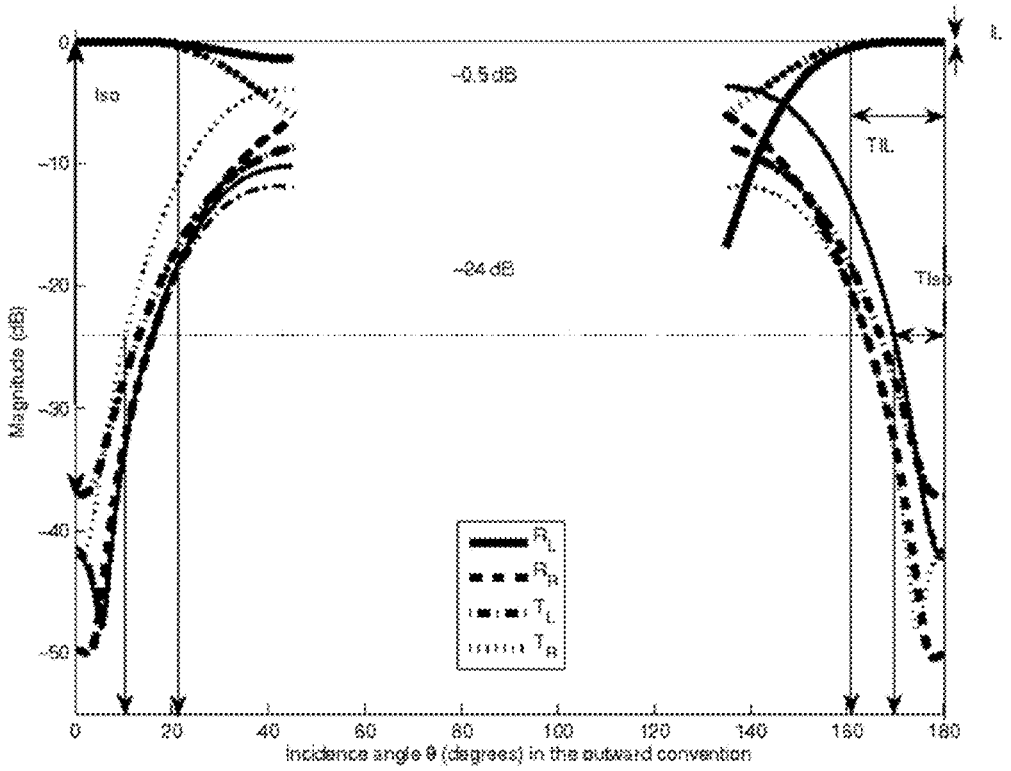
FIG. 16 is a graph showing same angular dependencies of the magnitudes of co-polarization and cross-polarization CP transmission and CP reflection coefficients as in FIG. 15 in a logarithmic (dB) scale.
Figure 17:
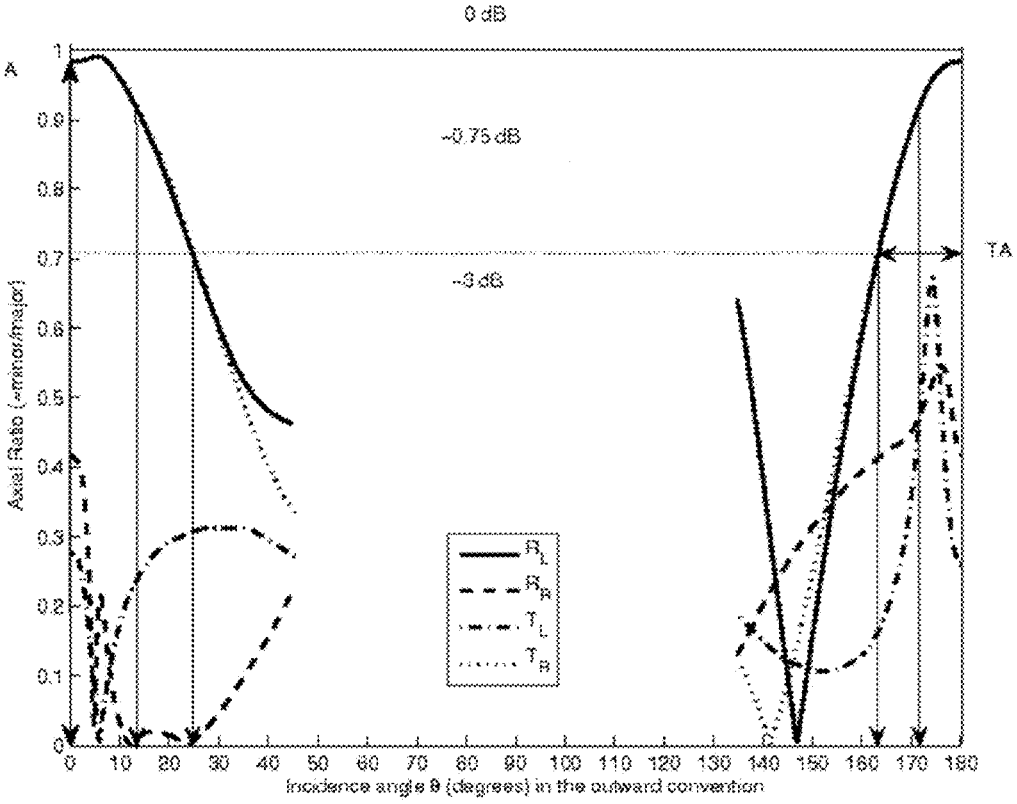
FIG. 17 is a graph showing the simulation results in term of an axial ratio of the elliptical polarization of reflected and transmitted radiation for LHCP and RHCP incident radiation in dependence on the angle of incidence θ for the 36×36 CPSS array of FIGS. 15 and 16.

FIGS. 15-17 present simulations results illustrating a performance for a 36×36 LHCPSS, with side-to-side EM coupling of the TSs, using the corrugated substrate with $\varepsilon_r$=3 and square cross-section dielectric columns of width 3.8720 mm on each side, and dielectric beams of 0.925 mm thickness, and using S=89, L=47, P=7, G=4, d=6, D=12, U=2, H=32, where the integer numbers refer to numbers of spatial discretization steps of the simulation model. Unless mentioned otherwise, the spatial discretization step size is Δs=0.185 mm along Z and Δs=0.121 mm along X and Y. The frequency of operation is f=12 GHz. It will be appreciated that all these values are by way of example only. If the material has negligible loss, the design can be scaled for another frequency by simply changing the values of the parameter Δs along Z and along X and Y. The simulation results presented in FIGS. 15-17 represent a significant improvement over the results found in prior art.

FIG. 15 shows the simulated CPSS performance in terms of the magnitudes of the co-polar (thicker lines) and cross-polar (thinner lines) CP scattering, i.e. reflection (R) and transmission (T), coefficients in the XZ plane (i.e. φ=0 or 180 degrees), plotted on a linear scale, in dependence on the angle of incidence θ, with the second subscript indicating the incident wave polarization and the first subscript indicating the scattered, i.e. transmitted or reflected, wave polarization; so that for example $R_{LL}$ denotes the co-polar reflection coefficient relating the complex amplitude of the reflected LHCP wave to that of the incident LHCP wave, $R_{RR}$ denotes the co-polar reflection coefficient relating the complex amplitude of the reflected RHCP wave to that of the incident RHCP wave, $R_{RL}$ denotes the cross-polar reflection coefficient relating the complex amplitude of the reflected RHCP wave to that of the incident LHCP wave, $R_{LR}$ denotes the cross-polar reflection coefficient relating the complex amplitude of the reflected LHCP wave to that of the incident RHCP wave, and similar designations for the transmission coefficients $T_{LL}$, $T_{RR}$, $T_{RL}$ and $T_{LR}$. '0' and '180' degrees correspond to normal incidence at opposite CPSS faces.

The thick solid curve refers to the co-polar reflection coefficient $R_{LL}$. The thin solid curve refers to the cross-polar reflection coefficient $R_{LR}$. Similarly, the thick and the thin dot-dashed curves refer to the co-polar and the cross-polar transmission coefficients $T_{LL}$ and $T_{LR}$ respectively. The thick and the thin dashed curves refer to the co-polar and the cross-polar reflection coefficients $R_{RR}$ and $R_{RL}$ respectively. The thick and the thin dotted curves refer to the co-polar and the cross-polar transmission coefficients $T_{RR}$ and $T_{RL}$ respectively. The magnitude of any scattering coefficient must always be equal to or less than 1. Hence, all curves in FIG. 15 should be bound by an ordinate value of 1.

The values of plane wave scattering coefficients may be inaccurate over the angular range of about 45°≤θ≤135° due to limitations of the numerical technique implemented in the software, with the angular range of validity of the simulations results being θ<45° and θ>135°. FIGS. 15-17 show only simulation results over the angular range of validity.

FIG. 16 shows the same eight dependences as FIG. 15 but plotted on a decibel (dB) scale rather than the linear scale of FIG. 15, wherein the value in dB is computed as $X_{dB}=20*\log_{10}(|X|)$ where |X| refers to the magnitude of the complex amplitude X.

On a linear scale, an ideal LHCPSS would have the magnitude curves for $R_{LL}$ and $T_{RR}$ at ordinate value 1 while having the other magnitude curves $R_{RL}$, $R_{RR}$, $R_{LR}$, $T_{LR}$, $T_{LL}$ and $T_{RL}$ at ordinate value 0, and the AR curves for $R_{LL}$ and $T_{RR}$ at ordinate value 1.

The outward convention for labeling the propagation direction of waves that is used herein for FIGS. 15-17 is defined with the propagation vector of an incident plane wave pointing outwards, i.e. away from the origin of the coordinate system, and the propagation vector of a scattered plane wave also pointing outwards. The plots for the inward convention would be obtained from the plots for the outward convention by flipping end-to-end the horizontal axis of the plots. Hence θ=0 in the outward convention corresponds to θ=180 in the inward convention and similarly, θ=0 in the inward convention corresponds to θ=180 in the outward convention. The incidence direction is defined by the conventional spherical coordinate angles θ and φ with the zenith angle θ referenced to the positive Z axis, the azimuthal angle φ referenced to the positive X axis and the origin of the spherical coordinate system located at the center of the CPSS with the Z axis being normal to the faces of the CPSS.

The transmission coefficient is shown here with the conventional transmission line definition whereby the positive direction of the E field vector is that whose tangential (to the interface) component of the E field vector points in the same direction for the incident, reflected and transmitted waves so that the LP reflection coefficients of the parallel and the perpendicular polarizations are identical at normal incidence.

The CPSS performance can be characterized in terms of the axial ratio (AR) of the scattered radiation. The AR is defined herein as the ratio of the minor to the major axes of the polarization ellipse of the scattered wave, hence AR≤1. The value of AR in dB is computed as $AR_{dB}=20*\log_{10}(AR)$.

The CPSS performance can also be characterized in terms of the following performance parameters that are common in the technical literature: IL, which is the Insertion Loss in dB, Iso, which is the Isolation in dB, TIL, which is the θ angular range over which IL<0.5 dB in degrees, and TIso, which is the θ angular range over which Iso>24 dB in degrees. From FIG. 16, the following exemplary values of these performance parameters may be obtained:

$IL_R=-20*\log_{10}(|R_{LL}|)=0.0014$ dB, which is the CPSS insertion loss in reflection wherein $|R_{LL}|$ refers to the magnitude of the complex amplitude $R_{LL}$.

$IL_T=-20*\log_{10}(|T_{RR}|)=0.0006$ dB, which is the CPSS insertion loss in transmission wherein $|T_{RR}|$ refers to the magnitude of the complex amplitude $T_{RR}$.

$Iso_R=-20*\log_{10}(|R_{RR}|)=50.1$ dB, which is the Isolation in reflection at θ=0 degree, and $Iso_R=49.8$ dB which is the Isolation in reflection at θ=180 degrees wherein $|R_{RR}|$ refers to the magnitude of the complex amplitude $R_{RR}$.

$Iso_T=-20*\log_{10}(|T_{LL}|)=37.1$ dB, which is the Isolation in transmission at θ=0 and 180 degrees wherein $|T_{LL}|$ refers to the magnitude of the complex amplitude $T_{LL}$.

The values for TIL are about 21 degrees for an illumination from below (i.e. the left end of the plot), and about 20 degrees for an illumination from above (i.e. the right end of the plot). In FIG. 16, TIL is shown for the worst case, i.e. TIL is shown at the right end of the figure. The values of TIso are about 10 degrees for both sides, so TIso is arbitrarily shown at the right end of the figure.

FIG. 17 shows the angular dependence of the AR, wherein '$R_L$' and '$R_R$' refer to the AR of the reflected wave when the incident wave is LHCP and RCHP, respectively, and '$T_L$' and '$T_R$' refer to the AR of the transmitted wave when the incident wave is LHCP and RCHP, respectively. In FIG. 17, the values for $R_L$ are 0.14 dB and 0.15 dB at θ=0 and 180 degrees, and the values for $T_R$ are 0.15 dB and 0.14 dB at θ=0 and 180 degrees. The values for TA for −3 dB threshold is about 25 degrees at the left end of the θ angular range, and 15 degrees at the right end. Showing TA for the worst case, TA is shown at the right end of the θ angular range.

Tables 1 to 6 illustrate simulation results for the performance for a LHCPSS formed of a Cartesian array of 30×30 cells, each cell with a free-standing double crankwire with side-to-side EM coupling as illustrated in FIG. 5 and TLs embedded in dielectric columns of bulk permittivity $\varepsilon_r=4$ and cross-section 7.0×17.0 mm, using a spatial discretization step size Δs=0.185 mm along X, Y and Z with a frequency of operation f=12 GHz, in terms of figures of merits Q, A, TQ and TA, with 'Q' and 'TQ' indicated as in FIGS. 15 and 16, and 'A' and 'TA' indicated as in FIG. 17. 'Q' refers to the width of an opening O(θ=0,180)) between the T and R curves at normal incidence, corresponding to the difference between the minimum among the $R_{LL}$ and $T_{RR}$ values, and the maximum among the $R_{LL}$, $R_{RR}$, $T_{LR}$, $T_{RL}$, $R_{RL}$ and $R_{RL}$ values, at normal incidence, as indicated by vertical arrows at θ=0 and 180 degrees in FIG. 15; the length of the smallest of these two arrows is taken a 'Q'. 'TQ' refers to the minimum range of the angle of incidence θ over which the opening is larger than or equal to $1/\sqrt{2}$, as indicated by two horizontal arrows extending from the vertical lines at θ=0 and 180 degrees in FIG. 15; the length of the shortest of these two arrows is taken as 'TQ'; the symbol 'N/A' is used to indicate that the opening is less than $1/\sqrt{2}$. 'A' refers to the smallest peak value among the AR values for $R_{LL}$ and $T_{RR}$ at normal incidence, while 'TA' refers to the minimum angular range in θ over which the AR values for $R_{LL}$ and $T_{RR}$ are larger than or equal to $1/\sqrt{2}$.

Table 1 shows simulated figures of merit Q, A, TQ and TA for a LHCPSS with S=61, G=2, U=2, d=5, W=5 and different values of L and P.

TABLE 1

| L, P | Q | A | TQ (deg) | TA (deg) |
|---|---|---|---|---|
| 45, 31 | 0.218 | 0.92 | N/A | 22.7 |
| 38, 17 | 0.407 | 0.92 | N/A | 18.3 |
| 36, 13 | 0.538 | 0.91 | N/A | 16.8 |
| 34, 9 | 0.744 | 0.90 | 17 | 14.7 |
| 33, 7 | 0.884 | 0.90 | 16 | 13.6 |
| 32, 5 | 0.922 | 0.89 | 14 | 12.5 |
| 31, 3 | 0.720 | 0.87 | 4 | 11.5 |
| 30, 1 | 0.433 | 0.85 | N/A | 10.4 |

The results in Table 1 show that: i) the optimum performance is reached in this exemplary case with P=5, ii) the optimum performance is reached with a value of L=32 that is substantially different from L=48 which corresponds to the length of about 3λ/8 that is required for the TSs of Pierrot's single crankwire, and iii) the performance varies asymmetrically about the optimum value of P.

As the coupling length P decreases, the amount of side-to-side EM coupling decreases. For P near 0, there is still some amount of EM coupling but the coupling is no longer side-to-side but rather end-to-end between the ends of the two respective TSs. When P becomes negative, i.e. when the overlap becomes in fact a gap between the TS ends, there is practically no more EM coupling between the TSs. Tilston's design would correspond to the case where there was little or no EM coupling.

Simulations show that when the TS gap G is increased from G=2 to G=4, an optimum overlap length P must be nearly doubled to obtain about the same amount of EM coupling. This agrees with the capacitance between the two edges of the two coupled TSs varying inversely proportional with the gap separation G and directly proportional with the overlap length P. This observation is borne out in Table 2 which presents the values of the figures of merit for the same type of LHCPSS as that of Table 1 when P is varied, with G=2 or 4, S=61, U=2, d=5. In simulations, the value of G was varied by varying the value of W so as to maintain constant the values of S, d and U.

TABLE 2

| G, P, L, W | Q | A | TQ (deg) | TA (deg) |
|---|---|---|---|---|
| 2, 5, 32, 5 | 0.922 | 0.89 | 14 | 12.5 |
| 4, 9, 34, 4 | 0.912 | 0.85 | 15 | 12.7 |
| 4, 11, 35, 4 | 0.894 | 0.86 | 16 | 13.9 |

FIG. 18 illustrates by way of example the dependence of Q on the ratio C=P/G according to the results summarized in Tables 1 and 2. As can be seen from the plot, the exemplary CPSS achieves the best efficiency in separating the CPs of different handedness when C is in the range from about 2 to 4, with Q falling below 0.5 when C is less than approximately 1 or greater than approximately 7. It will be appreciated that the plot of FIG. 18 may be different when the dielectric substrate of the CPSS is not free space or that the lattice of the CPSS array is not square.

As stated hereinabove, when the electrical length of the TL is a half-wavelength, the value of the characteristic impedance $Z_0$ of the TL is not critical. For a bifilar TL with circular conductors of diameter d, separated by a center-to-center distance D, the value of the characteristic impedance of the TL is obtained as:

$$Z_o = \frac{\eta}{\pi}\operatorname{arccosh}\left(\frac{D}{d}\right)$$

where $\eta=\sqrt{\mu/\varepsilon}$, is the intrinsic impedance of the propagation medium in which the TL is embedded. The results in Tables 1-2 were obtained with d=5 which resulted in D/d=2.12 and arccos h(D/d)=1.384. When the diameter of the cylindrical conductors is decreased from d=5 to d=3, there results D/d=3.536 and arccos h(D/d)=1.935 which represents a 40% change in the value of $Z_o$. Yet, in spite of this large change in the value of $Z_o$, the values of the figures of merit shown in Table 3 change little. Hence, the input impedance of the transverse offset dipoles does not have to be matched to the value of $Z_o$ when the CPSS is operated at resonance.

TABLE 3

| d | Q | A | TQ (deg) | TA (deg) |
|---|---|---|---|---|
| 5 | 0.922 | 0.89 | 14 | 12.5 |
| 3 | 0.927 | 0.91 | 19 | 16.7 |

Table 4 presents the values of the figures of merit when the value of the period S is varied, with G=2 and P=5. Table 5 presents the values of the figures of merit when the CPSS period S is varied with G=4. The results show that the value of Q degrades as S changes away from an optimum value, with S=61 being nearly optimum for both cases of G=2 and G=4 in the exemplary case considered here. Advantageously, the near-optimum value of S is smaller than a half-wavelength, as required to avoid the formation of secondary lobes in the radiation pattern of the array, and to avoid the presence of higher-order propagation modes over the array. Tables 4-5 also show that the degradation in the value of Q when S deviates from an optimal value is faster for G=2 than for G=4.

TABLE 4

| P = 5, G = 2, U = 2, d = 5, W = 5 | | | | |
|---|---|---|---|---|
| S, L | Q | A | TQ (deg) | TA (deg) |
| 59, 31 | 0.791 | 0.88 | 7 | 9.4 |
| 61, 32 | 0.922 | 0.89 | 14 | 12.5 |
| 63, 33 | 0.905 | 0.89 | 17 | 15.0 |

TABLE 5

| G = 4, U = 2, d = 5, W = 4 | | | | |
|---|---|---|---|---|
| S, P, L | Q | A | TQ (deg) | TA (deg) |
| 59, 9, 33 | 0.819 | 0.84 | 6 | 10.1 |
| 61, 9, 34 | 0.912 | 0.85 | 15 | 12.7 |
| 63, 9, 35 | 0.864 | 0.85 | 15 | 15.0 |
| 61, 11, 35 | 0.894 | 0.86 | 16 | 13.9 |
| 55, 11, 32 | 0.651 | 0.86 | N/A | 2.6 |

Table 6 presents the values of the figures of merit for different values of the azimuthal angle φ of incidence so as to assess the performance in different azimuthal directions of incidence. The value of φ=0 corresponds to the positive half of the XZ plane, i.e. the incident plane wave is incident from the positive half of the XZ plane in FIG. 5. The results of Table 6 show that the performance varies slightly with the azimuthal direction of incidence. In fact, due to the trace pattern on one face of the CPSS being the 90 degree rotation of that on the other face, the T, R and AR curves for φ=(−45+Δφ) degrees in one hemisphere are those for φ=(−45−Δφ) degrees in the other hemisphere, mirrored about θ=90 degrees. For example, with Δφ=15 degrees, the curves for φ=−30 degrees in one hemisphere are the mirrored curves for φ=−60 degrees in the other hemisphere. Consequently, the curves for φ=−45 degrees are symmetrical about θ=90 degrees. The results of Table 6 cover only one quadrant of the azimuthal range. The results in the three other quadrants can be obtained from those shown in Table 6 by using the fact that the geometry has a 2-fold rotational symmetry in azimuth and that the trace pattern on one face is the 90 degree rotation of that on the other face.

TABLE 6

| φ (deg) | Q | A | TQ (deg) | TA (deg) |
|---|---|---|---|---|
| 0 | 0.927 | 0.91 | 19 | 16.7 |
| −15 | 0.927 | 0.91 | 14 | 15.7 |
| −30 | 0.927 | 0.91 | 12 | 15.0 |
| −45 | 0.927 | 0.91 | 12 | 14.8 |
| −60 | 0.927 | 0.91 | 12 | 15.2 |
| −75 | 0.927 | 0.91 | 15 | 16.6 |
| −90 | 0.927 | 0.91 | 20 | 20.1 |

Thus, the simulation results confirm that the CPSS with the EM coupling between the constituent crankwires or dipoles may provide a superior performance as compared to CPSS embodiments without EM coupling between the constituent crankwires or dipoles, under both normal and oblique incidences, in discriminating between the two senses of the CP polarization of an incident EM wave, i.e. predominantly reflecting radiation of one CP sense while predominantly transmitting CP polarization of the other CP sense.

The exemplary CPSS embodiments described hereinabove relate mainly to square-cell CPSSs with the crankwires oriented so that their TSs extend along the sides of the square cells, and with the two crankwires of each double crankwire element (DCE) disposed close to the cell boundaries, such as for example illustrated in FIGS. 4 and 5. It will be appreciated however that other CPSS embodiments may utilize DCEs with differing relative arrangements of the two crankwires within each cell, and these DCEs may be disposed in a variety of distributed arrangements forming a 2D array in dependence on the choice of the lattice for the array, and the DCEs may be oriented at substantially any angle relative to the cells of the array. Furthermore, the EM coupling between adjacent TSs can be either side-to-side or end-to-end EM coupling. These four choices allow for considerable number of possibilities in the design of a CPSS.

Figure 2:
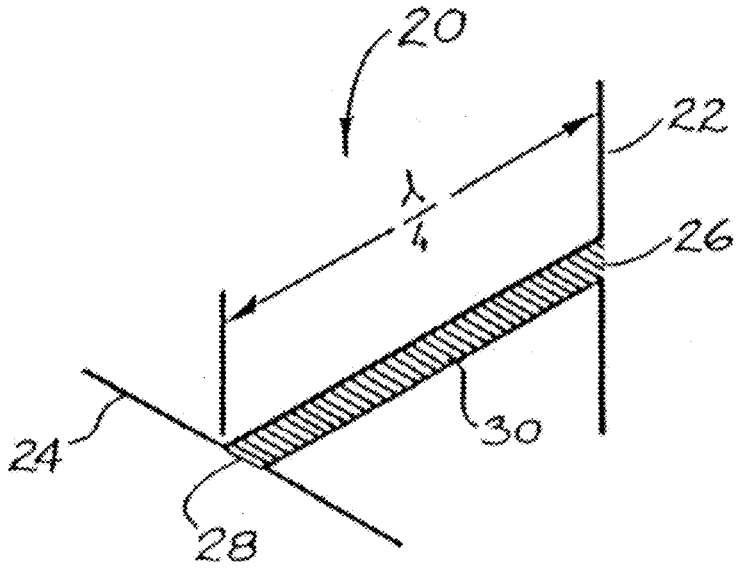
FIG. 2 (PRIOR ART)
FIG. 2 is a schematic diagram illustrating a prior art CPSS element in the form of two orthogonal λ/2 dipoles connected by a λ/2 transmission line within a λ/4 spacing.
Figure 3:
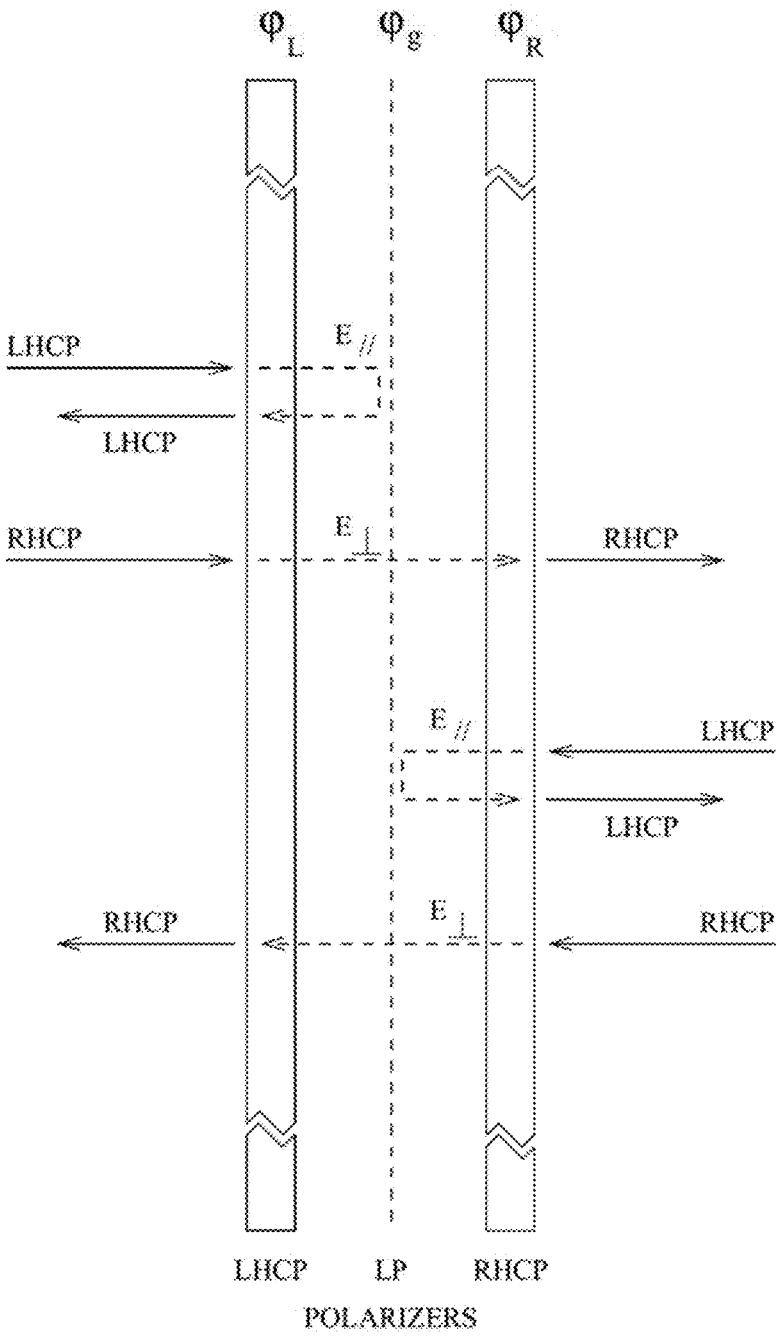
FIG. 3 (PRIOR ART)
FIG. 3 is a schematic diagram illustrating a prior art CPSS formed of two CP polarizers sandwiching a linear wire-grid polarizer.
Figure 19:
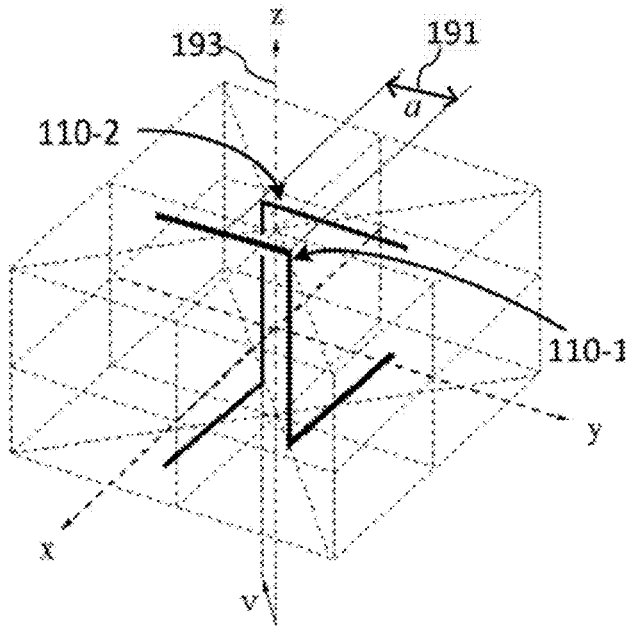
FIGS. 19(A) and 19(B) are isometric views of two example DCEs with differing crankwire positioning with respect to the 2-fold rotational symmetry axis of the DCE, with the vector V indicating the placement of a first crankwire.
Figure 19:
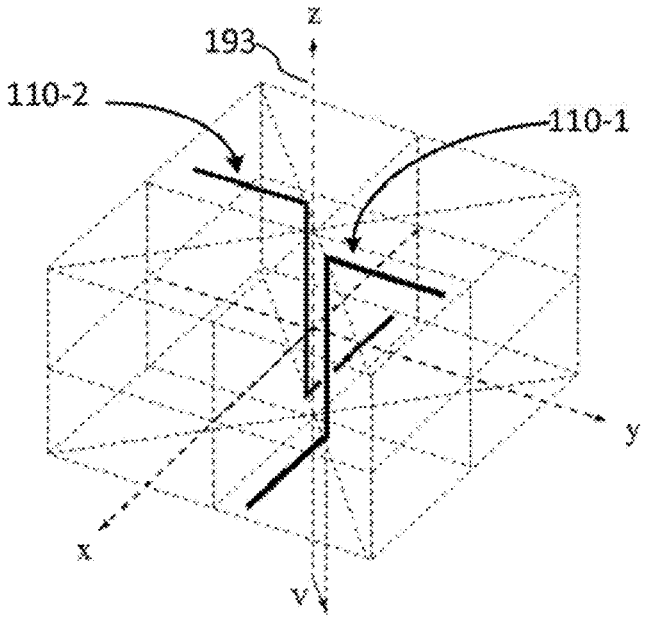

Referring to FIGS. 19 (A) and 19(B), there are illustrated by way of example two different DCEs, each formed of two crankwires 110-1 and 110-2 disposed so at to provide a 2-fold rotational symmetry to the respective double crankwire element, with the axis of symmetry 193 assumed to be the z-axis of an associated Cartesian coordinate system (x,y,z). The DCEs of the FIGS. 19(A) and 19(B) differ by an offset vector V of the LS of the crankwire 110-1 from the axis of symmetry 193. It will be appreciated that, generally, the offset vector V may have any length and direction. FIG. 19(A) illustrates a DCE embodiment wherein the symmetry axis passes between the TSs of the two crankwires, so that the in-plane TSs of the two crankwires of the DCE extend alongside each other along at least a portion a 191 of their length L. FIG. 19(B) illustrates a DCE embodiment wherein the TSs of the two crankwires extend away from the symmetry axis 193 along their whole length, so that a is in effect negative. The DCE of FIG. 4 may be viewed as an embodiment of the DCE of FIG. 19(A) with a greater offset vector V, so that a is about, or slightly smaller, than the TS length L. The DCE of FIG. 8 may be viewed as an embodiment of the DCE of FIG. 19(B). Furthermore, although the in-plane TSs of the DCE of FIG. 19(B) are shown to be laterally offset from each other, the embodiment of FIG. 19(B) may be modified so that two of the in-plane TSs are collinear, i.e. lie in a same line, as illustrated in FIG. 2. In some embodiments, the lengths of the transverse elements in FIG. 19(A) or 19(B) may be such as to provide resonant dipoles at the wavelength of operation as described hereinabove. The LSs of the two crankwires of the DCEs may form a TL as described hereinabove. The LSs of the two crankwires of the DCEs may be embedded into a dielectric column, as also described hereinabove.

Figure 20:
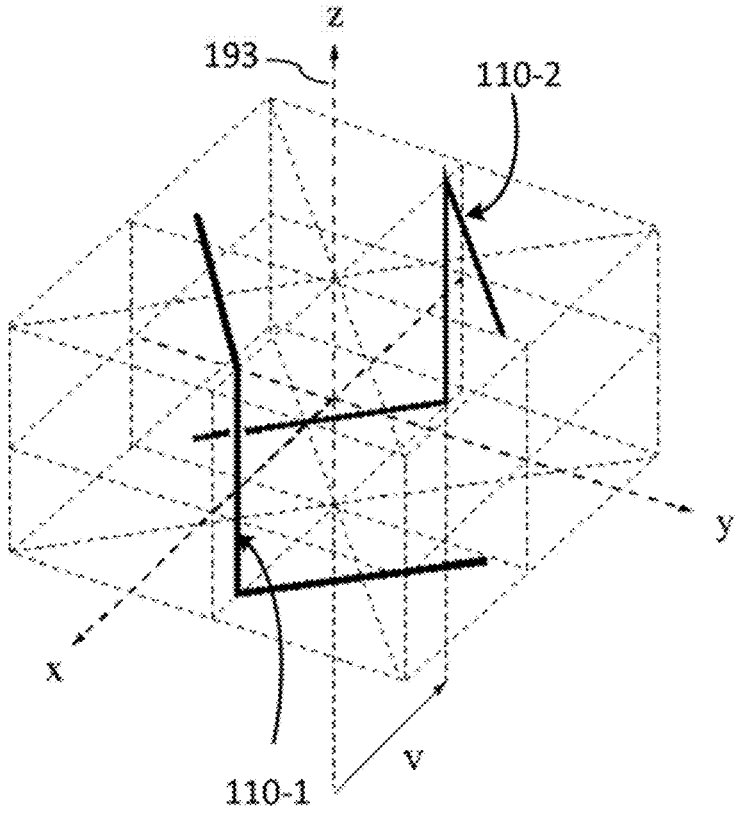
FIG. 20 is an isometric view of a DCE that corresponds to a 45 degree rotation of the crankwires illustrated in FIG. 4.

Note that the dashed lines in FIGS. 4, 19(A,B) showing a cube are for visual guidance only to assist in visual comprehension of the three-dimensional (3D) arrangement of the two crankwires within their respective DCE, and are not necessarily intended to identify a cell of a CPSS, which may differ from a cube or square. Similarly, the x- and y-axes in FIGS. 19(A) and 19(B) are assumed to be directed along the TSs of the DCE crankwires, and may or may not correspond to characteristic directions of a CPSS array. It will be appreciated that if one or both of the x- and y-axes are tied to a characteristic dimension of a CPSS cell, the crankwires 110-1,2 may be oriented with their TSs at any angle thereto. By way of example, FIG. 20 illustrates a DCE that is similar to that shown in FIG. 4, but oriented diagonally to the visualization cube, or rotated by 45 degrees relative to the Cartesian coordinate system (x,y,z).

A CPSS may be obtained by disposing a plurality of DCEs, for example of the type illustrated in FIGS. 4, 19(A), 19(B) and 20 or their modification, at nodes of a uniform or non-uniform 2D lattice. When a uniform 2D lattice is preferred for a CPSS, the 2D lattice may be in general any of the several regular lattices that are known to be possible in 2D. For example, a plurality of uniform 2D lattices may be constructed by superimposing, or interlacing, two identical rectangular lattices with an offset Boff. This is illustrated in FIG. 21, wherein a uniform 2D lattice is shown to be constructed from two rectangular lattices shown with hollow and solid circles, respectively, each having a vertical period A and a horizontal period B, with a vertical offset Aoff and a horizontal offset Boff between the two constituent interlaced lattices.

A variety of CPSS wherein the DCEs are arranged at nodes of 2D lattices may be obtained by selecting $A \neq B$, Aoff=A/2, Boff=B/2. By way of example, a square array CPSS in FIG. 22, and two triangular array CPSSs in FIGS. 23-24, with their two constituent interlaced Cartesian lattices having, respectively, B=A, $B=2A/\sqrt{3}$ and $B=A\sqrt{3}$, are described hereinbelow. In some embodiments, it will be appreciated that the use of non-square rectangular DCE arrays may in some cases be advantageous over the use of the square DCE array for conferring anisotropic CPSS performance in azimuth.

Figure 21:
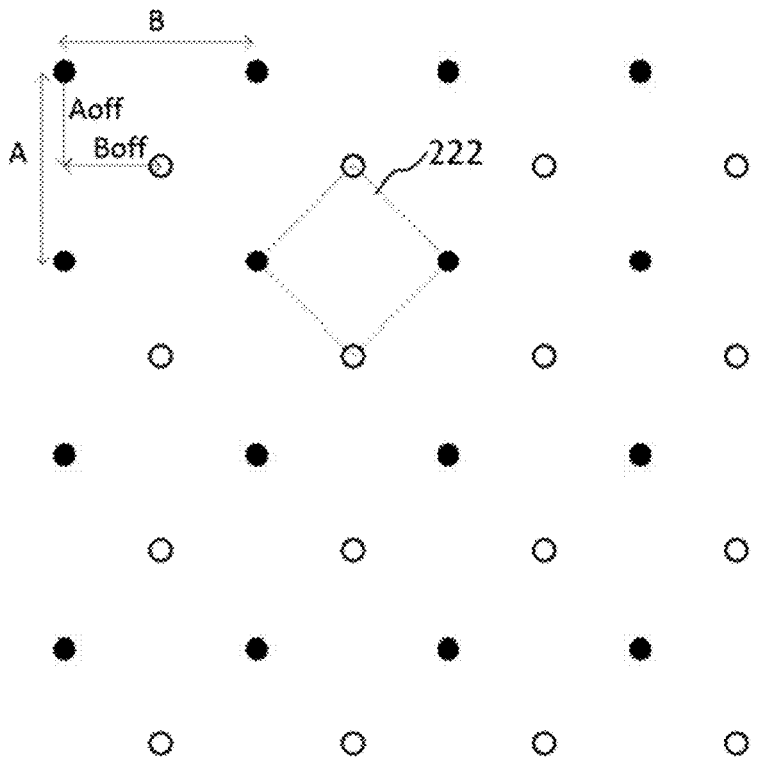
FIG. 21 is a schematic diagram illustrating a lattice that results from interlacing two identical Cartesian lattices with vertical period A, horizontal period B, vertical offset Aoff and horizontal offset Boff, the nodes of two constituent Cartesian lattices indicated by solid and hollow circles, respectively, and a characteristic cell of a corresponding array being indicated by the parallelogram in dashed line.
Figure 22:
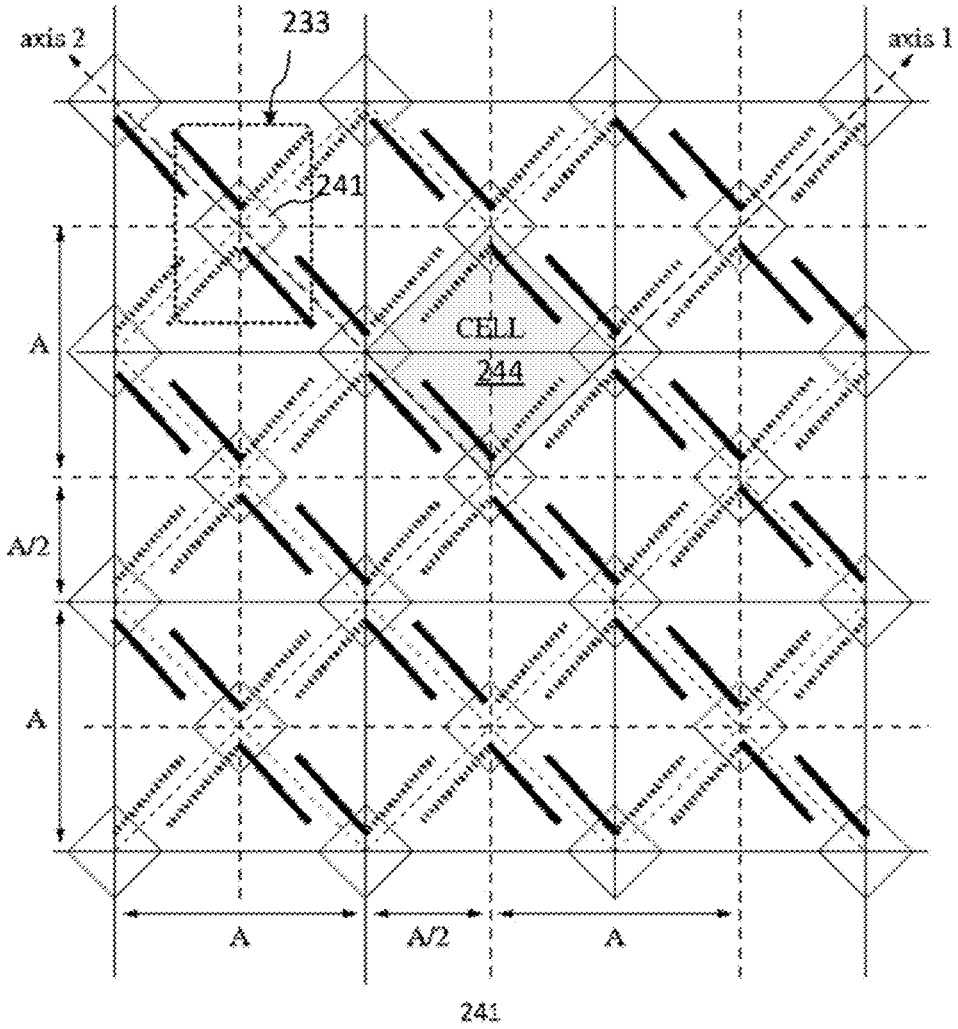
FIG. 22 is a schematic representation of a square-array CPSS that is composed of DCEs of the type illustrated in FIG. 19(B) that are disposed at the nodes of the lattice of FIG. 21 that is formed by two interlaced identical Cartesian lattices indicated with solid and dashed lines respectively, with B=A and Boff=0.5 Aoff.

Turning first to FIG. 22, there is illustrated a CPSS wherein a plurality of DCEs 233 of the type illustrated in FIG. 19(B) is disposed at the nodes of the 2D lattice illustrated in FIG. 21, resulting from the two constituent interlaced Cartesian lattices with A=B and Aoff=Boff=A/2. The 2D lattice of the DCE array may be viewed as formed of square cells having a side dimension of $A/\sqrt{2}$, one of which being indicated in the figure at 244, hence the lattice may be referred to as a square lattice even though it is rotated by 45 degrees. The LHCPSS is shown in a plan view, with the TSs on the top face thereof indicated by thick solid lines and the TSs on the bottom face indicated by thick dashed lines, with their intersections showing the locations of the LSs in the plane of the LHCPSS. The nodes of the two constituent interlaced lattices are indicated by intersections of thin solid and thin dashed lines forming two interlaced grids, respectively, with the 2-fold rotational symmetry axes of the DCEs located at the nodes. In the embodiment illustrated in FIG. 22, the crankwires in each DCE are oriented with their TSs directed at a 45 degree angle to the thin solid and the thin dashed lines connecting the nodes of the two constituent interlaced Cartesian lattices and at a 0 degree angle to the edges of the cell 244 of the square lattice. The gap G is the same at both faces of the CPSS. In one embodiment, the two LSs of each DCE may be positioned suitably close to each other so as to form a TL as described hereinabove. Each TL comprises a dielectric material represented in the figure as a square 241 rotated by 45 degrees, in which are embedded the two LSs of the DCE, as also described hereinabove. The lattice period A may be selected so that the TSs of two crankwires from two nearest adjacent DCEs extend alongside each other for at least a length portion P of the TS length L, with a gap G therebetween, wherein the ratio P/G is preferably at least 0.5, and in some embodiments preferably at least 1.

The CPSS of FIG. 22 may be viewed as that illustrated in FIG. 5, but rotated at 45 degrees in the plane of the figure. As mentioned hereinabove, when the type of endwise EM coupling is the side-to-side EM coupling, the length L of the TSs and the overlap length P can be chosen independently of one another by adjusting the period S of the square-cell lattice, according to the relation S=(2L−P−U). Hence, both L and P can be chosen independently of the gap G for a square array CPSS. However, this may not always be possible for a lattice that results from the use of $A \neq B$ for its two constituent interlaced Cartesian lattices, where the choice of the gap G may determine the array period S, as shown hereinbelow.

Figure 23:
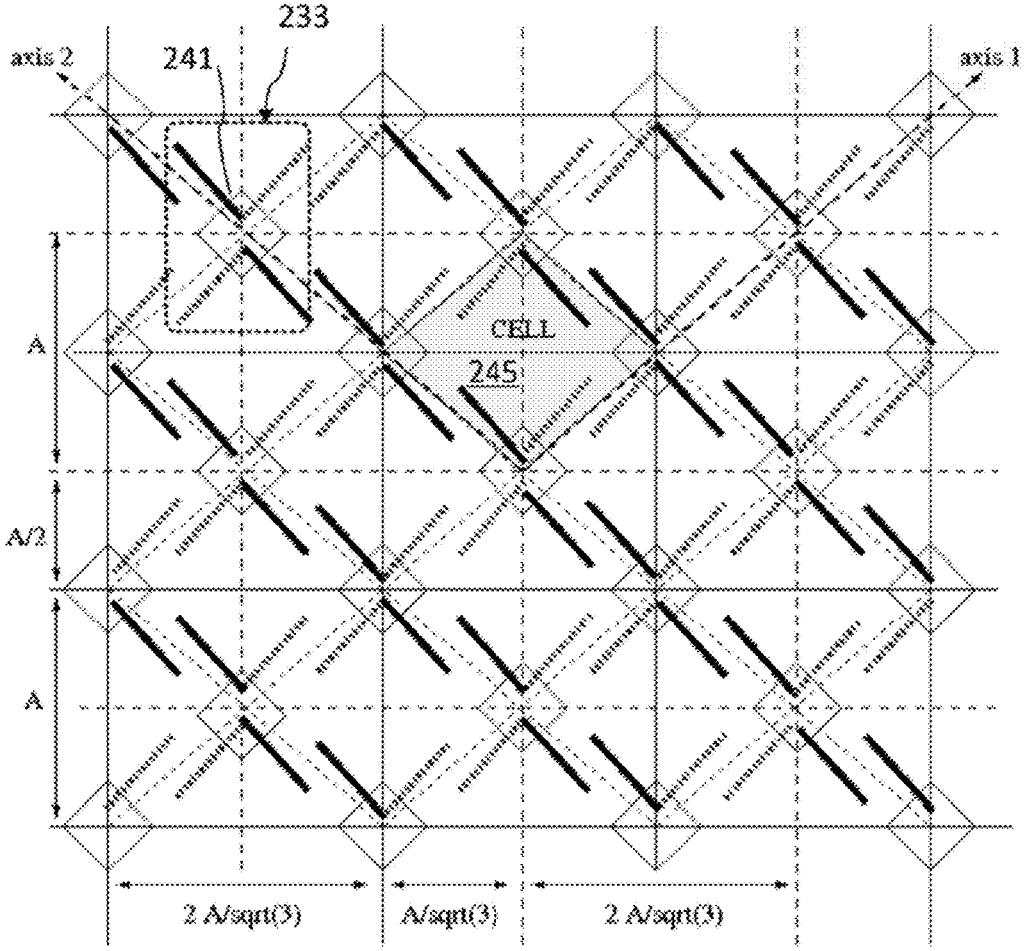
FIG. 23 is a schematic representation of a triangular-array CPSS that is composed of DCEs of the type illustrated in FIG. 19(B) that are disposed at the nodes of the lattice of FIG. 21 that is formed by two identical interlaced Cartesian lattices shown in solid or dashed lines, with B=2A/√3 and Boff=0.5 Aoff.

Turning now to FIG. 23, there is illustrated a CPSS wherein a plurality of DCEs 233 of the type illustrated in FIG. 19(B) are disposed at the nodes of the 2D lattice of the type illustrated in FIG. 21, resulting from the two constituent interlaced Cartesian lattices with $B=2A/\sqrt{3}$ and Aoff=Boff=A/2. The 2D lattice that results from the use of the two constituent interlaced Cartesian lattices may be viewed as formed of unit cells in the shape of a parallelogram, one of which being indicated in the figure at 245. The parallelogram-shaped cell 245 may be viewed as formed of two isosceles triangles joined at their bases, hence the lattice may be referred to as an isosceles triangular lattice or as a distorted triangular lattice. The LHCPSS is shown in a plan view, with the TSs on the top face thereof indicated by thick solid lines and the TSs on the bottom face indicated by thick dashed lines, with their intersections showing the locations of the LSs in the plane of the LHCPSS. The nodes of the two constituent interlaced Cartesian lattices are indicated by intersections of thin solid and thin dashed lines forming two interlaced grids, respectively, with the 2-fold rotational symmetry axes of the DCEs located at the nodes. In one embodiment, the two LSs of each DCE may be positioned suitably close to each other so as to form a TL as described hereinabove. Each TL comprises a dielectric material represented as a square 241 rotated by 45 degrees, in which are embedded the two LSs of the DCE 233, as also described hereinabove. In some embodiments the array period A may be selected so that the TSs of two crankwires from two nearest adjacent DCEs extend alongside each other for at least a length portion P of the TS length L, with a gap G therebetween, wherein the ratio P/G is preferably at least 0.5, and in some embodiments preferably at least 1. In the illustrated embodiment, the crankwires in each DCE are oriented with their TSs directed at a 45 degree angle to the solid and the dashed lines connecting the nodes of the two constituent interlaced Cartesian lattices and at an approximate 4 degree angle to the edges of the cell of the distorted triangular lattice so that the gap G is the same at both faces of the CPSS. The use of the distorted triangular lattice may be advantageous over the use of an equilateral triangular lattice for conferring anisotropic CPSS performance in azimuth. It will be appreciated that the angular value of 4 degrees is an approximate value which does not take into account fabrication tolerances.

Figure 24:
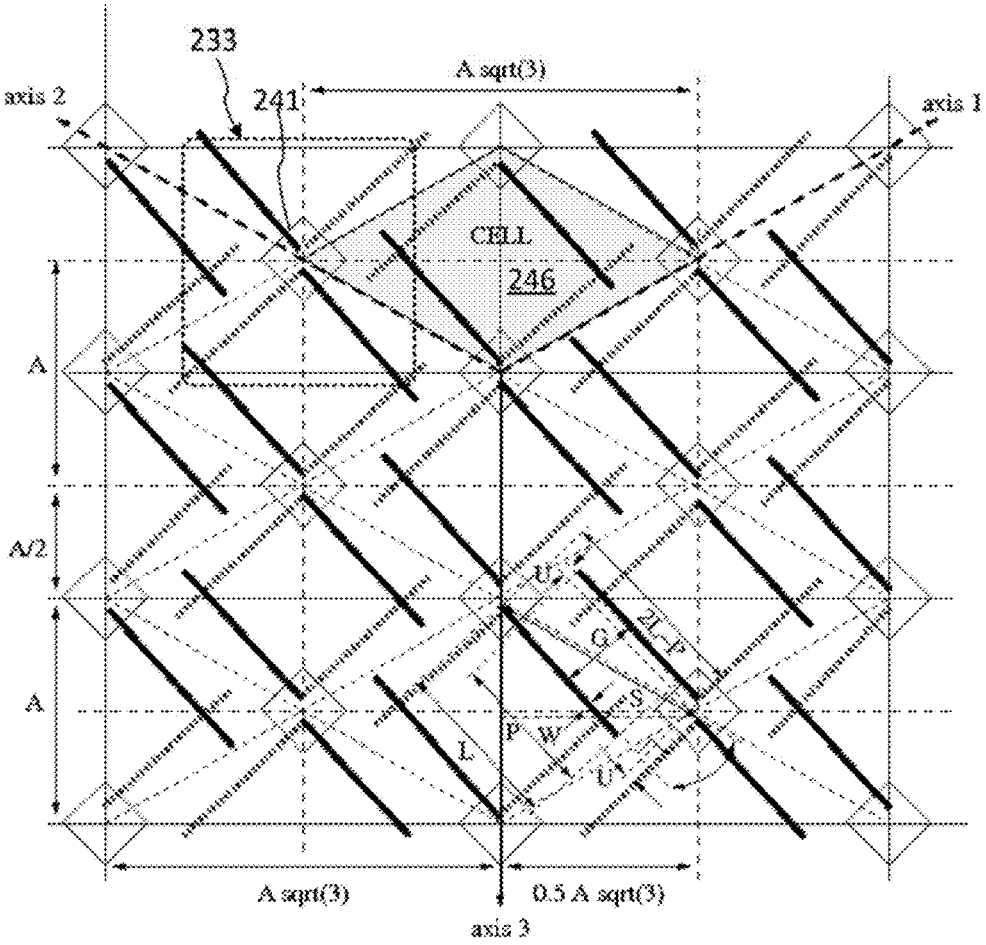
FIG. 24 is a schematic representation of a CPSS formed with a first equilateral triangular DCE array that is composed of DCEs of the type illustrated in FIG. 19(B) that are disposed at the nodes of the lattice of FIG. 21 that is formed by two identical interlaced Cartesian lattices shown in solid or dashed lines, with B=A √3 and Boff=0.5 Aoff.

Turning now to FIG. 24, there is illustrated a CPSS wherein a plurality of DCEs 233 of the type illustrated in FIG. 19(B) are disposed at the nodes of the 2D lattice illustrated in FIG. 21 resulting from the two constituent interlaced Cartesian lattices with B=A√3 and Aoff=Buff=A/2. The 2D lattice may be viewed as formed of unit cells is in the shape of a parallelogram, one of which being indicated in the figure at 246. The parallelogram-shaped cell 246 may be viewed as formed by two equilateral triangles joined at one side, or as a rhombus with a side S=A, hence the lattice may be referred to as an equilateral triangular lattice or as an exact triangular lattice. The LHCPSS is shown in a plan view, with the TSs on the top face thereof indicated by thick solid lines and the TSs on the bottom face indicated by thick dashed lines forming two interlaced grids, with their intersections showing the locations of the longitudinal segments in the plane of the LHCPSS. The nodes of the two constituent interlaced Cartesian lattices are indicated by intersections of the thin solid and thin dashed lines forming two interlaced grids, respectively, with the 2-fold rotational symmetry axes of the DCEs located at the nodes. In one embodiment, the two LSs of each DCE may be positioned suitably close to each other so as to form a TL as described hereinabove. Each TL comprises a dielectric material represented as a square 241 rotated by 45 degrees, in which are embedded the two LSs of the DCE, as also described hereinabove. In some embodiments the array period A may be selected so that the TSs of two crankwires from two nearest adjacent DCEs extend alongside each other for at least a length portion P of the TS length L, with a gap G therebetween. The ratio P/G is preferably at least 0.5, and in some embodiments preferably at least 1. In the illustrated embodiment, the crankwires in each DCE are oriented with their TSs directed at a 45 degree angle to the thin solid and thin dashed lines connecting the nodes of the two constituent interlaced Cartesian lattices and at a α=15 degree angle to the edges of the cell of the exact triangular lattice so that the gap G is the same at both faces of the CPSS. The following relationship between the gap G, the overlap length P, and the length L holds:

$$\tan(\alpha) = \frac{G - U}{2L - P + U}$$

and $$G = S \cdot \sin(\alpha) + U$$

where S=A is the period of the equilateral triangular lattice of the shown DCE array, U is the offset distance between closest edges of two parallel TSs in a DCE measured in a direction that is normal to the TSs, and α=15 degrees is the angle between a TS and an edge of the cell of the exact triangular lattice. Thus, for the equilateral triangular array CPSS illustrated in FIG. 24, selecting a particular value for the gap G determines, for a given U, the value of the array period S and the end-to-end length (2L−P) of the pairs of capacitively EM coupled TSs. In embodiments wherein the CPSS parameters such as S, L, P, and G are determined as a result of a CPSS optimization process wherein CPSS performance parameters are optimized, the initial value of L in the process of CPSS optimization may be selected to be substantially equal to a quarter-wavelength, the initial value of P is then determined by the values of (2L−P) and L. However, the final values for S, L, P, and G may be determined by the optimization of the CPSS performance. It will be appreciated that in a manufactured CPSS the angle α may deviate from 15 degrees across the CPSS due to fabrication tolerances.

Turning now to FIG. 25, there is illustrated a CPSS wherein a plurality of DCEs 233 of the type illustrated in FIG. 19(B) are disposed at the nodes of the same 2D equilateral triangular lattice as that in FIG. 24, but with the DCEs 233 in FIG. 25 rotated by 90 degrees about their longitudinal axes of symmetry with respect to the DCEs in FIG. 24. This DCE orientation provides a smaller value of the gap G between the EM coupled TSs of adjacent DCEs, and thus enhances the EM coupling for the same array period S. The following relationship between the gap G, the overlap length P, and the length L holds for the DCE array of FIG. 25:

$$\tan(\alpha) = \frac{G + U + 2W}{2L - P + U}$$

and $$G = S \cdot \sin(\alpha) - U - 2W$$

where W is the width of the TSs. Selecting a particular value for the gap G determines, for given DCE parameters U and W, the value of the array period S and the end-to-end length (2L−P) of the pairs of capacitively EM coupled TSs. In embodiments wherein CPSS parameters such as S, L, P, and G are determined as a result of a CPSS optimization process wherein CPSS performance parameters are optimized, the initial value of L in the process of CPSS optimization may be selected to be substantially equal to a quarter-wavelength, the initial value of P is then determined by the values of (2L−P) and L. However, the final values for S, L, P, and G may be determined by the optimization of the CPSS performance. In embodiments with in-line dipoles replacing the offset dipoles, in the relations hereinabove for equilateral triangular DCE arrays of FIG. 25, W should be replaced by 0.5(W−U) which mathematically results in (U+2 W) being replaced by Win the numerator of the first expression, and in (−U−2 W) being replaced by −W in the second expression.

An advantage of using a triangular lattice such as that illustrated in FIGS. 24 and 25 over using a square lattice of FIGS. 5 and 22 is that the triangular lattice provides a denser and a more rotationally uniform arrangement of the array elements, i.e. the DCEs and, ultimately, of the crankwires, for a same value of the gap G between the capacitively EM coupled TSs of the crankwires in adjacent DCEs.

Introducing defects in the CPSS array by modifying or eliminating the CPSS elements at some nodes may permit to modify the operation of the CPSS so as to confer it new capabilities. Similarly, using two different CPSS elements at the nodes of the two interlaced Cartesian lattices or eliminating the CPSS elements of one of the two interlaced Cartesian lattices may permit to modify the operation of the CPSS so as to confer it new CPSS capabilities. For instance, eliminating the CPSS elements of one of the two interlaced Cartesian arrays in FIGS. 22-25 may permit to form a CPSS array with overlap to gap ratio P/G approximately equal to 1. Eliminating one of the two interlaced Cartesian lattices, however, increases the period S of the resulting lattice. For instance in FIG. 22, eliminating one of the two interlaced Cartesian lattices make the resulting array go from a 45 degree rotated square array with a period $S=A/\sqrt{2}$ to a non-rotated square array with period S=A thereby increasing the period S by a factor $\sqrt{2}$.

Despite the overlap length P being no longer a parameter that may be varied independently of the length L and the gap G or the period S in the triangular arrays of FIGS. 24-25, the amount of the capacitive EM coupling between TSs can still be varied by shaping the profiles of the TSs. For example making the TSs serrated or meandered along the length of the overlap as illustrated in FIGS. 26-30 enables to adjust an effective EM coupling length. Varying the alignment of the serrations or meanders of one TS in relation to those of the other TS also enables to vary the amount of EM coupling between the TSs, and to achieve a desired amount of such coupling, even when the overlap length P along the TS direction by itself cannot be varied in a desired range. In the embodiments using serrated TSs, the serrations can be either one-sided or two-sided. It will be appreciated that a serration or a meandering of the TSs along the coupling length may be used in embodiments with either side-to-side or end-to-end coupling of the TSs, as illustrated in FIGS. 10 (*a*)-(*c*).

Figure 26:
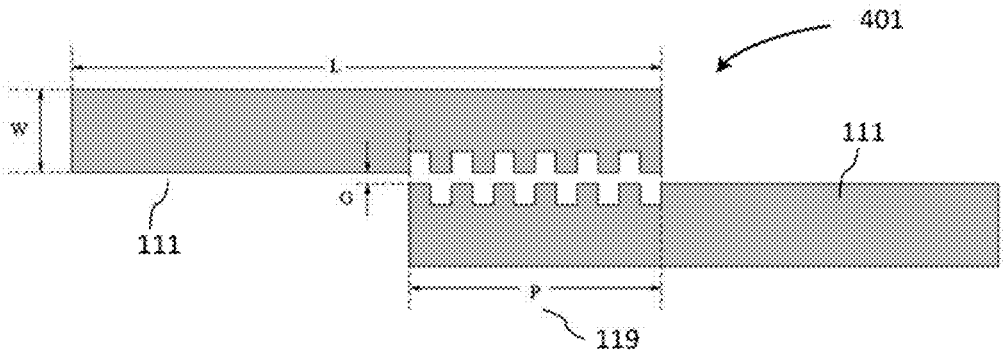
FIG. 26 is a schematic representation of two EM coupled transverse segments that are serrated over a part of their EM coupled edges, with the serrations in counter-phase.

FIG. 26 illustrates two capacitively EM coupled TS 111 of length L and width W that extend alongside each other along an overlap length P 119, forming a coupled TS pair 401. Proximate edges of the TSs 111 of the TS pair 401 are serrated along the overlap length P 119, with the serrations misaligned so as to further reduce the capacitive EM coupling between the TSs 111. FIG. 26 illustrates an example case of one-sided serrations whereby the serrations are applied to only one of the two edges of a TS.

Figure 27:
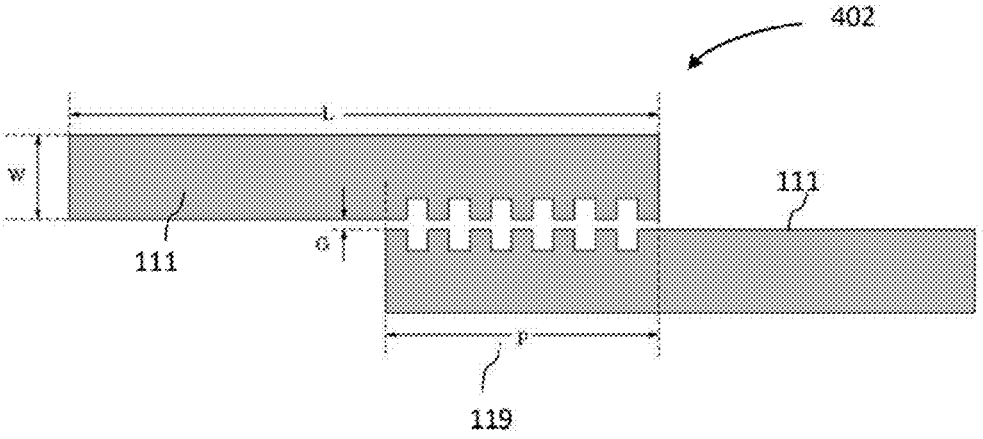
FIG. 27 is a schematic representation of two EM coupled transverse segments that are serrated over a part of their EM coupled edges, with the serrations being in-phase.

FIG. 27 illustrates two capacitively EM coupled TS 111 of length L and width W that extend alongside each other along an overlap length P 119, forming a coupled TS pair 402. Proximate edges of the TSs 111 of the TS pair 402 are serrated along the overlap length P 119, with the serrations aligned so as to somewhat increase the capacitive EM coupling between the TSs 111 as compared to that provided in the arrangement of FIG. 25.

It will be appreciated that the opposite sides of the TSs 111 in FIG. 26 and FIG. 27 may also be serrated in some embodiments and that the alignment between the serrations of coupled TSs can be at any intermediate value between the two extreme cases of being fully misaligned as in FIG. 26 and being fully aligned as in FIG. 27, so as to obtain the desired amount of EM coupling between the two TSs.

Figure 28:
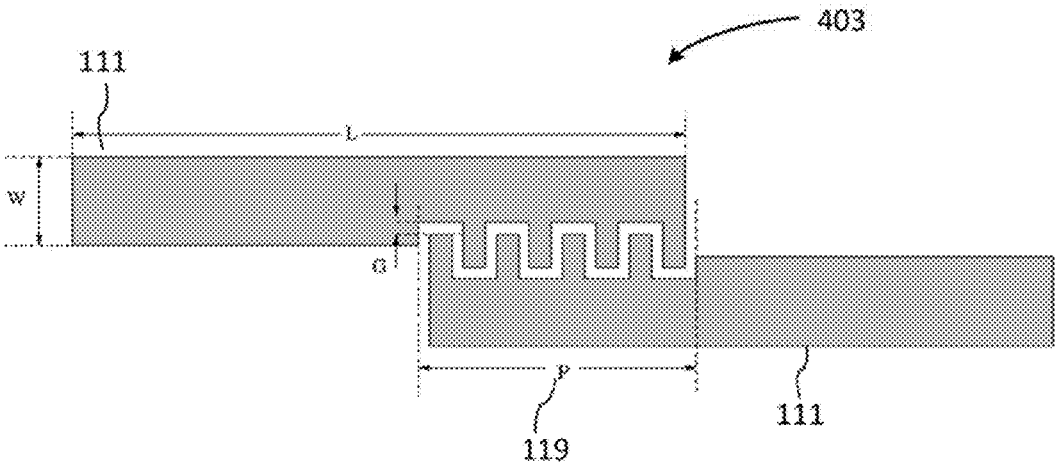
FIG. 28 is a schematic representation of two EM coupled transverse segments that are serrated over a part of their EM coupled edges, with the serrations forming a meandering gap.

FIG. 28 illustrates two capacitively EM coupled TS 111 of length L and width W that extend alongside each other along an overlap length P 119, forming a coupled TS pair 403. Proximate edges of the TSs 111 of the TS pair 401 are serrated along the overlap length P 119 in a complementary manner, so as to provide a meandering gap with an effective EM coupling length that is greater than the overlap length P, so as to obtain the desired amount of EM coupling between the two TSs.

Figure 29:
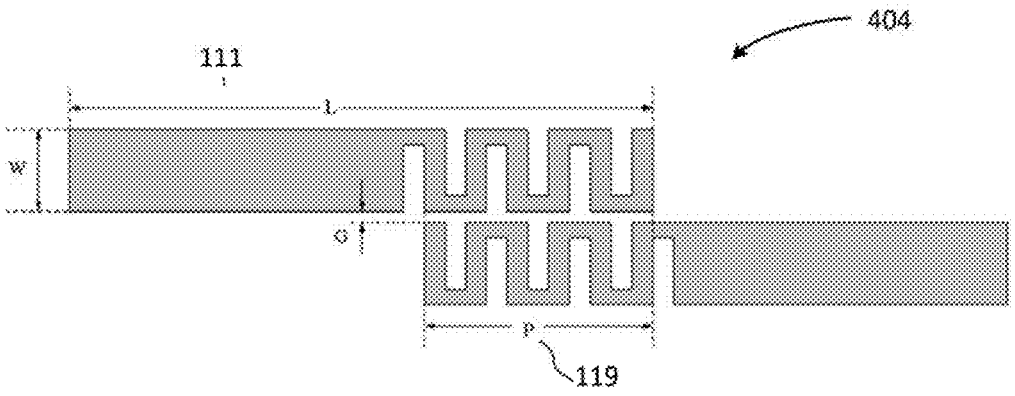
FIG. 29 is a schematic representation of two EM coupled transverse segments that are meandered over a part of their EM coupling length, with the meandering being in counter-phase.
Figure 30:
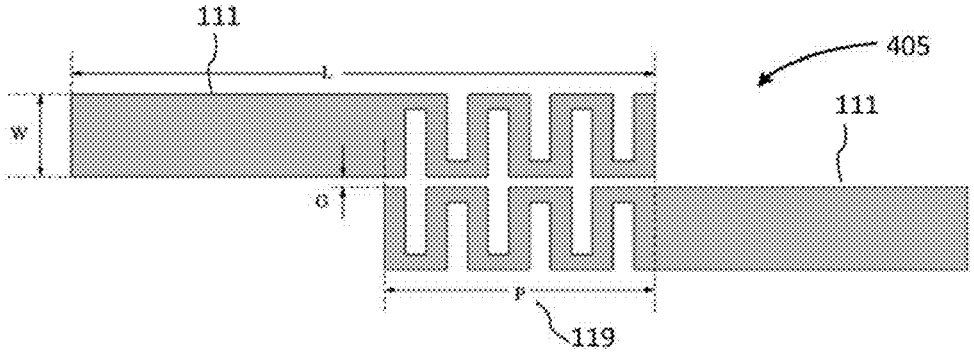
FIG. 30 is a schematic representation of two EM coupled transverse segments that are meandered over a part of their EM coupling length, with the meandering being in-phase.

FIG. 29 and FIG. 30 illustrate EM coupled TS pair embodiments 404 and 405 wherein the TSs 111 are shaped as a meander along at least a portion of the overlap length P, with the meanders being fully misaligned (FIG. 29) or fully aligned (FIG. 30) or in any intermediate value so as to obtain the desired amount of EM coupling between the two TSs. It will be appreciated that the capacitive EM coupling between the TSs 111 may be somewhat stronger in the embodiment of FIG. 30 than that in FIG. 29 for the same values of P, L, G, and W, and the same depth and period of the meander.

Similar to the CPSS described hereinabove with reference to FIGS. 5, 9, and 12-14, CPSSs illustrated in FIGS. 22-25 may be implemented using a dielectric substrate, with the TSs defined by metal strips attached at opposing faces of the substrate, and the LSs defined by metallized via-holes through the substrate. In some embodiments, the substrate may be thinned in the middle of the cells in areas absent of the TSs. The substrate may also be formed by two intersecting sets of dielectric beams supporting the TSs that are connected by dielectric columns wherein the longitudinal TLs are defined, generally as described hereinabove with reference to FIGS. 12-14. It will be appreciated, however, that the cross-section profile of the longitudinal dielectric columns may be different than square. The choices of the profile and of the dimensions of the cross-section affect the value of the large-scale effective permittivity for the CPSS substrate and the value of the small-scale effective permittivity for the TL. The process of optimizing the CPSS performance may include the process of varying the profile and the dimensions of the cross-sections of the dielectric columns, and CPSS embodiments with the dielectric columns of non-rectangular cross-sections are within the scope of the present disclosure.

Figure 31:
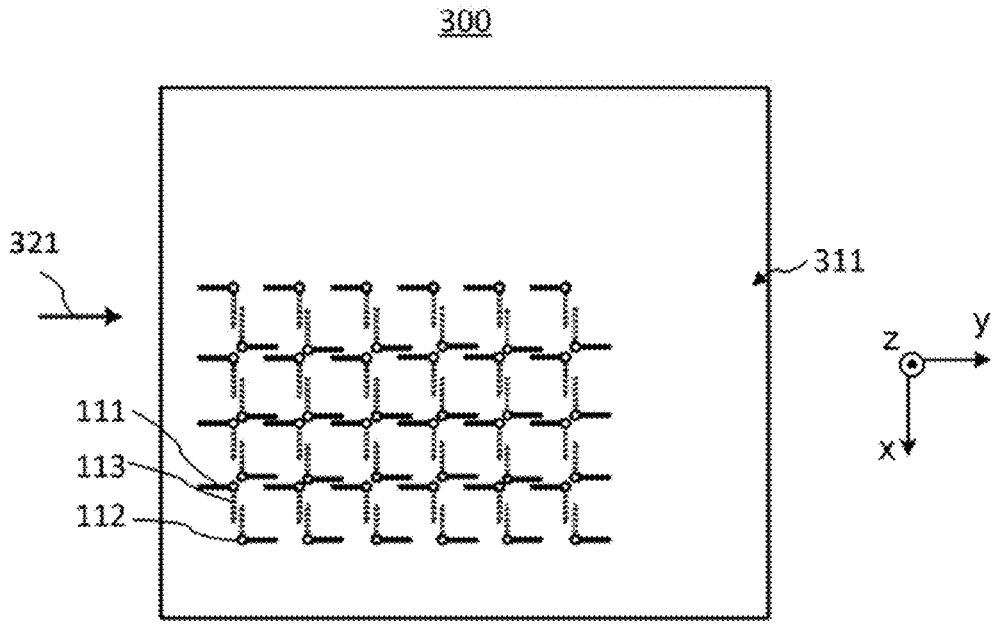
FIG. 31(A) is a schematic top view of a corrugated substrate composed of two thin dielectric sheets sandwiching the longitudinal dielectric columns and supporting the TSs of the crankwires of a CPSS array with a view of a portion of the array.
FIG. 31(B) is a schematic side view of FIG. 31(A)
FIG. 31(C) is a schematic side view of a DCE comprising two longitudinal segments embedded in a longitudinal dielectric column for forming a longitudinal transmission line, and two thin dielectric sheets supporting the transverse segments.
FIG. 31(D) is a side view of the corrugated substrate showing additional layers at the top and bottom of the CPSS of FIG. 31(A) for wave-impedance matching.
Figure 31:
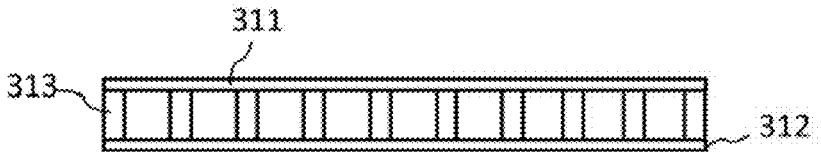
Figure 31:
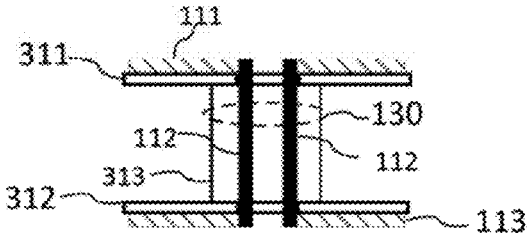
Figure 31:
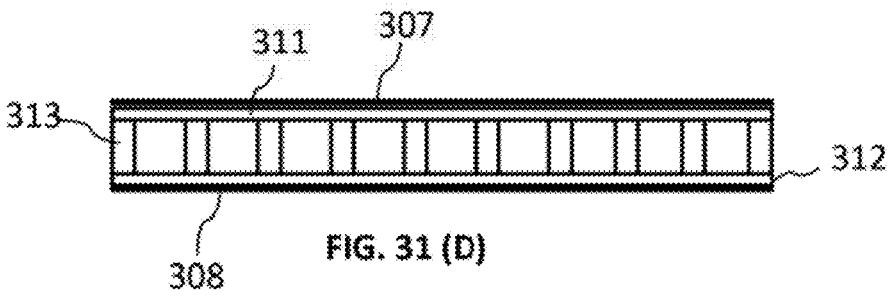
Figure 32:
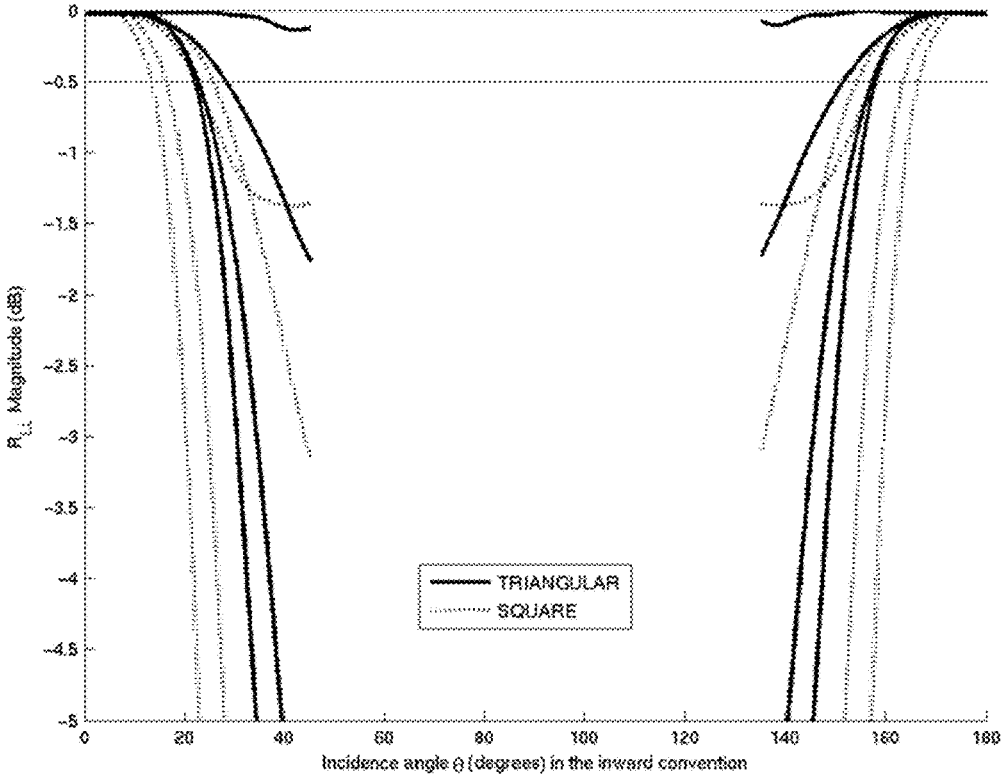
FIG. 32 is a graph that shows a comparison between the simulation results for the magnitude of a CPSS reflection coefficient $R_{LL}$ for the triangular-array CPSS of FIG. 25 in solid lines and for the square-array CPSS in dashed lines, both CPSS having been optimized in performance by varying the values of L, P, and S without wave-impedance matching layers.
Figure 33:
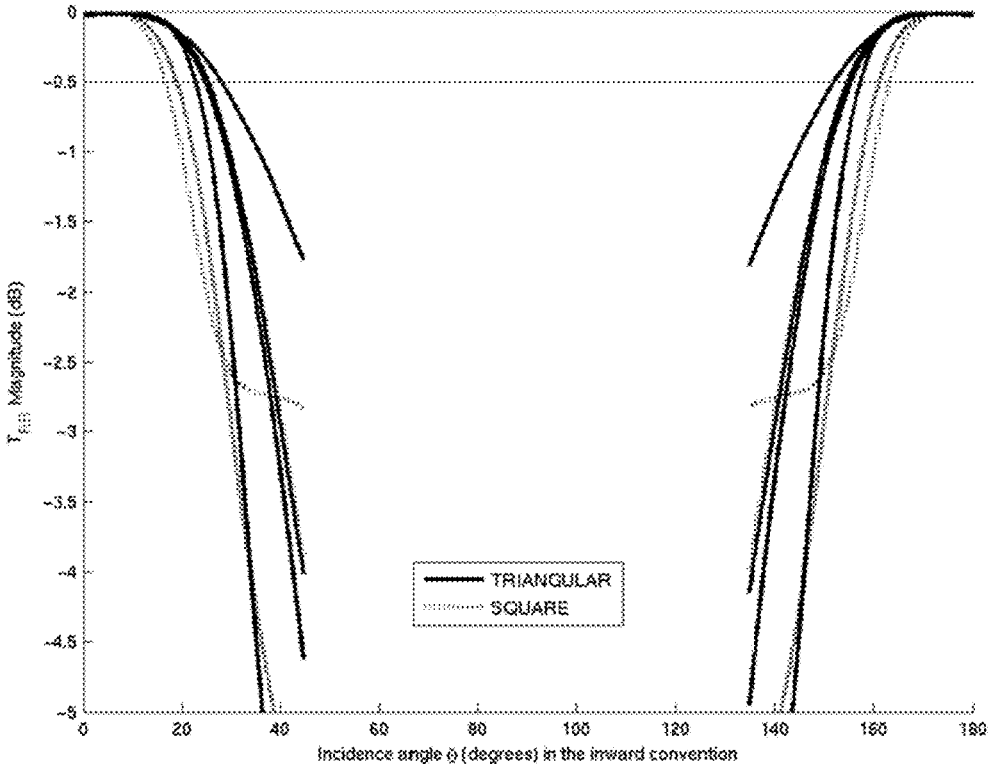
FIG. 33 is a graph that shows a comparison between the simulation results for the magnitude of a CPSS transmission coefficient $T_{RR}$ for the triangular-array CPSS of FIG. 25 in solid lines and those for the square-array CPSS in dashed lines, both CPSS having been optimized in performance by varying the values of L, P and S without wave-impedance matching layers.

Referring to FIGS. 31(A)-31(C), in one embodiment the substrate may be in the form of two thin sheets of dielectric material 311 and 312, each supporting a set of TSs 111 or 113 that lie in the same plane as illustrated in FIG. 31(A), with the sheets 311 and 312 connected by dielectric columns 313 wherein adjacent LSs 112 connecting TSs 111 and 113 are embedded. FIG. 31(B) illustrates a side view of the CPSS in the direction indicated by the arrow 321 in FIG. 31(A), while FIG. 31(C) shows a zoomed-in view of one DCE with the two LS 112 forming a TL 130 embedded in a dielectric column 313. Although FIG. 31(A), which shows a plan view of the CPSS, illustrates the use of a square lattice, it will be appreciated that the DCEs may also be located at the nodes of a triangular lattice such as those illustrated in FIGS. 23, 24 and 25. It will also be appreciated that the dielectric material of the thin dielectric sheets may be different than that of the longitudinal dielectric columns, and the CPSS substrate may be described as a composite substrate.

With reference to FIG. 31(C), in one embodiment wave-impedance matching layers 307 and 308 may be added at the two faces of the CPSS in order to minimize wave reflections off the CPSS, as illustrated in FIG. 31(D). These spurious wave reflections may be caused by the presence of the thin dielectric sheets 311, 312 or the fact that the large-scale effective permittivity of the CPSS substrate is different from that of the surrounding propagation medium (usually air or vacuum). Consequently, the CP sense of these spurious reflections may be opposite to that of the incident CP wave and may contribute to the magnitude of the cross-polarized CP scattering coefficients. The design of the wave-impedance matching layers may be carried out according to RF filter designs based on the use of one or more sections of quarter-wave transformers. Possible embodiments include the maximally flat binomial filter and the equal-ripple Chebyshev filter. An air gap between the wave-matching layers and a face of the CPSS that may exist due to the finite thickness of the metallized traces on a face of the CPSS may be filled with a soft dielectric material that has a permittivity of any value between the permittivity value of the substrate that supports the TSs at the face of the CPSS and the permittivity value of the wave-impedance matching layer that is in contact with these TSs so as to mitigate the impedance discontinuity due to the air gap. By way of example, this soft dielectric material may be petroleum jelly like Vaseline that has a permittivity of about 2.2 or a bonding film such as by way of example Arlon CuClad6250 with $\varepsilon_r$=2.32 and loss tangent factor tan(δ)=0.0013. The permittivity value desired for a matching layer can be realized by drilling an array of small holes through the layer according to the concept whereby small inclusions (herein air tubes) of a different material (herein air) are incorporated in a host material (herein the bulk dielectric material of the layer) so as to achieve a desired volume ratio of the inclusion material to the host material, ratio that corresponds to the desired permittivity value. It will be appreciated that the presence of the wave-impedance matching system composed of one or more dielectric layers modifies the local effective permittivity in the vicinity of the TSs. Therefore, the optimization of the CPSS performance should preferably be carried out with the wave-impedance matching layers present.

FIGS. 32-35 illustrate results of computer simulations of optimized performance of an example LHCPSS of the type illustrated in FIG. 25 with thin continuous dielectric sheets as illustrated in FIG. 31(A) and FIG. 31(B) in comparison with the optimized performance of an example LHCPSS of the type illustrated in FIG. 5 or 9, with a corrugated dielectric substrate as illustrated in FIGS. 13-14. Simulations were performed using a Finite Difference Time Domain (FDTD) method of the scattered field formulation, using a uniform Yee lattice and a cubic Yee cell size of 240 micrometers (μm) on a side, and a frequency f=12 GHz. For both LHCPSSs, the following parameters were kept constant, measured in number of Yee cells: gap G=2 (i.e. 480 μm), CPSS thickness H=42 (i.e. 10.080 mm), width of the TSs W=4 (i.e. 960 μm), thickness of the dielectric sheets or beams underneath the TSs is 2 (i.e. 480 μm), dimensions of the square dielectric columns are 16 units (i.e. 3.840 mm) on the side, spacing U along the TSs between the LSs is 2 units (i.e. 480 μm), square cross-section of the LSs has a side length of 2 units (i.e. 480 μm). The relative value of the bulk permittivity for all dielectric material is 3. All conducting segments are modeled as Perfectly Electrical Conductors (PEC). The TSs are modeled as infinitely thin PEC strips.

Optimized parameters for the example LHCPSS with the exact triangular lattice in FIG. 25 was found to be slightly different from those for the example LHCPSS with the square lattice. The example optimized LHCPSS with the exact triangular lattice used a TS length L=25 units (i.e. 6.0 mm) and a period S=11.127 mm. Using the relations given hereinabove, the value of the overlap is obtained as P=7.22. Owing to the discretization of the simulation model using only integer numbers of Yee cells, the value of P in the simulation was either 7 or 8 according to the cumulative value of the round-off error at the position of each DCE in modeling the CPSS with integer numbers of Yee cells. Optimized parameters that were used for the example LHCPSS with the square lattice are as follows: a TS length L=23 units (i.e. 5.520 mm), an overlap length P=4 units (i.e. 960 μm), a period S=44 units (i.e. 10.560 mm).

Figure 34:
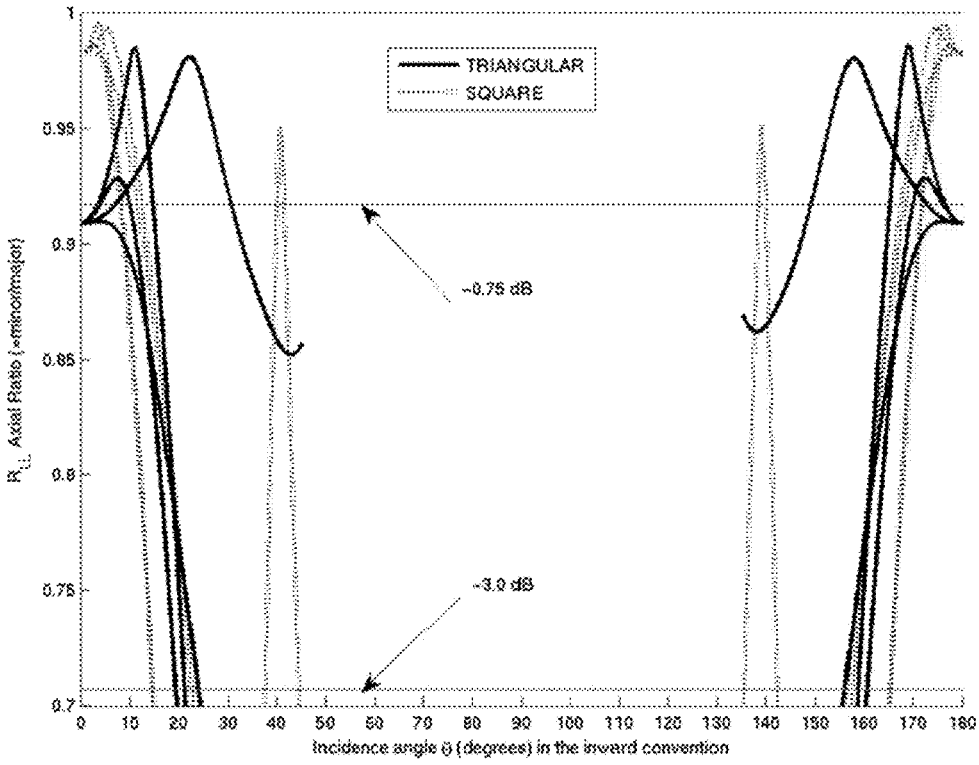
FIG. 34 is a graph that shows a comparison between the simulation results for the axial ratio (AR) of the CPSS reflection coefficient $R_{LL}$ for the triangular-array CPSS of FIG. 25 in solid lines and those for the square-array CPSS in dashed lines, both CPSS having been optimized in performance by varying the values of L, P and S without wave-impedance matching layers.
Figure 35:
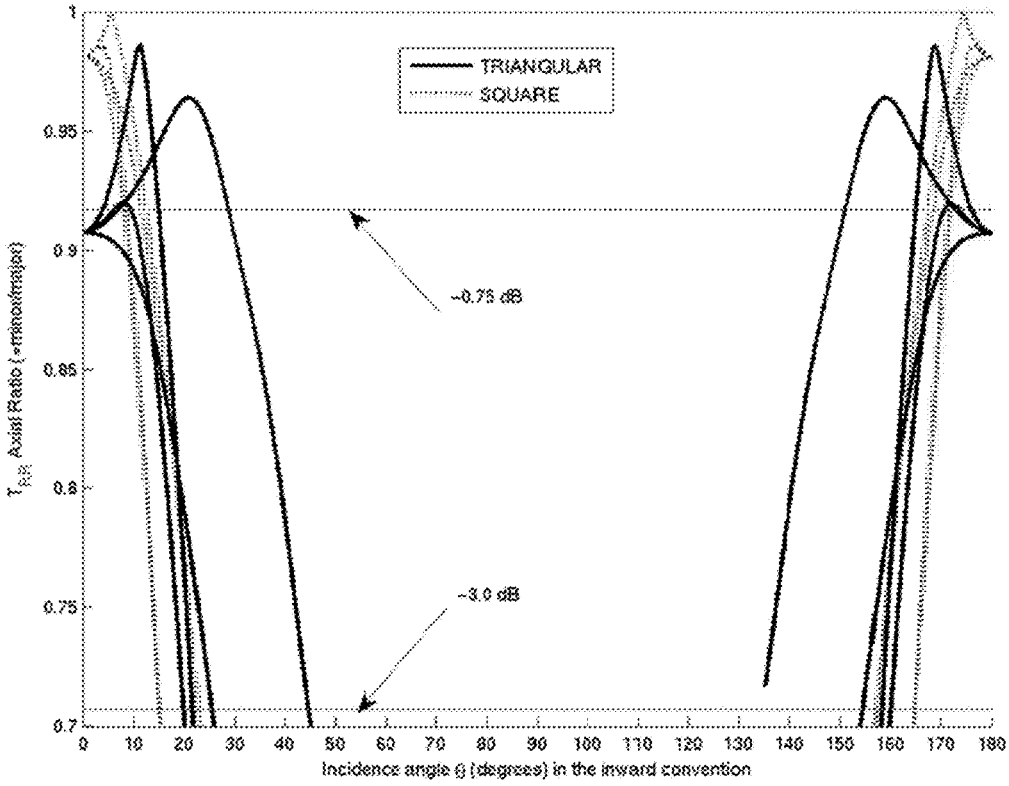
FIG. 35 is a graph that shows a comparison between the simulation results for the axial ratio (AR) of the CPSS transmission coefficient $T_{RR}$ for the triangular-array CPSS of FIG. 25 in solid lines and those for the square-array CPSS in dashed lines, both CPSS having been optimized in performance by varying the values of L, P and S without wave-impedance matching layers.

Presented with the inward convention, the plots of FIGS. 32-35 show a comparison between the magnitudes (in dB) of the CP reflection coefficient $R_{LL}$ (FIG. 32), and of the CP transmission coefficient $T_{RR}$ (FIG. 33) and their corresponding axial ratio (FIG. 34 for $R_{LL}$ and FIG. 35 for $T_{RR}$). Simulation results for the example LHCPSS with the square lattice are shown in dashed lines and for the example LHCPSSs with the exact triangular lattice in solid lines, over four different azimuthal cuts (180, 135, 90 and 45 degrees). The results for the four other azimuthal cuts φ=(0, 315, 270 and 225 degrees) would be the same as those for the azimuthal cuts φ=(180, 135, 90 and 45 degrees), respectively. The plots show that the LHCPSS using the exact triangular lattice provides a significantly better azimuthal uniformity of the LHCPSS response than the plots for the LHCPSS using the square lattice, as demonstrated by wider angular ranges for a same azimuthal cut φ and a same threshold value of −0.5 dB in magnitude in FIGS. 32-33, and for a same azimuthal cut φ and a same threshold value of −3.0 dB in axial ratio AR in FIGS. 34-35.

Connecting two adjacent longitudinal crankwire segments that form a half-wavelength long TL at mid-length points thereof with one or more microwave diodes enables selective electronic control of the CPSS operation of the pair of crankwires that include the TL, which may be effectively switched off by turning the diodes on with a forward-biasing voltage. The term 'microwave diode' relates here to a diode that provides substantially a short-circuit path when forward-biased, and an open-circuit path when reversed biased, to an electrical signal of the operating frequency of the CPSS. Generally, any electronically-controlled ON/OFF switch of suitable dimensions that operates as described may be used in place of the microwave diode. When the diodes are forward-biased, the diodes becomes substantially short-circuits regardless of the CP sense of the incident CP wave. This short-circuit at the mid-length point of the longitudinal half-wavelength TL transforms into virtual open-circuits at the two ends of the TL where the TSs of the two crankwires are connected. The presence of the virtual open-circuit between the two quarter-wavelength long TSs at each end of the TL prevents these quarter-wavelength segments from forming a half-wavelength resonant dipole and thus, their scattering response remains negligible thereby effectively creating a transparent zone to the incident CP wave at the site of the disabled pair of crankwires. If all pairs of crankwires are electronically disabled simultaneously, the whole CPSS becomes transparent to the incident CP wave regardless of the CP sense of the incident CP wave. The bias lines that provide the biasing to the diodes should preferably be thin resistive insulated lines so as to minimize the current induced on these resistive wires by the EM waves at the CPSS so as to minimize the scattering effect of these resistive lines.

Figure 36A:
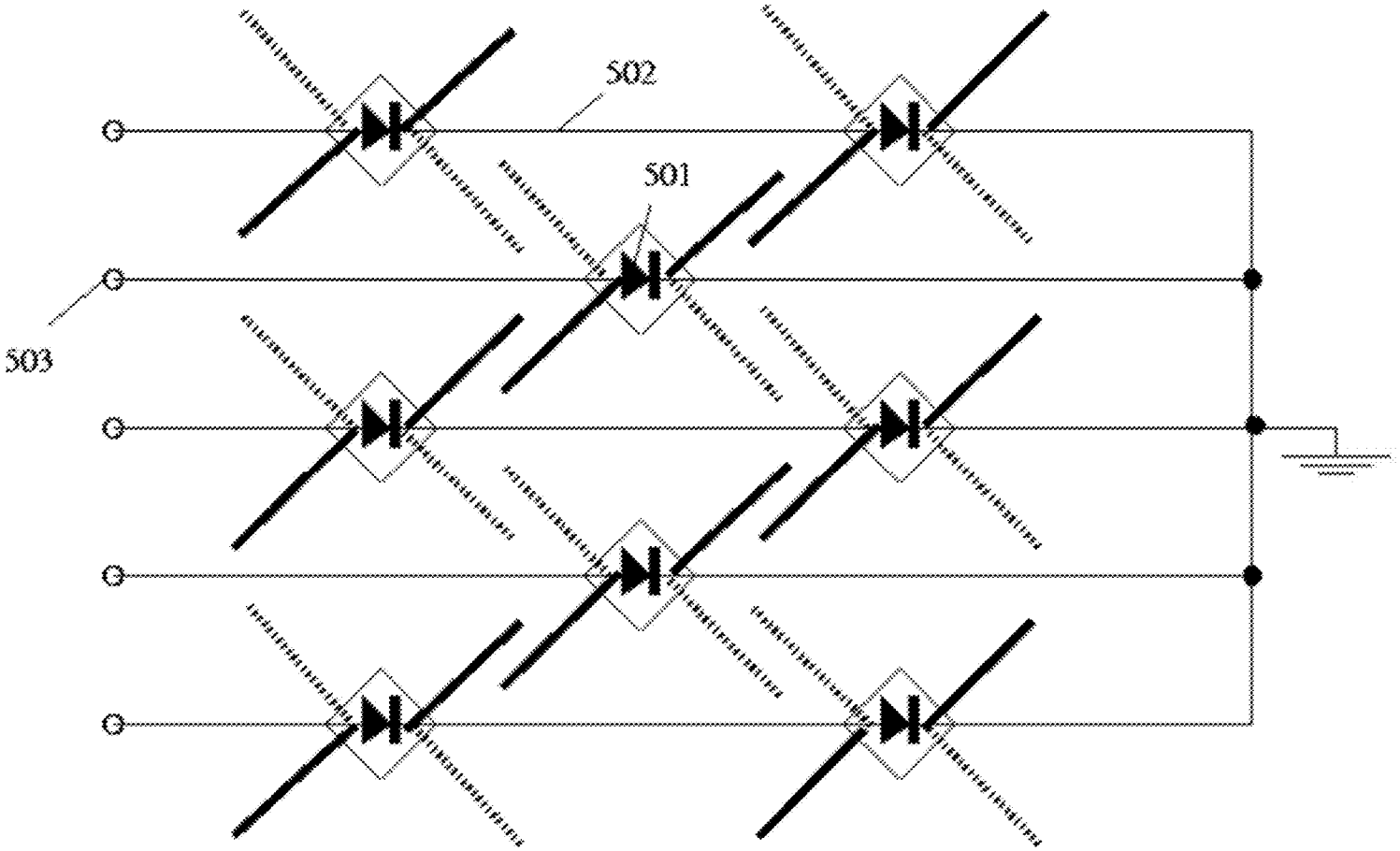
FIG. 36(A) is a schematic representation of the triangular-array LHCPSS of FIG. 25, with one microwave diode between the two longitudinal segments of each transmission line, wherein the diodes are biased in groups corresponding to the rows of the array.
Figure 36B:
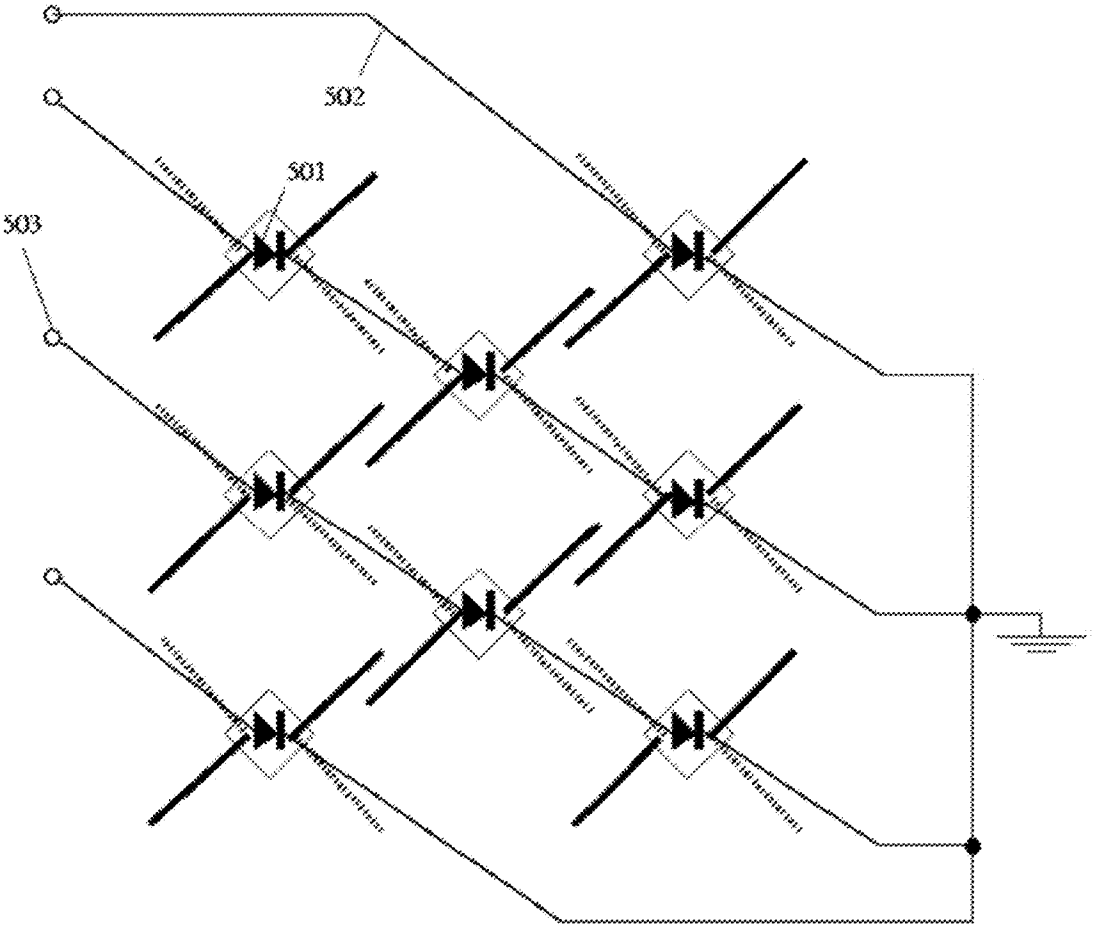
FIG. 36(B) is a schematic representation of the triangular-array LHCPSS of FIG. 25, with one microwave diode between the two longitudinal segments of each transmission line, wherein the diodes are biased in groups corresponding to diagonals of the array.

FIG. 36(A) and FIG. 36(B) show two different example arrangements of bias lines 502 for biasing one or more diodes 501 connected between the two LSs of each pair of crankwires. In operation the bias lines may be fed with a voltage or a current at the terminals 503, each bias line being selectively fed with a desired electrical signal so as to provide the desired geometry of the active zone of CPSS operation. Other arrangements of the bias lines may also be possible or desirable.

Figure 36C:
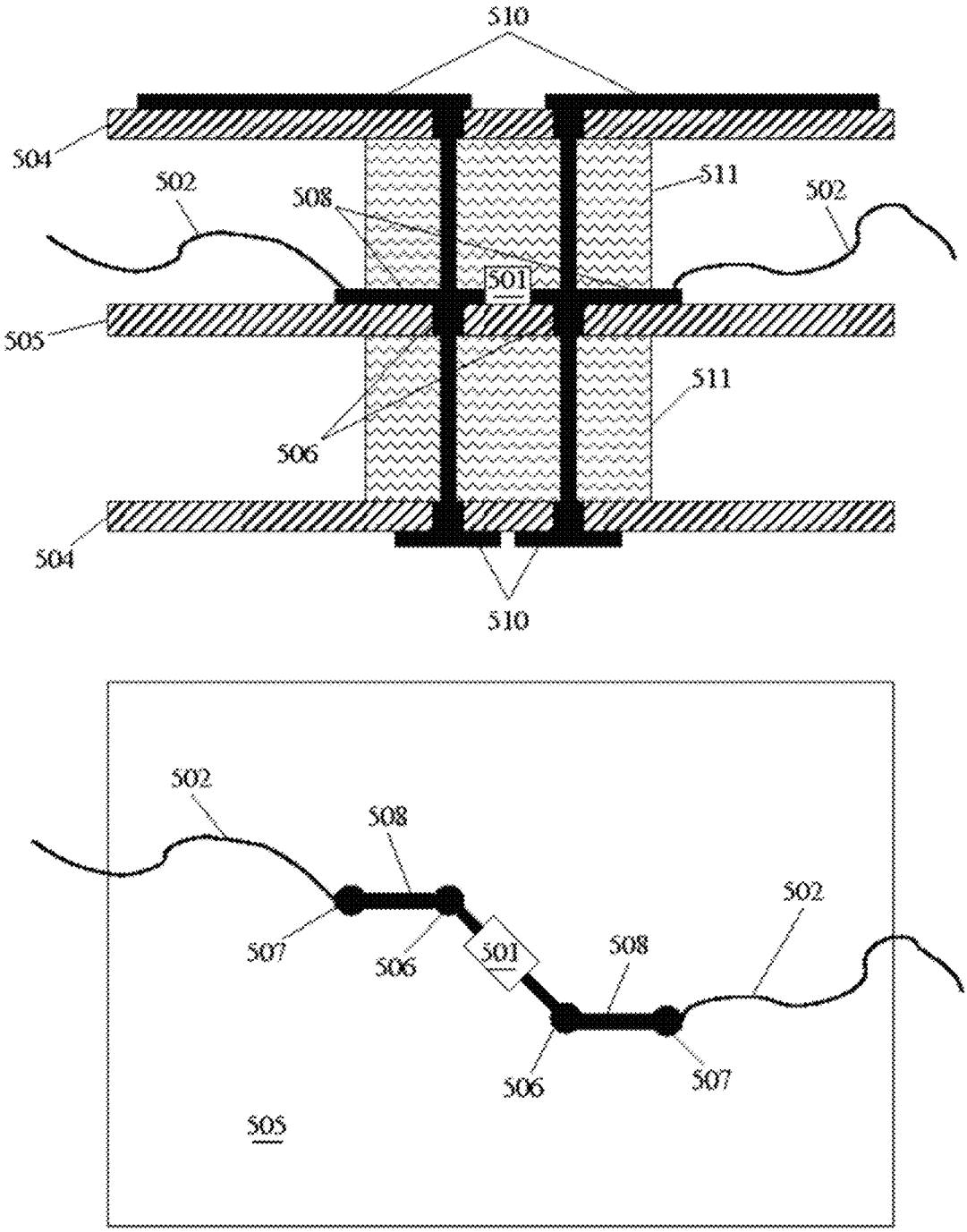
FIG. 36(C) is a schematic diagram showing a side view of a pair of crankwires with adjacent longitudinal segments (top panel) and a top view of an internal mid-layer (lower panel) that supports a microwave diode connected between the two longitudinal segments of the pair of crankwires.

The top panel in FIG. 36(C) shows a schematic side view of an example pair of crankwires with a surface-mounted microwave diode 501 connected to the longitudinal TL at its mid-length point with metallized via-holes 506. The bottom panel in FIG. 36(C) shows a top view of an internal mid-layer 505 supporting the diode. In the shown example embodiment, the longitudinal TSs and the longitudinal dielectric column 511 are segmented at mid-length for introducing the internal mid-layer substrate 505 for surfacemounting the diode 501 between the two LSs, which are shown in black extending longitudinally between opposing TSs 510. The diode is biased with a bias line 502 comprising thin resistive insulated wires that may be soldered to soldering pads 507, which may be positioned outside the dielectric column 511 for easy access. The soldering pads 507 are electrically connected to the LSs by conducting strips 508, which for example may be photoetched on the mid-layer substrate 505, and by metallized via-holes 506 through the mid-layer substrate 505. The two thin dielectric sheets 504 support the TSs 510. The TL is formed of metallized via-holes through the top and bottom thin dielectric sheets 504, the metallized via-holes 506 through the mid-layer substrate 505, and the thin conductors or metallized via-holes through the dielectric column 511. Other arrangements are possible for connecting the bias line to the diode. For example, in one embodiment the resistive insulated wires of the bias line may be soldered to the TSs so as to use the conductivity of the LSs to bias the diode. This alternative arrangement, however, may require that each TS includes a soldering pad, which might affect the performance of the CPSS operation. This arrangement might also complicate the physical addition of wave-impedance matching layers against a face of the CPSS. In another embodiment, two microwave diodes may be used, each surface-mounted on a different side of the mid-layer 505, in order to make symmetric the positioning of the mid-layer and the two diodes about the mid-length point of the longitudinal TL. Both diodes may be biased with the same bias line.

By electronically controlling the CPSS operation, the CPSS can act as a long range RFID (radio-frequency identification device) by modulating the CP polarization of the reflected beam of the CPSS according to an identification sequence that controls the forward-biasing of the diodes. As an example, a radar may interrogate a target LHCPSS with a series of EM pulses formed of a LHCP wave. The radar echo of the LHCPSS would be LHCP polarized whenever the LHCPSS operation was not defeated electronically. By electronically controlling the LHCPSS to become transparent for some of the EM pulses in the series of incident pulses, according to the identification sequence of the LHCPSS, the radar echo is missing the corresponding LHCP pulses in the series of reflected pulses. The radar can thus determine the identification sequence of the LHCPSS. In one embodiment, a metallic plane may be positioned at a separation distance behind the LHCPSS so as to always return a radar echo. The separation distance is not critical and can be for example 1 to 3 wavelengths. When the LHCPSS operation is not defeated, the radar echo is formed by the reflection off the LHCPSS and is LHCP polarized. When the LHCPSS operation is defeated electronically by turning on the diodes 501, the EM pulse of the radar passes through the LHCPSS, reflects off the metallic plate and becomes RHCP polarized, passes again through the LHCPS and returns to the radar as RHCP polarized. Hence no EM pulse is missing in the radar echo but the CP polarization of the EM pulses is RHCP whenever the LHCPSS operation was defeated electronically. The modulation of the CP polarization of the radar echo reveals the sequence of the identification code. For operation with a monostatic radar, a LHCPSS corner reflector instead of a planar LHCPSS, and a RHCPSS corner reflector instead of a planar metallic reflector, would be used so that the EM echo would return in the same direction as the incoming wave.

By electronically controlling the forward-biasing of the diodes of each pair of crankwires or group of crankwire pairs, the geometry of the active zone where the CPSS operation is preserved can be made programmable so as to confer new capabilities to the CPSS. For instance, in replacing the ground plane of an antenna with an electronically programmable CPSS, the radiation pattern of the antenna could be modified electronically in a programmable way. The radiation pattern of an antenna may also be modified in a non-programmable way by replacing its ground plane with a non-programmable CPSS.

Figure 37:
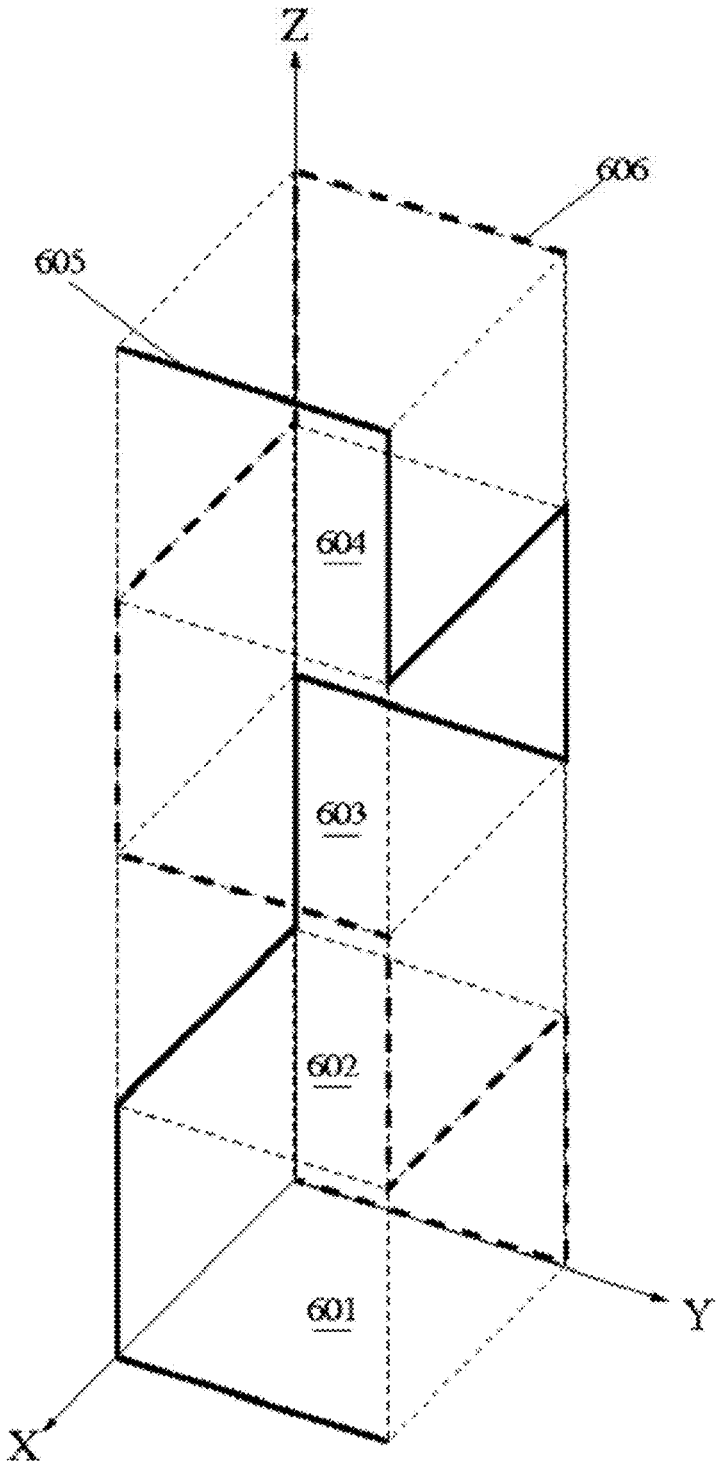
FIG. 37 is an isometric view of a 4-stage LHCPSS bifilar square helix.

Although example embodiments described hereinabove were described with reference to three-segment crankwires, other embodiments may employ electrically conducting crankwires that are formed of more than three segments. A crankwire that may have more than three segments may be referred to herein as a multi-segment crankwire (MSC). An MSC that operates as a CPSS element may generally include N LSs and (N+1) TSs for a total of (2N+1) conductive segments, with the two end-segments of the MSC being TSs; here $N \geq 1$. A plurality of such MSC, which are substantially 3D elements, that are disposed in a 2D array may form a CPSS having two opposing faces formed by the two transverse end-segments of the MSC. These two opposing faces of the CPSS are separated by a distance $N \cdot L$, where L is the length of one longitudinal element and may correspond in preferred embodiments to $\lambda/4$. A MSC with N LSs may be referred to herein as a N-level MSC or N-stage MSC. FIG. 37 illustrates by way of example a 4-stage MSC 605 shown in a solid black line with four LSs extending along the z-axis and defining four levels or stages 601 to 604 of the MSC. An N-stage MSC may be viewed as a conventional three-segment crankwire with added (N−1) pairs of segments, wherein each segment is orthogonal to the immediately preceding segment, and every second segment extending parallel to the same axis, which is referred to as the longitudinal axis; in a CPSS, the longitudinal axis is normal to the faces of the CPSS at the MSC location. Every additional stage of the N-stage MSC is formed by a pair of segments that include one LS and one TS, with each subsequent TS being rotated with respect to a TS immediately preceding it by 90° in the same direction for all TSs in the MSC, either clockwise or counter-clockwise, so as to preserve the handedness or chirality of the MSC.

In some embodiments, a CPSS may be formed of pairs of MSCs wherein in each such pair the MSCs are disposed so as to provide a 2-fold symmetry to the pair; similar to embodiments described hereinabove with reference to three-segments crankwires, such pairs of MSCs may also be referred to as double-crankwire elements, or DCEs. FIG. 37 illustrates a DCE which is composed of two 4-stage MSCs 605 and 606. A DCE of the type illustrated in FIG. 37 with $N \geq 1$ may also be referred herein to as a bifilar square helix crankwire or simply as a bifilar square helix, while a single N-stage MSC with $N \geq 1$ may be referred herein to as a monofilar square helix crankwire or simply as a monofilar square helix.

An MSC obtained by adding subsequent stages with a 90 degree azimuthal rotation and a quarter-wavelength longitudinal translation, is shaped as a 3D staircase approximation of a bifilar helix of increasing length, and is herein referred to as a bifilar square helix. The same process of 90 degrees azimuthal rotation and a quarter-wavelength longitudinal translation can be used with the single crankwire to obtain a monofilar instead of a bifilar square helix. It will also be appreciated that the term 'process' is not meant to describe the process of manufacturing the corresponding structure, but is merely used to describe its geometry.

An N-stage bifilar square helix wherein N is an odd integer number, has the same handedness but not the same appearance when viewed on-axis from either end when the helix is rotated 180 degrees about the X or the Y axis. There is a 90 degree azimuthal rotation between the two views. Consequently, this introduces a 180 degree phase difference between the two corresponding CP on-axis responses, and an effective 90 degree rotation of the incidence plane when the incidence direction is oblique. However, when N is an even integer number, the N-stage bifilar square helix has exactly the same appearance when viewed on-axis from either end when the helix is rotated 180 degrees about the X or the Y axis. This eliminates the phase difference and the effective azimuthal rotation of the incidence plane. Thus, a CPSS formed of a 2D array of 2N-stage bifilar square helices, with N≥1, might be more suitable for applications that rely on the CPSS response being the same in both phase and magnitude regardless of which CPSS face the incident wave was incident on. Similarly, the 4N-stage monofilar square helix wherein N is an integer number, with N≥1, has exactly the same appearance when viewed on-axis from either end. Thus, a CPSS formed of a 2D array of 4N-stage monofilar square helices, with N≥1, might be more suitable for applications that rely on the CPSS response being the same in both phase and magnitude regardless of which CPSS face the incident wave was incident on.

When the electrical length of each TS is 3λ/8 and the electrical length of each LS is λ/4 as with Pierrot's element, the total length of a MSC in a 4-stage monofilar square helix is 2.875λ which is not a resonance length. To obtain a resonance length of 3λ, the electrical length of each TS may be selected to be substantially 0.40λ. Similarly, when the electrical length of each TS is λ/4 and the electrical length of each LS is λ/2 as with Tilston's element, the total length of a MSC in a 2-stage bifilar square helix is 2.75λ which is not a resonance length. To obtain a resonance length of 3λ, the electrical length of each TS may be selected to be substantially λ/3.

The 2-stage square helix which is nominally λ/2 thick along the longitudinal axis may compare favourably in terms of mass, weight and thickness to the CP-LP-CP cascade design that uses a total of 7 or more layers of meanderline CP-LP converters and a wire grid. However, the frequency bandwidth of the MSC-based CPSS might become more limited as the number of stages increases because the longer a wire, the more frequency dependent it becomes.

Microwaves diodes may be used at the mid-length of the longitudinal half-wavelength TL of every stage of an EM coupled pair of MSCs so as to disable their CPSS operation.

CPSS elements may also be in the form of smoothly curved helices instead of square helices. An array of randomly oriented helices of the same handedness may have a net non-null chirality in spite of the random orientation of each helix because the handedness of each helix is the same when seen on-axis from either end. This may enable using real molecules as CPSS elements at optical or higher frequencies, since many molecules, including the DNA molecules, are conductive.

Figure 38:
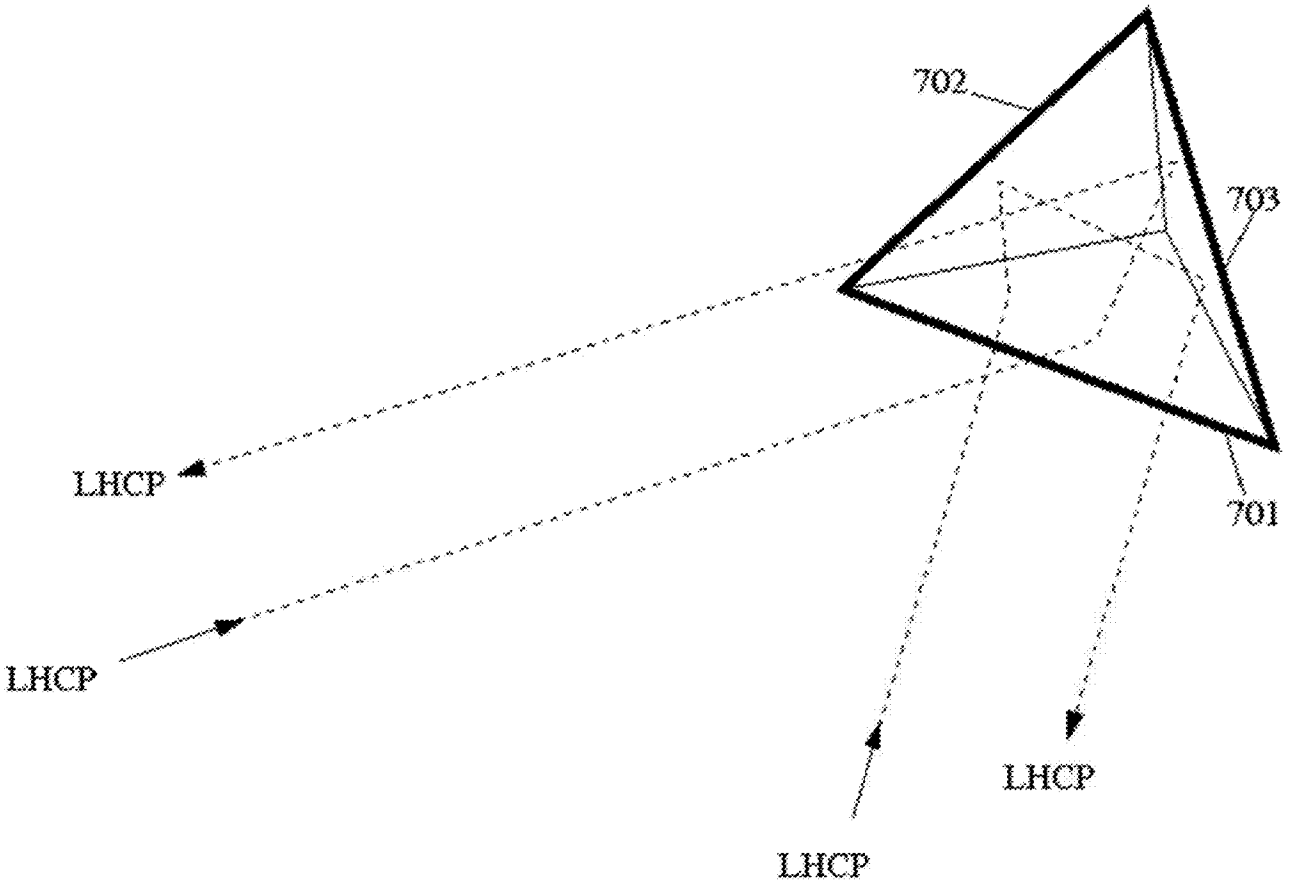
FIG. 38 is a schematic diagram of a CPSS corner reflector formed of three LHCPSS reflector arrays.

FIG. 38 shows a schematic diagram of a retro-reflector or corner-reflector that may be composed of three reflecting planes 701-703 with each reflecting plane perpendicular to the other two reflecting planes so as to form a 3D corner. A retro-reflector may return an EM echo in the same direction as that of the incoming wave. However, because the sense of CP reverses with every bounce off a metallic surface, the polarization sense of the CP echo from a corner reflector that has metallic surfaces for reflecting planes, depends on the number of internal bounces that the incoming CP wave has undergone between the three metallic surfaces and thus, the polarization sense of the CP echo depends on the direction of the incoming CP wave. Only even numbers of internal bounces return an echo that is polarized with the sense of the incoming CP wave. A retro-reflector or corner-reflector wherein the three reflecting planes 701-703 are composed of three CPSSs of the same handedness instead of three metallic surfaces may also return an EM echo in the same direction as that of the incoming CP wave if the sense of the incoming CP wave corresponds to the handedness of the three CPSSs. However, because the sense of CP does not reverse when bouncing off a CPSS, the polarization sense of the CP echo may be the same as that of the incident CP wave irrespective of the number of internal bounces. When the sense of the incoming CP wave does not correspond to the handedness of the CPSSs, the corner reflector may appear to be substantially transparent. By way of example, FIG. 38 illustrates a CPSS corner reflector that is composed of three plane LHCPSS arrays and thus reflects LHCP waves and is substantially transparent for RHCP waves. In other embodiments, the CPSS corner reflector of FIG. 38 may be composed of three plane RHCPSS arrays. In embodiments wherein one or more of the three CPSSs are made electronically programmable with the use of microwave diodes, the corner-reflector may provide new capabilities, as for instance retro-reflection polarized with the sense of the incoming CP wave for only some incoming directions.

The above-described exemplary embodiments are intended to be illustrative in all respects, rather than restrictive. The CPSS of the present disclosure is capable of many variations in detailed implementation that can be derived from the description contained herein by a person skilled in the art. For example, it will be appreciated that the ends of the TSs can be shaped not only as square ends as shown in the figures hereinabove, but also as other shapes, such as for example rounded or pointed ends. Of course numerous other embodiments may be envisioned without departing from the scope of the disclosure. All such variations and modifications are considered to be within the scope and spirit of the present disclosure as defined by the following claims.

I claim:

1. A circular polarization selective surface (CPSS) comprising:

a plurality of double crankwire elements (DCEs) disposed so as to form a two-dimensional (2D) array, each double crankwire element (DCE) comprising two crankwires of the same handedness, each crankwire comprising a longitudinal segment electrically connecting two transverse segments, each of the segments being electrically conductive, the two crankwires in each DCE disposed to impart a two-fold rotational symmetry to the DCE with respect to a longitudinal symmetry axis that is generally perpendicular to the CPSS at a location of the DCE, the transverse segments of the plurality of the DCEs defining two opposing faces of the CPSS;

wherein the plurality of DCEs comprise pairs of crankwires wherein the longitudinal segments in each of said pairs are generally parallel to each other and adjacently spaced so as to form a longitudinal transmission line;

wherein the transverse segments of the crankwires in each of the plurality of DCEs are disposed to facilitate an electromagnetic (EM) coupling between nearest transverse segments of crankwires of adjacent DCEs, so as to define pairs of EM coupled transverse segments wherein at least a portion of one transverse segment directly faces at least a portion of another transverse segment along a coupling length P and is spaced apart therefrom to define a gap of width therebetween, and wherein said gap has a width G of at most 2P, and wherein the coupling length P defines a length of said gap.

2. The CPSS according to claim 1, wherein the two transverse segments of each crankwire are spaced apart in the longitudinal direction by an electrical distance of substantially 90°, the transverse segments have an electrical length of substantially 90° each, and the longitudinal transmission line has an electrical length of substantially 180°.

3. The CPSS according to claim 2 further comprising a substrate made of a dielectric material for supporting the crankwires, wherein the two transverse segments of each crankwire are formed of conducting strips disposed on opposite faces of the substrate, and wherein the longitudinal segments are embedded in the dielectric material of the substrate.

4. The CPSS according to claim 3, wherein the substrate is shaped so that, for a given frequency of an incident electromagnetic wave, an electrical thickness of the substrate in the direction along the longitudinal segments of the crankwires is substantially 90 degrees.

5. The CPSS according to claim 4 wherein the substrate comprises two sets of parallel beams, wherein:

the beams of one set are disposed so as to cross the beams of the other set so as to form a periodic 2D grid, the longitudinal segments of the crankwires are embedded at beam intersections, the transverse segments of each crankwire are disposed upon the beams of the first and second sets extending from the beam intersection, and the transverse segments of each pair of the EM coupled transverse segments are disposed upon the same beam.

6. The CPSS according to claim 5 wherein the beams are connected at beam intersections by dielectric longitudinal columns, each dielectric longitudinal column comprising at least a portion of one of the longitudinal transmission lines.

7. The CPSS according to claim 3 wherein the substrate has an opening or thinning in regions away from the longitudinal segments so as to make an electrical thickness of the substrate to be half of an electrical length of one of the longitudinal transmission lines.

8. The CPSS according to claim 3 wherein the longitudinal segments comprise metalized via-holes extending through the substrate.

9. The CPSS according to claim 2 further comprising one or more microwave diodes disposed to connect, in one or more of the pairs of crankwires, mid-length points of the longitudinal segments forming the longitudinal transmission line, for electronically suppressing a scattering of an incident wave by the one or more of the pairs of crankwires upon turning on the diodes with a forward-biasing voltage or current.

10. The CPSS according to claim 1 comprising at least one DCE wherein each of the transverse segments of the two crankwires thereof are EM coupled to a transverse segment of an adjacent DCE, facing said segment along the coupling length P with the gap of width of at most G therebetween.

11. The CPSS according to claim 1, wherein the 2D array formed by the plurality of DCEs is periodic or quasi-periodic.

12. The CPSS according to claim 11, wherein the 2D array formed by the plurality of DCEs comprises one of: a 2D rectangular array of DCEs or a 2D triangular array of DCEs.

13. The CPSS according to claim 12, wherein the 2D array formed by the plurality of DCEs comprises one of: a 2D square array of DCEs or a 2D equilateral triangular array of DCEs.

14. The CPSS according to claim 13, wherein the 2D array formed by the plurality of DCEs comprises an equilateral triangular array of DCEs, and the transverse segments of each of the DCEs are aligned substantially at 15 degrees to a line connecting nearest nodes of the equilateral triangular array.

15. The CPSS according to claim 1 wherein the transverse segments in each pair of the EM coupled transverse segments extend alongside each other for at least a fraction of a length thereof.

16. The CPSS according to claim 15 wherein at least one of the transverse segments of the pair comprises a serrated or meandering portion so as to modify the EM coupling between the two transverse segments.

17. The CPSS according to claim 1 wherein at least some of the transverse segments comprise an end portion that is bent or flared, so as to provide an enhanced end-to-end EM coupling between the transverse segments in each pair of the EM coupled transverse segments.

18. The CPSS according to claim 1 further comprising:

a first sheet of a dielectric material supporting the transverse segments of the DCEs at one of the two opposing faces of the CPSS;

a second sheet of a dielectric material spaced apart from the first sheet and supporting the transverse segments of the DCEs at the other one of the two opposing faces of the CPSS; and a plurality of longitudinal columns of a dielectric material connecting the first and second sheets and supporting the longitudinal segments of the crankwires.

19. The CPSS according to claim 1 wherein the two crankwires of each of the DCEs are disposed with two of the transverse segments thereof being collinear.

20. The CPSS according to claim 1 further comprising one or more wave-impedance matching layers disposed at at least one of the two opposing faces of the CPSS.

* * * * *